US006042280A

United States Patent [19]

Yamaguchi et al.

[11] Patent Number: 6,042,280

[45] **Date of Patent: *Mar. 28, 2000**

[54] TAPE LABEL PRINTING DEVICE

[75] Inventors: Koshiro Yamaguchi, Kasugai; Mitsuharu Hattori, Nagoya, both of Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/854,351

[22] Filed: May 12, 1997

Related U.S. Application Data

[63] Continuation-in-part of application No. 08/450,356, May 25, 1995, Pat. No. 5,653,542.

[30] Foreign Application Priority Data

May 13, 1996 [JP] Japan ..... 8-117451

[51] Int. Cl.[7] ..... B41J 2/35

[52] U.S. Cl. ..... 400/120.16; 400/613; 400/615.2

[58] Field of Search ..... 400/120.02, 120.04, 400/207, 208, 231, 240, 240.4, 613, 691, 692, 693, 120.16

[56] References Cited

U.S. PATENT DOCUMENTS

| | | | |
|---|---|---|---|
| D. 317,172 | 5/1991 | Miyamoto et al. | D18/12 |
| D. 342,275 | 12/1993 | Cooper | D18/12 |
| D. 361,342 | 8/1995 | Hattori et al. . | |
| 4,402,619 | 9/1983 | Paque et al. | 400/36 |
| 4,557,617 | 12/1985 | Richardson et al. | 400/208 |
| 4,776,714 | 10/1988 | Sugiura et al. | 400/248 |
| 4,815,871 | 3/1989 | McGourty et al. | 400/120 |
| 4,815,875 | 3/1989 | Richardson et al. | 400/208.1 |
| 4,927,278 | 5/1990 | Kuzuya et al. | 400/208 |
| 4,930,913 | 6/1990 | Basile | 400/120 |
| 4,966,476 | 10/1990 | Kuzuya et al. | 400/208 |
| 5,009,531 | 4/1991 | Koike . | |
| 5,017,942 | 5/1991 | Asakura et al. | 346/76 PH |
| 5,022,771 | 6/1991 | Paque | 400/120 |
| 5,056,940 | 10/1991 | Basile | 400/120 |
| 5,078,523 | 1/1992 | McGourty et al. | 400/613 |
| 5,120,147 | 6/1992 | Ozaki | 400/649 |
| 5,165,806 | 11/1992 | Collins | 400/120 |
| 5,188,469 | 2/1993 | Nagao et al. | 400/615.2 |

(List continued on next page.)

FOREIGN PATENT DOCUMENTS

| | | | |
|---|---|---|---|
| 24609 | 2/1994 | Benelux TM/Des. Off. . | |
| 386937 | 9/1990 | European Pat. Off. | 400/240 |
| A1 0-769385 | 4/1997 | European Pat. Off. . | |
| 940681 | 2/1994 | France . | |
| A1 40-23784 | 2/1991 | Germany . | |
| 9401507 | 2/1994 | Germany . | |
| 62-189187 | 8/1987 | Japan . | |
| 63-222883 | 9/1988 | Japan | 400/240 |
| 1-101180 | 4/1989 | Japan . | |
| 2-106555 | 4/1990 | Japan . | |
| 5-84994 | 4/1993 | Japan . | |
| 121073 | 2/1994 | Switzerland . | |
| 2037151 | 8/1994 | United Kingdom . | |

OTHER PUBLICATIONS

Patent Abstracts of Japan, vol. 012, No. 036, Feb. 3, 1988.
Patent Abstracts of Japan, vol. 013, No. 311, Jul. 17, 1989.

*Primary Examiner*—Ren Yan
*Attorney, Agent, or Firm*—Oliff & Berridge, PLC

[57] ABSTRACT

An ink ribbon is serially coated by inks in the three primary colors. A distinction portion is provided at each boundary portion between different colored inks. Each distinction portion is formed from two lines, one having a width common for all the distinction portions and regardless of corresponding ink color and one set with a width peculiar to particular ink color. Because this decreases the region taken up by the distinction portion, the printable region on the ink ribbon can be increased.

17 Claims, 35 Drawing Sheets

U.S. PATENT DOCUMENTS

| | | | |
|---|---|---|---|
| 5,195,835 | 3/1993 | Collins | 400/248 |
| 5,232,297 | 8/1993 | Kitazawa . | |
| 5,277,503 | 1/1994 | Nagao | 400/208 |
| 5,302,034 | 4/1994 | Kitazawa | 400/120 |
| 5,348,406 | 9/1994 | Yoshiaki et al. | 400/615.2 |
| 5,350,243 | 9/1994 | Ichinomiya et al. | 400/208 |
| 5,374,132 | 12/1994 | Kimura | 400/586 |
| 5,411,339 | 5/1995 | Bahrabadi et al. | 400/56 |
| 5,419,643 | 5/1995 | Matsuura | 400/208 |
| 5,443,319 | 8/1995 | Sugiura et al. | 400/208 |
| 5,447,378 | 9/1995 | Otsuka et al. | 400/61 |
| 5,454,650 | 10/1995 | Yamaguchi | 400/208 |
| 5,480,237 | 1/1996 | Tanahashi | 400/120.02 |
| 5,500,669 | 3/1996 | Yamashita et al. | 400/208 |
| 5,533,818 | 7/1996 | Bahrabadi | 400/208 |
| 5,536,092 | 7/1996 | Yamaguchi | 400/231 |
| 5,538,352 | 7/1996 | Sugiura | 400/615.2 |
| 5,595,447 | 1/1997 | Takayama et al. | 400/231 |
| 5,620,268 | 4/1997 | Yamaguchi et al. | 400/613 |
| 5,636,926 | 6/1997 | Yamaguchi | 400/120.02 |
| 5,653,542 | 8/1997 | Sugimoto et al. | 400/248 |
| 5,727,888 | 3/1998 | Sugimoto | 400/586 |
| 5,771,803 | 6/1998 | Takami | 400/208 |

FIG. 16

| NO | SWITCH NUMBER 1 | 2 | 3 | 4 | 5 | 6 | 7 | 8 | WIDTH | TAPE TYPE | RIBBON TYPE |
|---|---|---|---|---|---|---|---|---|---|---|---|
| 1 | ON | OFF | OFF | OFF | OFF | OFF | OFF | OFF | 32 | RECEPTER | THREE PRIMARY COLOR STRIPED RIBBON |
| 2 | ON | ON | OFF | OFF | OFF | OFF | OFF | OFF | 32 | LAMINATE | ALL COLORS COMMON |
| 3 | ON | ON | ON | OFF | OFF | OFF | OFF | OFF | 32 | RECEPTER | RED MONOCHROME |
| 4 | ON | ON | ON | ON | OFF | OFF | OFF | OFF | 32 | RECEPTER | GREEN MONOCHROME |
| 5 | ON | ON | ON | ON | OFF | OFF | OFF | OFF | 32 | RECEPTER | BLACK MONOCHROME |
| 6 | ON | ON | ON | ON | ON | OFF | OFF | OFF | 32 | RECEPTER | YELLOW MONOCHROME |
| 7 | ON | OFF | OFF | OFF | OFF | OFF | OFF | ON | 18 | RECEPTER | THREE PRIMARY COLOR STRIPED RIBBON |
| 8 | ON | ON | OFF | OFF | OFF | OFF | OFF | ON | 18 | LAMINATE | ALL COLORS COMMON |
| 9 | ON | ON | ON | OFF | OFF | OFF | OFF | ON | 18 | RECEPTER | RED MONOCHROME |
| 10 | ON | ON | ON | ON | OFF | OFF | OFF | ON | 18 | RECEPTER | GREEN MONOCHROME |
| 11 | ON | ON | ON | ON | OFF | OFF | OFF | ON | 18 | RECEPTER | BLACK MONOCHROME |
| 12 | ON | ON | ON | ON | ON | OFF | OFF | ON | 18 | RECEPTER | YELLOW MONOCHROME |

FIG. 17 (a)

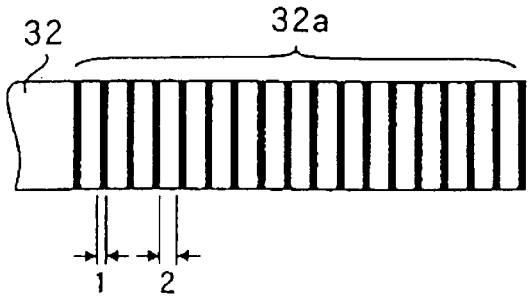

FIG. 17 (b)

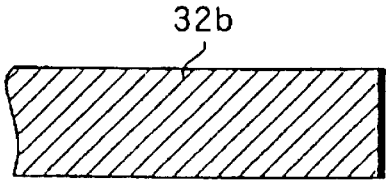

| COLOR | THREE PRIMARY COLOR COMPOSITION | | |
|---|---|---|---|
| | Y(YELLOW) | M(MAGENTA) | C(CYAN) |
| RED | ○ | ○ | – |
| PINK | – | ○ | – |
| BLUE | – | ○ | ○ |
| LIGHT BLUE | – | – | ○ |
| GREEN | ○ | – | ○ |
| YELLOW | ○ | – | – |
| BLACK | ○ | ○ | ○ |

FIG. 23

| | COLOR DATA | |
|---|---|---|
| A | RED | FOURTH COLOR |
| B | RED | |
| SP | | |
| C | GREEN | THIRD COLOR |
| D | GREEN | |
| E | GREEN | |
| SP | | |
| F | BLACK | SECOND COLOR |
| G | BLACK | |
| SP | | |
| H | YELLOW | FIRST COLOR |

FIG. 24

| | Y | M | C |
|---|---|---|---|
| A | ○ | ○ | |
| B | ○ | ○ | |
| SP | | | |
| C | ○ | | ○ |
| D | ○ | | ○ |
| E | ○ | | ○ |
| SP | | | |
| F | ○ | ○ | ○ |
| G | ○ | ○ | ○ |
| SP | | | |
| H | ○ | | |

TAPE LABEL PRINTING DEVICE

This is a continuation-in-part of application Ser. No. 08/450,356, filed May 25, 1995, now U.S. Pat. No. 5,653, 542.

BACKGROUND OF THE INVENTION

1. Field of the Invention

Present invention relates to an ink ribbon used in a print device for printing characters and other images on a printing medium using a thermal head and based on inputted print information.

2. Description of the Related Art

Conventionally, there has been known a device for preparing tape-shaped labels for attaching to the spine of files and the like. For example, Japanese Laid-Open Patent Application No. HEI-5-84994 describes a tape-shaped label producing device for printing characters and marks, inputted using a keyboard, for example, onto a tape-shaped printing medium using an ink ribbon and a thermal head. This type of label producing device includes a keyboard, a display, and a thermal printing type printing mechanism. By using this label producing device, characters and marks can be printed on printing tapes, which serve as a printing media, in a variety of character sizes and fonts. Examples of print tapes include tapes with widths of 6, 9, 12, 18, or 24 mm.

The tape-shaped labels produced by printing characters and texts in the above described manner need not to be used as labels for the spines of files. The tape-shaped labels are also appropriate for attaching to cassette tapes, video tapes, or to their cases. Because these tape-shaped labels have a variety of applications, there has been a demand for producing colorful labels, wherein a portion of the characters or text character trains are printed in colors changed according to genre or recorded content of the file or tape to which the label is attached.

SUMMARY OF THE INVENTION

The following two methods can be used to print characters and texts in a plurality of colors. The first method will be referred to as multi-color printing and the second method will be referred to as full-color printing, hereinafter.

In multi-color printing, the label producing device is configured so as to able to both feed and rewind the print tape. A ribbon cassette housing the ink ribbon and a separate tape cassette housing the print tape are configured so that the ribbon cassette is detachably mountable in the tape cassette. Multi-color printing is performed while exchanging different colored ribbon cassettes. However, the user must have a ribbon cassette for each different color set to the text and characters to be printed, when he or she sets a great number of colors to the text, he or she must purchase all of the corresponding ribbon cassettes, which places a great burden on the user. Otherwise, the user must limit the number of colors he sets to the text. Additionally, when the user purchases a great number of ribbon cassettes and sets many different colors to the text, he or she must exchange ribbon cassettes for each color to be printed, which is very troublesome.

In full-color printing, each ink ribbon is serially divided into a plurality of regions, each region being coated with ink in one of the three primary colors. Full-color printing is performed by overlapping the three primary colors. Using this method, printing can be performed in a plurality of colors using only the three primary colors. Moreover, there is no need to exchange ink ribbon cassettes for each printing of a different color. Therefore, this method is very easy and convenient.

As shown in FIG. 47, indication portions 314, 315, 316 are formed on the ink ribbon for distinguishing which color is disposed in each region. Each indication portion 314 to 316 includes sensor marks, such as vertical lines having the same width. The tape-shaped label producing device is provided with a transmission type photo sensor for determining the ink color using the distinction portions 314 to 316. The type of color of the corresponding region is determined by using the photosensor to count the number of sensor marks, that is, the number of vertical lines.

However, when the number of colors increases greatly, the number of sensor marks also increases, as does the region required for the distinction portion itself. This generates a problem in that the overall printable region along the length of the ink ribbon must be shortened to accommodate the larger distinction portion, which increases running costs.

It is an objective of the present invention to overcome the above-described problems and to provide an ink ribbon serially coated with a plurality of different colored inks, wherein the printable region of the ink ribbon is increased by reducing the region required for the distinction portions, thereby reducing running costs of the ink ribbon and of the ribbon cassette housing the ink ribbon.

In order to achieve the above-described objectives, an ink ribbon according to the present invention includes: a web-shaped ribbon substrate; print regions serially juxtaposed along a length of the ribbon substrate, each print region being coated with one of a plurality of different colored inks; and distinction portions distinguishing different colored inks of the print regions, each distinction portion being formed on the ribbon substrate at a boundary portion of a corresponding print region, each distinction portion being formed by a plurality of marks including: at least one common mark common to all the distinction portions; and a particular mark particular for its corresponding ink color.

Accordingly, ink color is determined based on information obtained from a mark common to all, and so unrelated to any, ink colors and a mark peculiar to each particular color. Each mark can be formed in a narrow space so that the region required for the distinction portion can be reduced. Consequently, the usable region of the ink ribbon can be increased so that running costs of the ink ribbon can be reduced.

According to another aspect of the present invention, the in each distinction portion: the at least one common mark is a line extending across a width of the ribbon substrate, the line having a width extending parallel with the length of the ribbon substrate and being common to all corresponding lines of the distinction portions; and the particular mark includes another line extending across the width of the ribbon substrate, the other line having a width particular for its corresponding ink color.

Therefore, by determining the ratio of the width of the common line, whose width is set fixed regardless of ink color, and the width of the peculiar line whose width is set peculiar for each ink color, and then controlling the tape-shaped label producing device to determine ink color based on the ratio, the region required for the ink color distinction portion can be reduced. Consequently, the usable region of the ink ribbon can be increased so that running costs of the ink ribbon can be reduced.

According to another aspect of the present invention, the above-described ink ribbon is housed in a ribbon cassette.

When this type of ribbon cassette is used mounted in a tape-shaped label producing device, because usable region of the ink ribbon is increased, more printing can be performed using this type of ribbon cassette than using a ribbon cassette housing a conventional ink ribbon of the same length.

When the print tape, serving as the printing medium, and the ink ribbon are housed in the same cassette, the ribbon cassette can be used mounted in a tape-shaped label producing device and the amount of printing on the ink ribbon and the print tape can be increased compared to the conventional situation.

According to another aspect of the present invention, the above-described ink ribbon cassette is used in combination with a tape cassette including: a tape cassette case; a print tape housed in the tape cassette case; and a ribbon cassette mounting portion formed in the tape cassette case and into which the ribbon cassette is mounted.

With this configuration, the same tape cassette can be used for used for multi-color printing, wherein printing is performed by exchanging different color ribbon cassettes, and for full-color printing, wherein colors are reproduced by overlapping three primary colors using the ribbon cassette according to the present invention.

According to still another aspect of the present invention, the above described ink ribbon cassette is used in combination with a tape-shaped label producing device including: a print mechanism that prints on the print tape using the ink ribbon; a transport mechanism that imparts relative movement between the ink ribbon and the print tape; an input unit that inputs the images to be printed on the print tape; an image storage that stores the images inputted by the input unit; a print color setting unit that sets a plurality of print colors to the images stored in the image storage; an ink ribbon detection unit that detects, based on the distinction portions, position of print regions of the ink ribbon with respect to the printing mechanism; and a control unit that controls, based on detection of the ink ribbon detection unit, the transport mechanism to transport the ink ribbon relative to the print tape to bring required ones of the print regions into confrontation with desired positions of the print tape at the print mechanism and that controls the print mechanism, based on the images stored in the image storage, to print corresponding ones of the different colored inks onto the print tape to form the images in the plurality of print colors set by the print color setting unit.

BRIEF DESCRIPTION OF THE DRAWINGS

The above and other objects, features and advantages of the invention will become more apparent from reading the following description of the preferred embodiment taken in connection with the accompanying drawings in which:

FIG. 6 (B) is a schematic cross-sectional side view showing the positional relationship shown in FIG. 6 (A) at an intermediate stage in the process for mounting the ribbon cassette to the tape cassette;

FIG. 6 (C) is a schematic cross-sectional side view showing positional relationship shown in FIG. 6 (A) after the ribbon cassette has been completely mounted in the tape cassette;

FIG. 11 (B) is a cross-sectional view showing the platen roller;

FIG. 12 (B) is a cross-sectional view showing the platen subroller;

FIG. 16 is schematic view showing a ribbon cassette determination table stored in a ROM of the device;

FIG. 17 (*a*) is a schematic view showing a plurality of line shaped sensor marks for indicating an end portion of an ink ribbon;

FIG. 17 (*b*) is a schematic view showing a transparent portion for indicating an end portion of an ink ribbon;

FIG. 23 is a view showing multi-color data stored in a RAM of the control system;

FIG. 24 is a view showing full-color data stored in the RAM;

FIG. 30 (*b*) is a schematic view showing the preformatted tape of FIG. 30 (*a*) printed with label information;

FIG. 38 (*b*) is a cross-sectional view showing the platen roller of the second embodiment;

FIG. 39 (*b*) is a cross-sectional view showing the platen subroller of the second embodiment;

DETAILED DESCRIPTION OF THE PREFERRED EMBODIMENTS

Preferred embodiments of the present invention will be referred to while referring to the accompanying drawings. First, an explanation for a first embodiment of the present invention will be provided. It should be noted that in the present embodiment, the ink ribbon according to the present invention is used in a tape-shaped label producing device.

Figure 1:
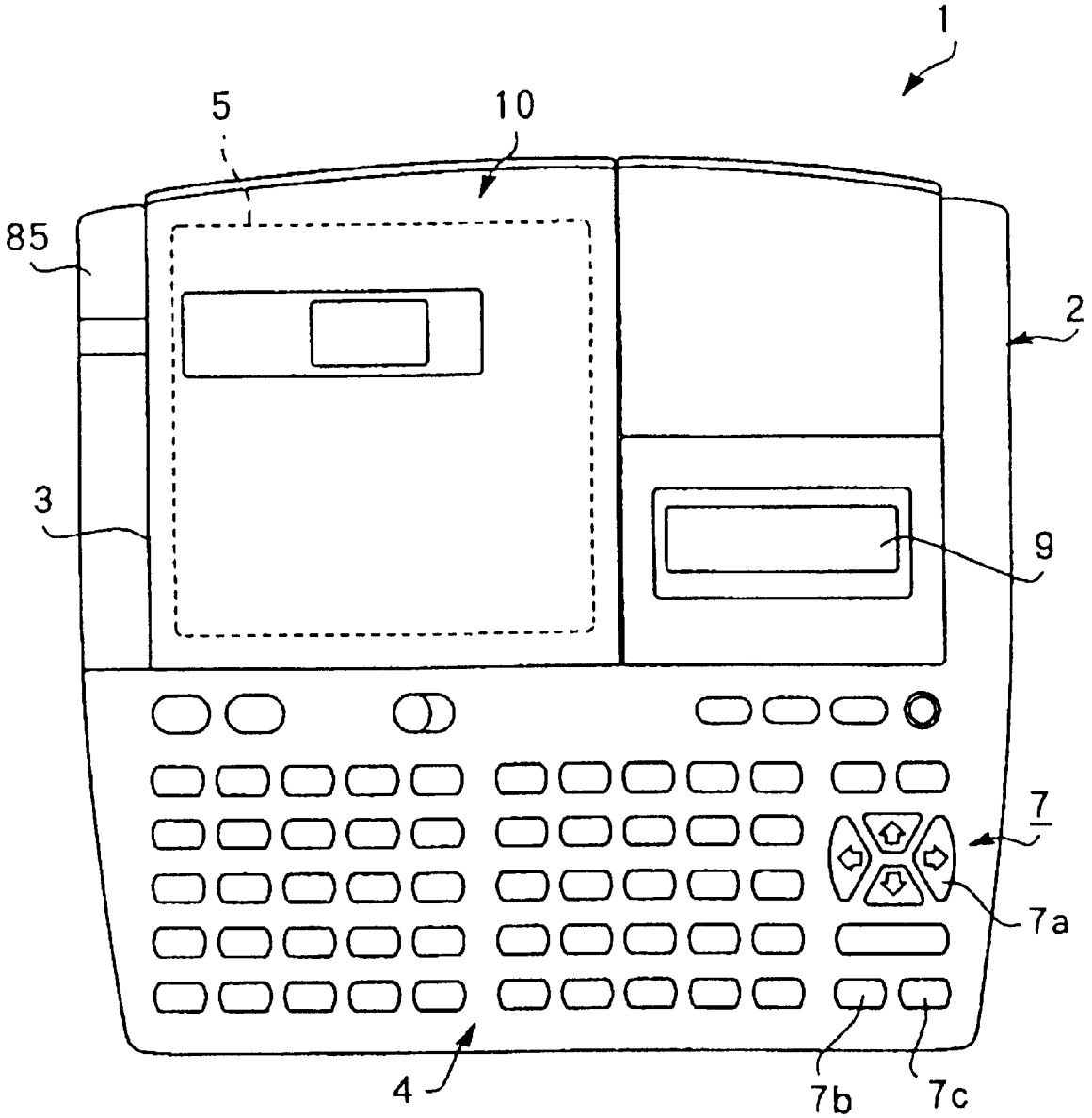
FIG. 1 is a plan view schematically showing a tape-shaped label producing device according to the present invention.

FIG. 1 is a plan view schematically showing a tape-shaped label producing device according to the first embodiment.

The tape label producing device 1 is provided with a main case 2 and a cassette cover 3 at the upper surface of the main case 2. The cassette cover 3 can be opened and closed in order to cover a cassette housing portion 5 in which is mounted a tape cassette to be described later. A variety of components are disposed on the main case 2 including; a keyboard 4 for inputting characters and the like; a switch panel 7 for performing various operations: and a liquid crystal display portion 9 for displaying inputted characters and the like.

Two types of cassettes are usable in the tape-shaped label producing device. The two types include: a receptor type cassette housing both a print tape and an ink ribbon; and a laminate type cassette housing, instead of the print tape, a transparent tape and a two-sided adhesive tape. The transparent tape is adhered to the two-sided adhesive tape and used as the print tape.

There are two types of receptor type cassettes. One is an integral tape/ribbon cassette housing both a print tape and an ink ribbon in the same cassette. The second type is a tape/ribbon separated cassette housing the print tape and the ink ribbon in separate tape and ribbon cassettes, wherein, the ribbon cassette is detachably mountable in the tape cassette.

Either receptor type or laminate type cassettes can be used in the tape-shaped label producing device of the first embodiment. However, the first embodiment will be explained for the case when a laminate type tape/ribbon separate cassette is mounted in the tape-shaped label producing device.

Figure 2:
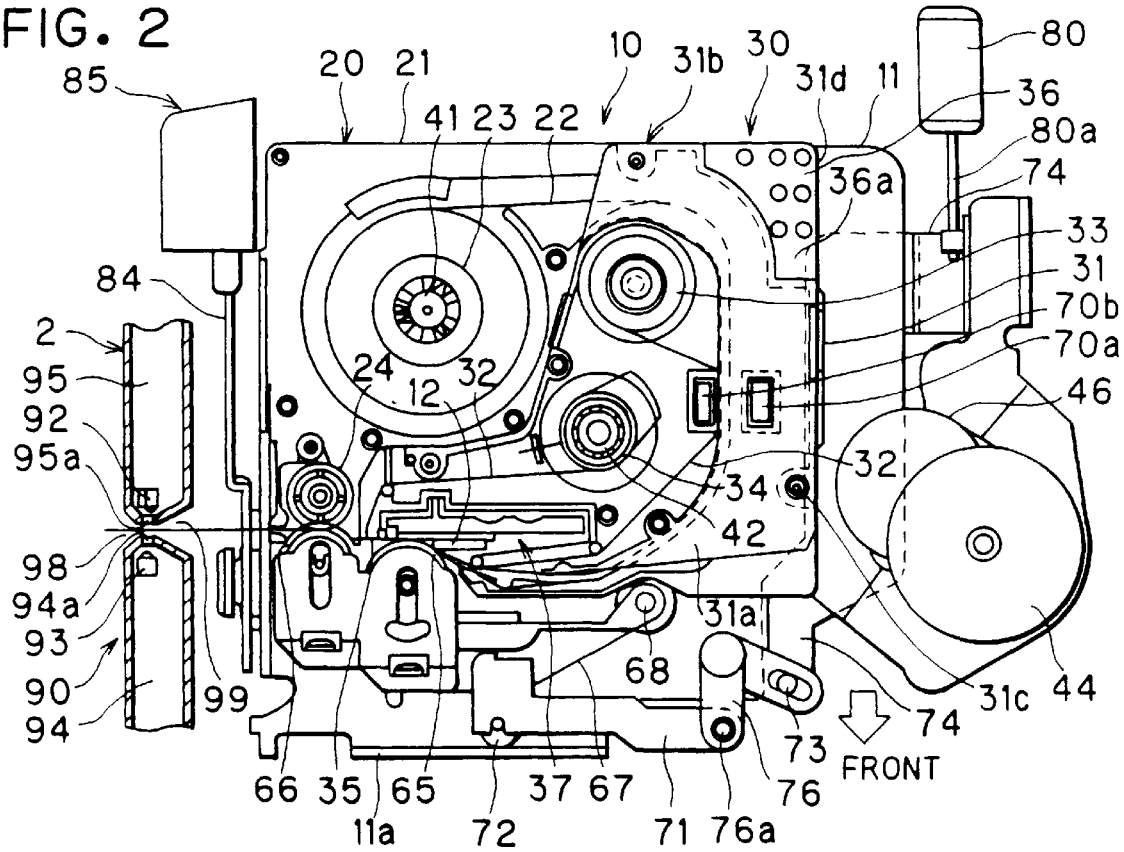
FIG. 2 is a plan view showing a cassette housing portion of the tape-shaped label producing device mounted with a tape cassette and a ribbon cassette.

FIG. 2 is a plan view showing the cassette housing part in the tape-shaped label producing device 1 mounted with a tape cassette 20 and a ribbon cassette 30. The tape cassette 20 includes a print tape 22 and a tape spool 23 for winding up the print tape 22. The ribbon cassette 30 includes an ink ribbon 32 and a ribbon spool 33 for winding up the ink ribbon 32.

The tape cassette 20 includes a tape case 21; the tape spool 23 rotatably disposed in the tape case 21; and a tape feed roller 24 housed in the tape case 21 and for transporting the print tape 22.

The ribbon cassette 30 includes: a ribbon case 31; the ribbon spool 33 rotatable housed in the ribbon case 31 and for winding the ink ribbon 32; and a ribbon take-up spool 32 rotatable provided in the ribbon case 31 and for taking up the ink ribbon 32. Further, a head housing portion 37 is formed in the ribbon cassette 30. A thermal head 12 to be described later is inserted from underneath into the head housing portion 37.

The ink ribbon 32 and the print pate 22 are guided in an overlapped condition to the thermal head 12 inserted into the head insertion portion 37 in a manner to be described later. A separation member 35 is provided to the ribbon case 31 at a position adjacent to the head insertion portion 37. The separation member 35 bends the ink ribbon 32 at a substantially acute angle, thereby separating the ink ribbon 32 from the print tape 22. The ink ribbon 32 is then is taken up by the ribbon take-up spool 34.

Figure 3:
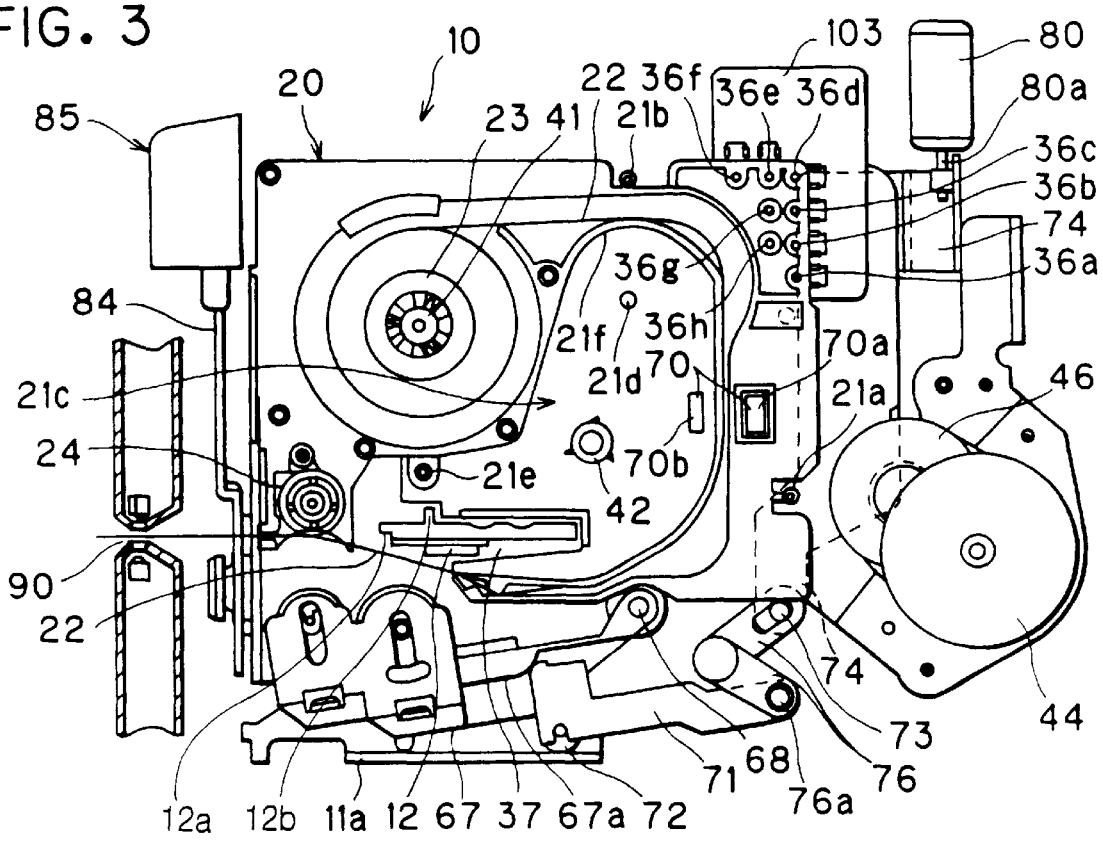
FIG. 3 is a plan view showing the cassette mounting portion of the tape-shaped label producing device mounted with the tape cassette only.

Next, an explanation will be provided for the tape-shaped label producing device 1. As shown in FIG. 3, the main frame 11 rotatably supports a variety of components including: a tape take-up cam 41 engageable with the tape spool 23 of the tape cassette 20; a ribbon take-up cam 42 engageable with the ribbon take-up spool 34 of the ribbon cassette 30; and a tape drive cam 43 engageable with the tape feed roller 24.

The thermal head 12 for printing on the print tape 22 is provided in the tape-shaped label producing device 1. The thermal head 12 is inserted into the head housing portion 37 of the ribbon cassette 30 when the ribbon cassette 30 is mounted in the tape-shaped label producing device 1.

Figure 4:
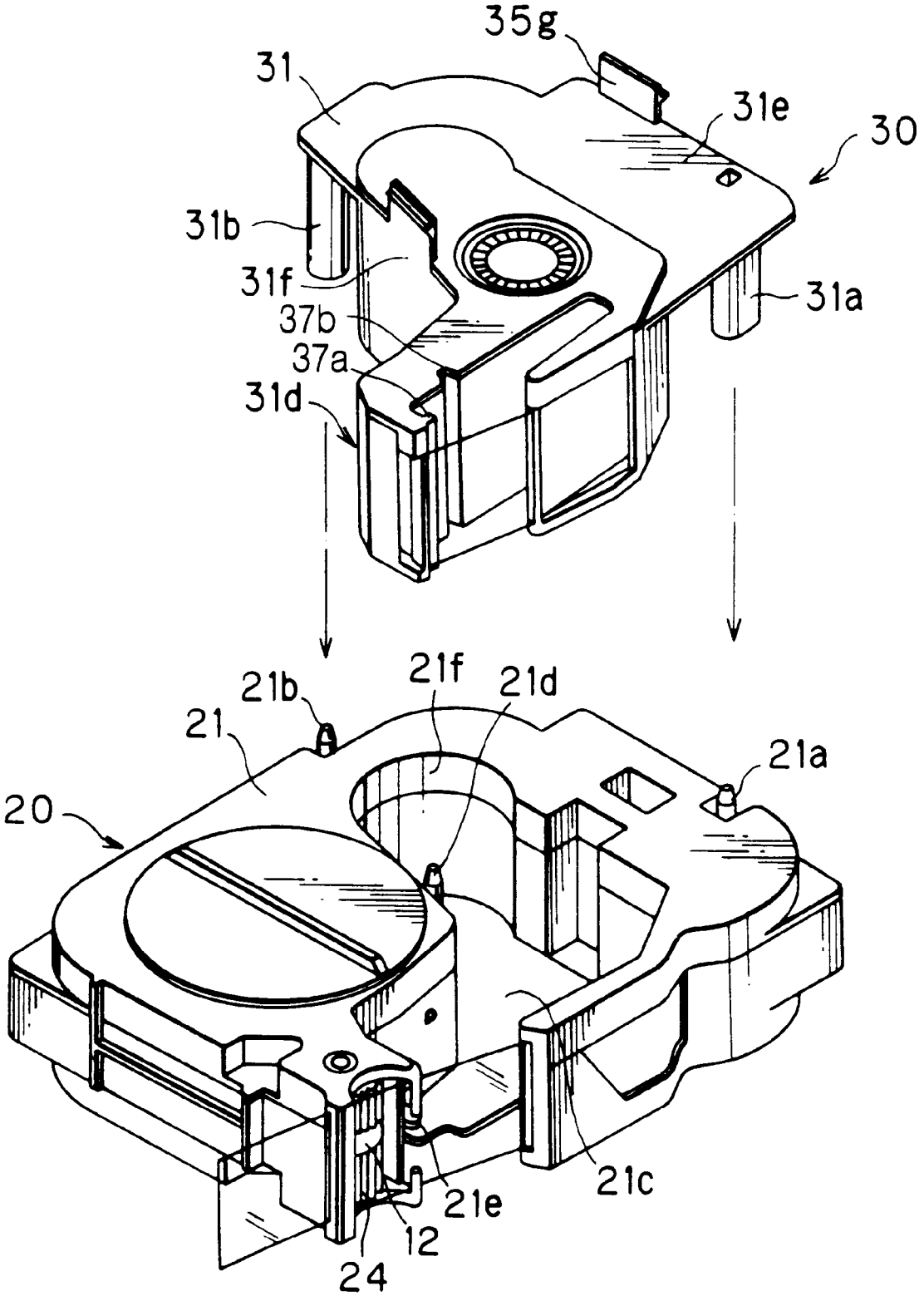
FIG. 4 is an exploded perspective view showing configuration for attaching the tape cassette and the ribbon cassette.
Figure 5:
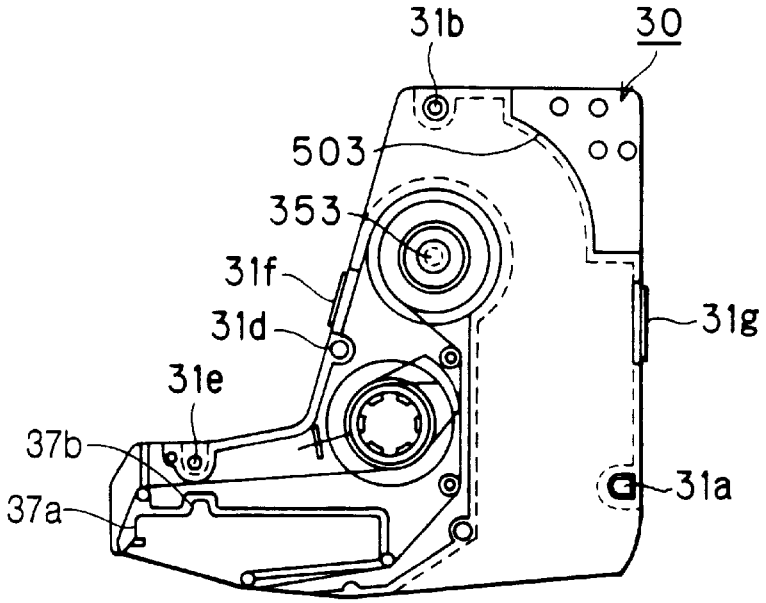
FIG. 5 is a plan view showing the ribbon cassette.

As shown in FIGS. 4 and 5, head accommodating portion 37 includes one or more slots 37*a,* 37*b* formed in perpendicular walls of the ribbon cassette. Slot 37*a* extends generally in the tape feeding direction, and slot 37*b* extends generally perpendicular to the tape feeding direction. Slots 37*a,* 37*b* receive corresponding coupling protrusions or ridges 12*a,* 12*b* (see FIG. 3) on thermal head 12 when the ribbon/tape cassette assembly is attached to the printing device.

A platen roller 65 is disposed in a confrontation with the thermal head 12 so as to sandwich a tape between itself and the thermal head 12. A tape feed subroller 66 is disposed in confrontation with the tape feed roller 24 of the tape cassette 20 so as to sandwich a tape between itself and the tape feed roller 24. A roller holder 67 pivotable with respect to the main frame 11 supports both the platen roller 65 and the tape feed subroller 66. The roller holder 67 supports the platen roller 65 and the tape feed subroller 66 so as to be pivotable between an abutment portion shown in FIG. 2 and a release portion shown in FIG. 3. In the abutment position, the thermal head 12 and the tape feed subroller 24 press therebetween the print tape and the ink ribbon. In the release position, the thermal head 12 is separated from the tape feed roller 24.

The print tape 20 housed in the tape cassette 20 and the ink ribbon 32 housed in the ribbon cassette 30 are transported by the platen roller 65 and the like passed a operation the thermal head 12, which prints characters on the print tape 20 using the ink ribbon 32. Afterward, the ink ribbon 32 is taken up by the ribbon spool 34 and the print tape 22 is discharged from the tape cassette 20.

The tape-shaped label producing device 1 is also provided with: a cutter 84 for cutting the print tape 22 after it is discharged from the tape cassette 20; a cutting knob 85 for driving the cutter 84; and a tape detection sensor 90 for detecting the tip of the print tape.

Next, an explanation will be provided for a mechanism for pivoting the roller holder 67, which supports the platen roller 65 and the tape feed subroller 66.

A solenoid 80 is provided for pivoting the roller holder 67. An operation plate 74 fixed to an operation lever 80*a* of the solenoid 80 is supported on the main frame 11 of the tape-shaped label producing device 1 so as to be pivotable in a vertical direction as viewed in FIGS. 2 and 3. A shaft 73 is disposed in an upright posture at a tip of the operation plate 74 opposite from the side of the solenoid 80.

A shaft 68 is provided for pivotably supporting the roller holder 67. A spring member, not shown in the drawings, is provided for urging the roller holder 67 to pivot in the released position, that is, downward as viewed in FIGS. 2 and 3. The roller holder 67 has a cam shaft 76*a* for abutting a release rod 71 which is positioned below the roller holder 67 in the FIGS. 2 and 3. A roller 72 is rotatably disposed in the release rod 71. The roller 72 is rotatable rightward and leftward, as viewed in FIGS. 2 and 3, while in abutment with an upright wall 11*a* of the main frame 11. The shaft 76*a* is provided with a upright posture on the release rod 71. A swing lever 76 is pivotable about the shaft 76*a*. A shaft 73 provided to the operation plate 74 engaged in a groove formed in the pivot lever 76. The pivot lever 76 pivots by operation, in the vertical direction as viewed in FIGS. 2 and 3, of the operation plate 74.

With this configuration, when the operation lever 80*a* of the solenoid 80 protrudes outward as shown in FIG. 2, then the operation plate 74 moves downward as viewed in FIG. 2, in association with movement of the operational lever 80*a*. The release rod 71 moves leftward, as viewed in FIG. 2, between the roller holder 67 and the upright wall 11*a* so that the roller holder 67 is moved into its abutment position. On the other hand, when the operation lever 80*a* of the solenoid 80 moves into its retracted condition shown in FIG. 3, then the operation plate 74 moves in association with this upward as viewed in FIG. 3. The release rod 71 moves rightward as viewed in FIG. 3, thereby releasing urging force of the sprint member against the roller holder 67. As a result, the roller holder 67 is moved into its release position by the spring member.

In this way, the platen roller 65 and the tape feed subroller 66, which are supported by the same roller holder 67, are pivoted by the solenoid 80 between the abutment position shown in FIG. 2 and the release position shown in FIG. 3.

Next, an explanation will be provided for a configuration for attaching the ribbon cassette 30 to the tape cassette 20.

FIG. 4 is an exploded perspective view showing the tape cassette 20 and the ribbon cassette 30 in a separated condition. As shown in FIG. 3 and FIG. 4, a ribbon cassette housing portion 21*f* for housing the ribbon cassette 30 is formed in the tape cassette 20. Two guide shafts 21*a,* 21*b* extending vertically, that is, in a thickness direction of the tape cassette 20, are provided at the outer peripheral edge of the tape cassette 20. Positioning shafts 21*d,* 2*e* are provided extending vertically at a base surface 21*c* of the tape cassette 20. As shown in FIG. 4, the guide shafts 21*a,* 21*b* protrude above the upper surface of the tape cassette 20. In contrast to this, the positioning shafts 21*d,* 21*e* are shorter than the guide shafts 21*a,* 21*b* and do not extend to the upper surface of the tape cassette 1.

FIG. 5 is a plan view showing internal configuration of the ribbon cassette 30.

As shown FIGS. 4 and 5, guide rails 31*a,* 31*b* for engaging with the guide shafts 21*a,* 21*b* respectively of the tape cassette 20 are provided at the peripheral of the ribbon cassette 30 at positions corresponding to the guide shafts 21*a,* 21*b*. Also, positioning rails 31*d,* 31*e* for engaging with the positioning shafts 21*d,* 21*e,* respectively are provided at the periphery of the ribbon cassette 30 at positions corresponding to the positioning shafts 21*d,* 21*e*. Grip ribs 31*f,* 31*g* are formed on the upper surface of a lid member 31*e* of the ribbon case 31.

Figure 6A:
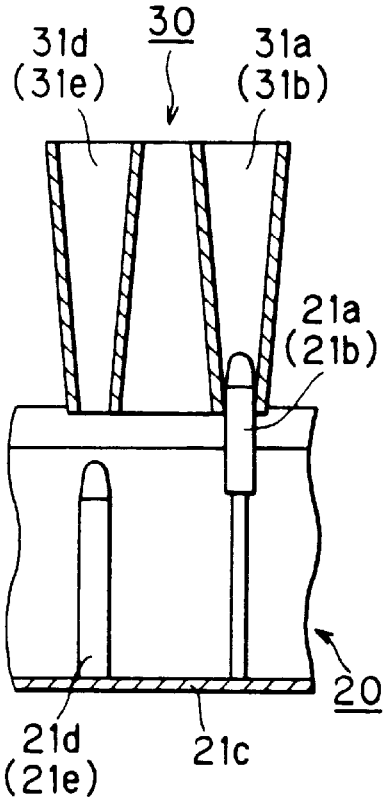
FIG. 6 (A) is a schematic cross-sectional side view showing positional relationship between a guide shaft and a positioning shaft of the tape cassette and a guide rail and a positioning rail of the ribbon cassette when mounting of the ribbon cassette is first started to be mounted to the tape cassette.
Figure 6B:
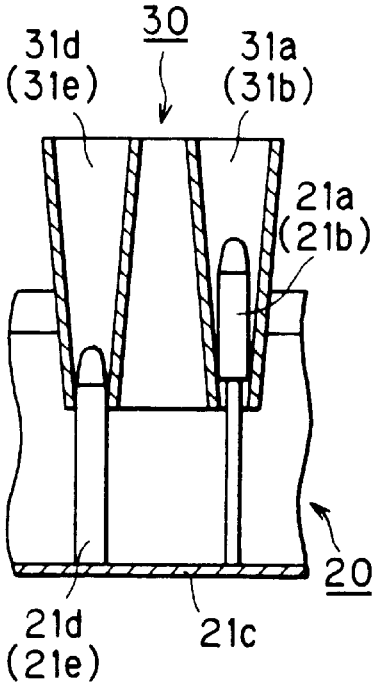
Figure 6C:
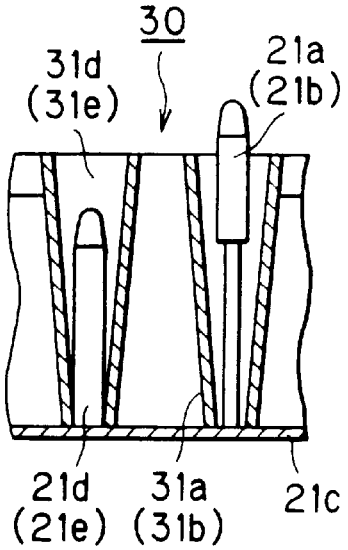

When the ribbon cassette 30 is mounted in the tape cassette 20, first the guide shafts 21*a,* 21*b* and the guide rails 31*a,* 31*b* engage. FIG. 6 (A) through FIG. 6 (C) show positional relationship between the guides shafts 21*a,* 21*b,* the positioning shafts 21*d,* 21*e,* the guides rails 31*a,* 31*b,* and the positioning rails 31*d,* 31*e* in the mounting direction of the ribbon cassette. It should be noted that FIG. 6 (A) shows a condition when the ribbon cassette 30 is started mounted in the tape cassette 20; FIG. 6 (B) shows an intermediary phase of the mounting process; FIG. 6 (C) shows the condition after the ribbon cassette 30 is completely mounted in the tape cassette 20. As shown in FIGS. 6 (A) through 6 (C), the guide rails 31*a,* 31*b* and the positioning rails 31*d,* 31*e* are formed with groove portions into which the guide shafts 21*a,* 21*b* and the positioning shafts 21*d,* 21*e,* respectively, are fitted. The groove portions are formed so that the their widths taper narrower in the downward direction, that is, in the direction in which the ribbon cassette 30 is mounted into the tape cassette 20.

As shown in FIG. 6 (A), when the ribbon cassette 30 is first started to be mounted in the tape cassette 20, the guide shafts 21*a,* 21*b* and the guide rails 31*a,* 31*b* engage, thereby guiding and positioning the ribbon cassette 30 during mounting. A predetermined lower portion of the guide shafts 21*a,* 21*b* are formed with a relatively small diameter. Therefore, as shown in FIG. 6 (B), after the smallest width portion of the guide rails 31*a,* 31*b,* that is, the lower tips of the rails 31*a,* 31*b,* reach the start of the small diameter portion of the guide shafts 21*a,* 21*b* during mounting of the ribbon cassette 30*a,* then the guide shafts 21*a,* 21*b* are released from the guide rails 31*a,* 31*b* in association with engagement between the positioning shafts 21*d,* 21*e* and the positioning rails 31*d,* 31*e.*

As shown in FIG. 6 (C), when mounting of the ribbon cassette 30 is completed, the narrowest width portion of the positioning rails 31*d,* 31*e* and the lower tips of the positioning shafts 21*d,* 21*e* are engaged, thereby guiding and positioning the ribbon cassette 30 when mounted to the tape cassette 20. The narrowest portion of the positioning rails 31*d,* 31*e* is held tightly against the positioning shafts 21*d,* 21*e,* that is, separated by only a slight clearance. Therefore, the ribbon cassette 30 accurately positioned in the tape cassette 20 by the positioning rails 31*d,* 31*e* and the positioning shafts 21*d,* 21*e.*

Figure 7:
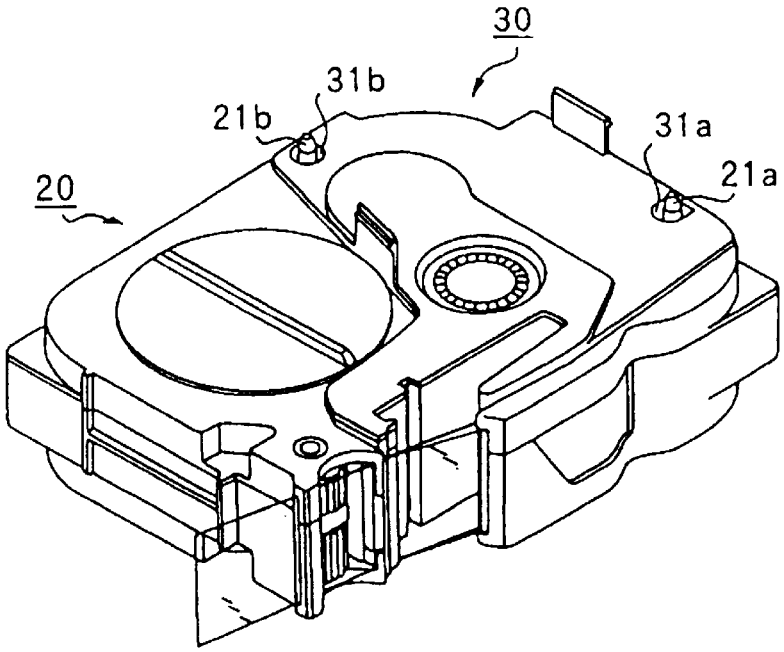
FIG. 7 is a perspective view showing a tape/ribbon separated type cassette.

In this way, the start of the mounting process of the ribbon cassette 30, the ribbon cassette 30 is guided and positioned in the tape cassette 20 by engagement between the guide shafts 21*a,* 21*b* and the guide rails 31*a,* 31*b.* After mounting is completed, the ribbon cassette is positioned in the tape cassette 20 by engagement between the positioning shafts 21*d,* 21*e* and the position rails 31*d,* 31*e.* Thus, as shown in FIG. 7, the ribbon cassette 30 and tape cassette 20 become an integral unit.

It should be noted that when the ribbon cassette 30 is mounted in the tape cassette 20 while the tape cassette 20 is already mounted in the tape-shaped label producing device 1, then as shown in FIG. 3, mounting is performed after the roller holder 67 is brought into its released condition and space is opened between platen roller 65 in the thermal head 12 and between the tape feed roller 24 and the tape feed subroller 66.

In this way, a guide portion formed by the guide shafts 21*a,* 21*b* and a positioning portion formed by the positioning shafts 21*d,* 21*e* are provided to the tape cassette 20. Also, a guided portion formed by the guide rail 31*a,* 31*b* and a positioned portion formed by the positioning rails 31*d,* 31*e* are provided to the ribbon cassette 30. The guided portion is guided by the guide portion when the ribbon cassette 30 is first started to be mounted in the tape cassette 20. Further, when mounting of the ribbon cassette 30 is completed, the positioned portion is positioned by the positioning portion. As a result of this configuration, each of the different members, that is, the shafts and the rails, can be formed shorter, and so are easier to form. Further, mounting is easier especially when the tape housed in the tape cassette 30 is very wide tape.

Next, an explanation will be provided for a mechanism used to transport the print tape and the ink ribbon.

Figure 8:
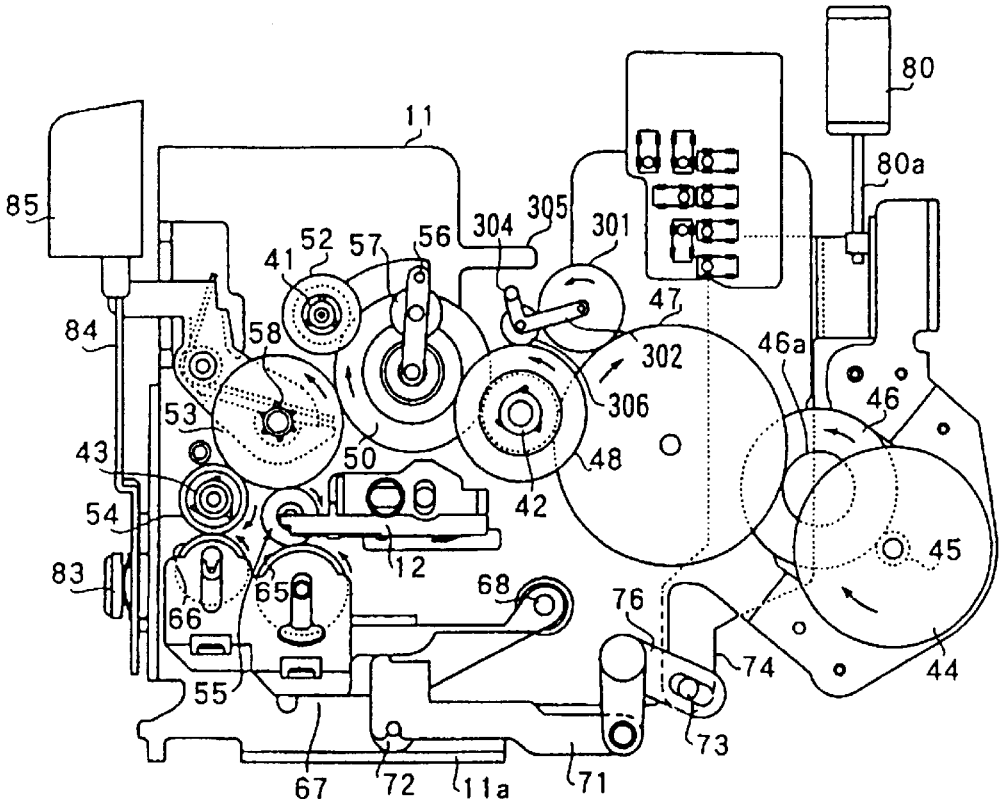
FIG. 8 is a plan view showing a tape feed drive mechanism of the tape-shaped label producing device.
Figure 9:
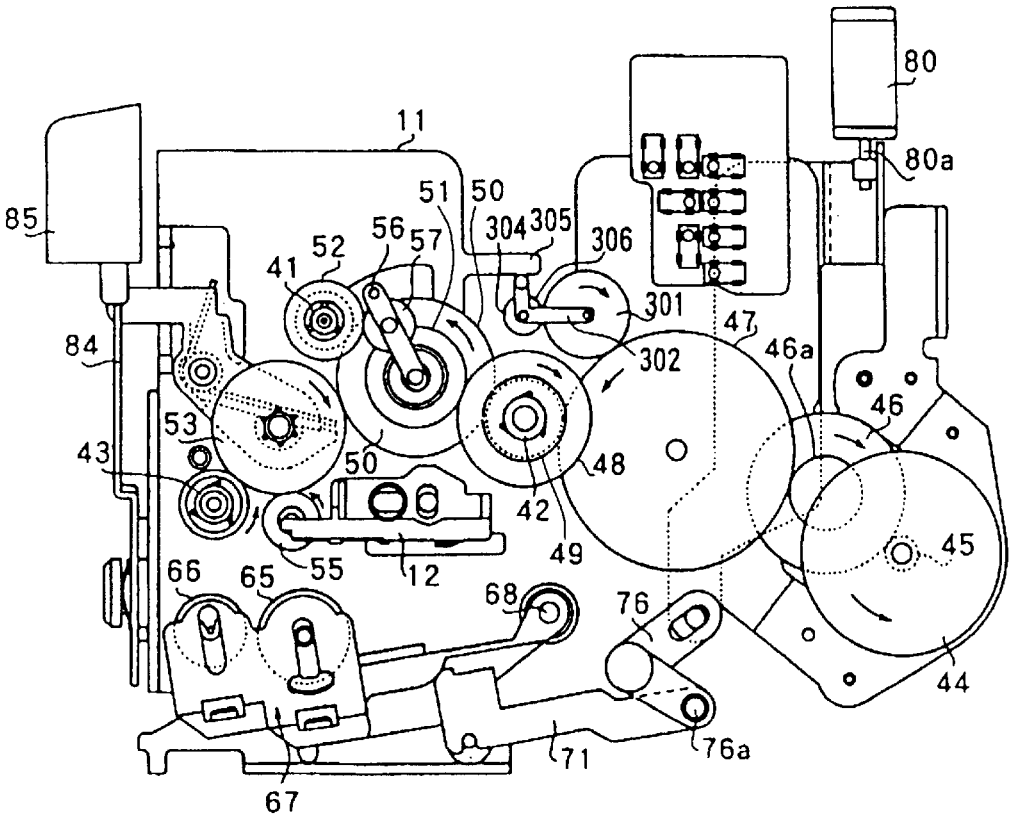
FIG. 9 is a plan view showing the drive mechanism shown in FIG. 10.

FIGS. 8 and 9 are plan views showing the mechanism for transporting the tape and the ink ribbon. As shown in FIG. 8, a tape drive motor 44, which is a step motor, is attached to the right corner portion of the main frame 11. A drive gear 45 is fixed to the drive shaft of the tape drive motor 44. A first gear 46 rotatably disposed on the main frame 11 is engaged with the drive gear 45. A gear 46*a* is integrally formed on the same rotational shaft as the gear 46. A gear 47 provided to the main frame 11 is engaged with the gear 46*a.*

Figure 10:
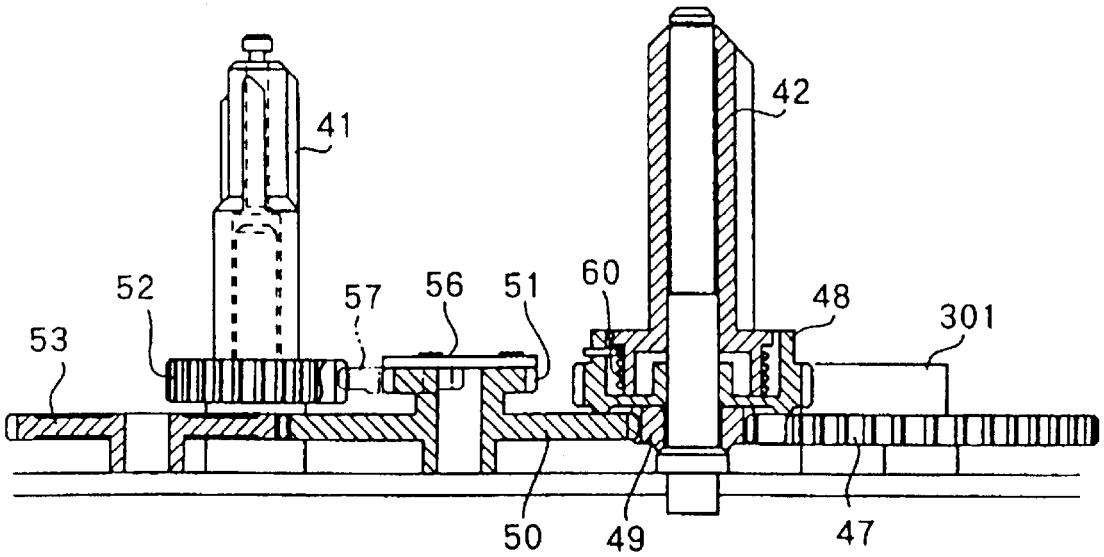
FIG. 10 is a side view in partial cross section showing a gear train in the vicinity of a ribbon take-up cam.

FIG. 10 shows a gear train in the vicinity of the ribbon take-up cam 42. As shown in FIG. 10, a gear 49 rotatably provided to the rotation shaft 42*a* of the ribbon take-up cam 42 is engaged with the gear 47. The gear 49 is engaged with a gear 50, which is rotatably supported on the main frame 11.

A gear 51 is integrally formed on the same rotational shaft as the gear 50. A pivot lever 56, which is pivotable with respect to the rotation shaft of the gears 50, 51, is provided at an upper portion of the gear 51. An appropriate amount of frictional resistance is imparted between the lower surface of the pivot lever 56 and the upper surface of the gear 51. A planetary gear 57 constantly engaged with the gear 51 is rotatably provided on the pivot lever 56.

The planetary gear 57 is pivotable between a position shown in FIG. 10 where it is engaged with a tape take-up gear 52 fixed to the lower tip of the tape take-up cam 41 and a position shown in FIG. 8 where it is separated from the tape take-up gear 52. When the tape drive motor 44 rotates in a clockwise direction viewed in FIG. 8, by positive rotational drive so that the gear 50 rotates in the clockwise direction, then the pivot lever 56 also rotates in the clockwise direction as a result of the friction resistance between it and the gear 51. In association with this, the planetary gear 57 separates from the tape take-up gear 52 so that the tape take-up cam 41 becomes free.

The gear 50 is engaged with the gear 53 and the gear 53 is engaged with the tape guide gear 54. That is, rotation of the tape drive motor 44 is transmitted to the tape take-up cam 41 fixed to the tape guide gear 54 via the gears 54 to 54. On the other hand, the gear 53 is also engaged with a gear 55 and to a platen gear 65*a,* which, as will be described nest, is for driving the platen roller 65.

Figure 11:
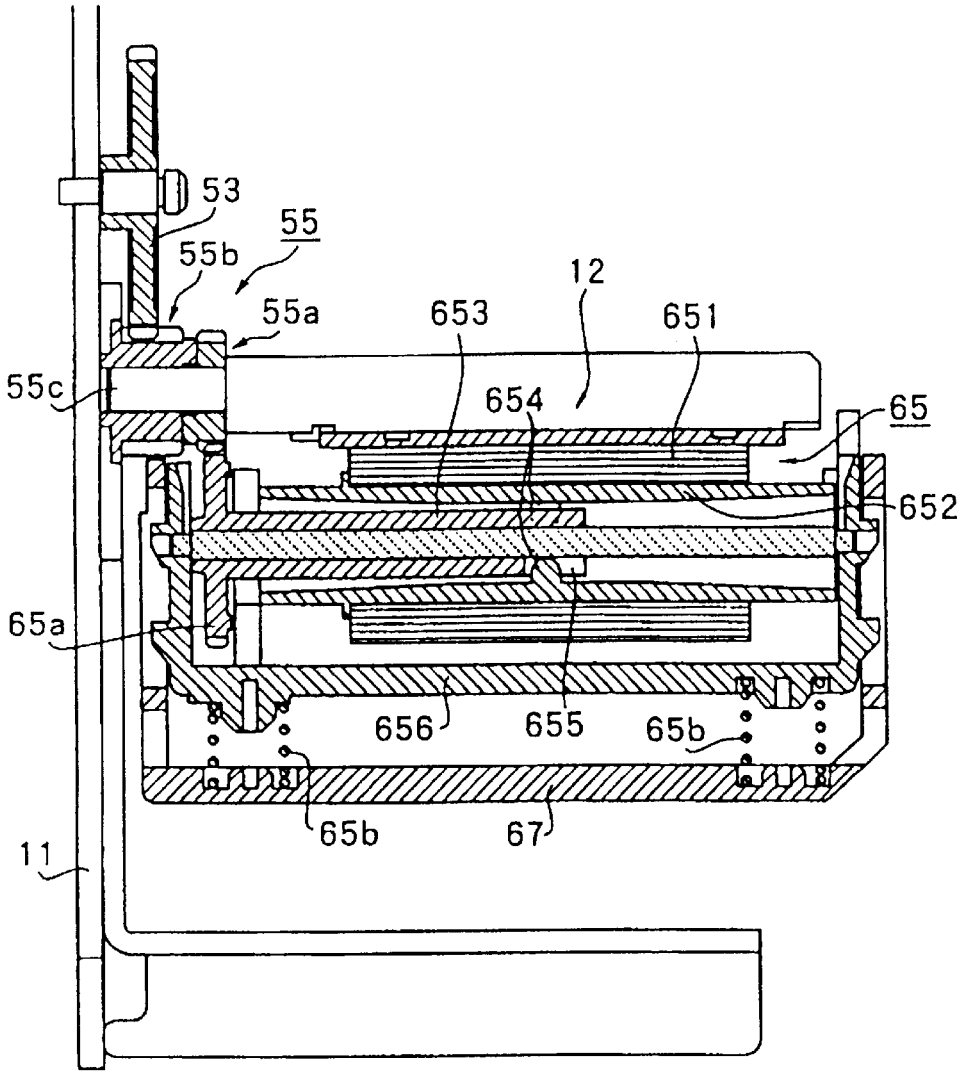
FIG. 11 (A) is a cross-sectional view showing a platen roller and its drive portion.
Figure 11:
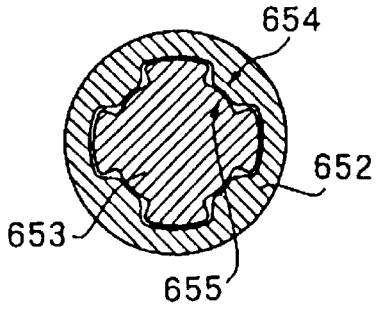

FIG. 11 (A) is a cross-sectional view showing a driving portion of the platen roller 65. As shown in FIG. 11 (A), the platen roller 65 is formed from a roller body 651 and a hollow roller shaft 652 penetrating through the internal portion of the roller body 651. A drive shaft 563 for driving rotation of the platen roller 65 is inserted into the hollow portion of the roller shaft 652.

FIG. 11 (B) is a cross-sectional view taken through the center, in the axial direction, of the roller shaft 652. As shown in FIG. 11 (B), inward protruding engagement protrusions 654 are formed at the substantial center in the axial direction of the roller shaft and 652. Engagement grooves 655 are provided in the drive shaft 653. The engagement protrusions 654 are engaged in the engagement grooves 655. This engagement is performed only at the center in an axial direction of the platen roller 65. That is to say, the drive shaft 653 engages with the roller shaft 652 at only one position in the axial direction.

As shown in FIG. 11 (A), a movable case 656 is supported so as to be movable in the vertical direction, as viewed in FIG. 11 (A), with respect to the roller holder 67. The drive shaft 653 is rotatably supported by the movable cased 656. Also, springs 65*b* provided to the roller holder 67 urge the axial tips of the movable case 656 upward, as viewed in FIG. 11 (A). For this reason, the platen roller 65 is urged by a uniform urging force in the axial direction of the platen roller 65 with respect to the head 12. Because of this configuration, when the gear 53 is rotated, then the platen gear 65 is rotated via the gear 55 and the gear 65*a.* Further, the platen roller 65 is pressed by a uniform pressing force in the axial direction of the platen roller 65 with respect to the head 12.

Figure 12:
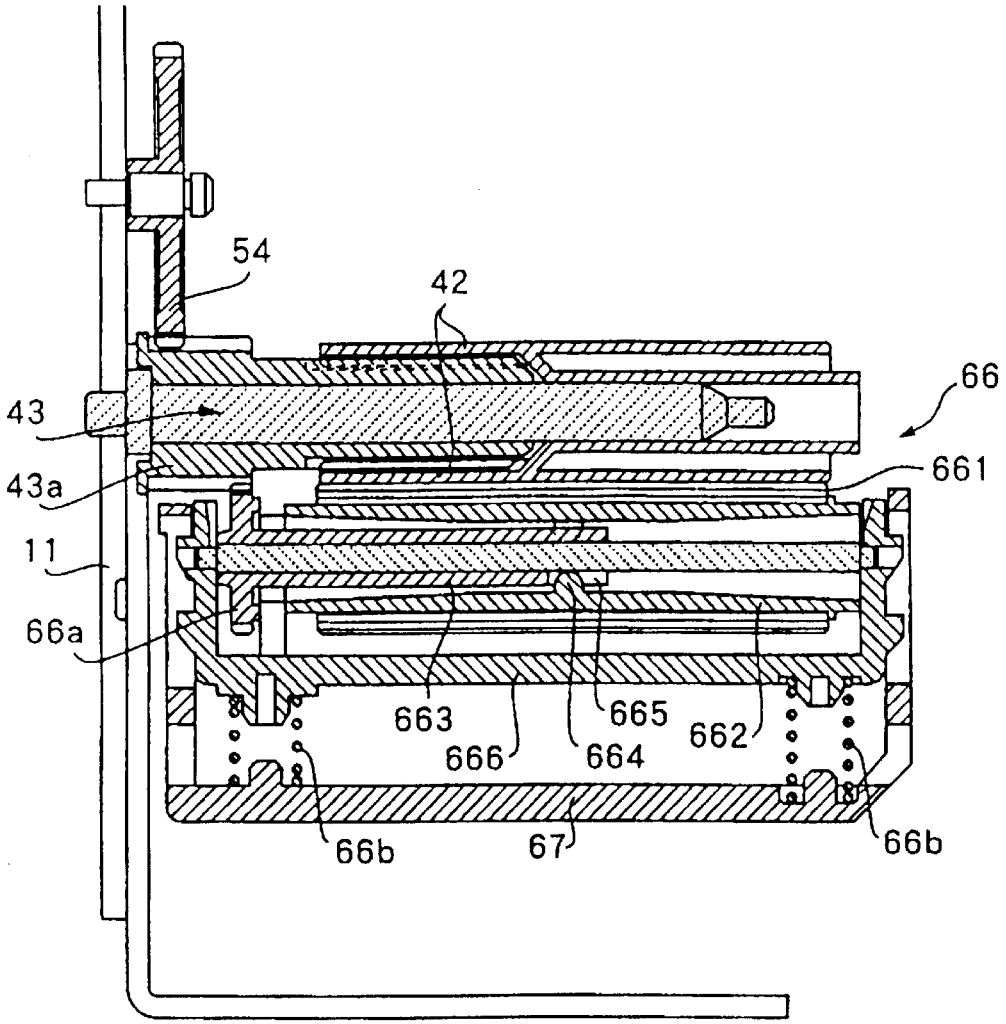
FIG. 12 (A) is a cross-sectional view showing a platen subroller and its drive portion.
Figure 12:
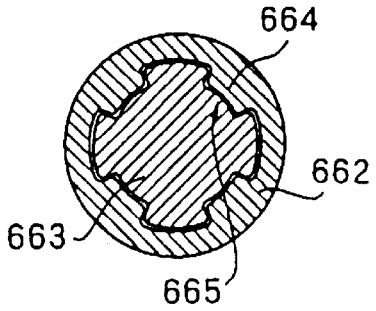

FIG. 12 (A) is a cross-sectional view showing the drive portion of the tape feed subroller 66. As shown in FIG. 12 (A), the tape feed subroller 66 is formed from a roller body 661 and a hollow roller shaft 662 penetrating through the internal portion of the roller body 661. A drive shaft 663 for driving the tape feed subroller 66 is inserted into the hollow portion of the roller shaft 662.

FIG. 12 (B) is a cross-sectional view showing a central portion in the axial direction of the roller shaft 662. As shown in FIG. 12 (B), engagement protrusions 664 protruding towards the interior from the substantial center, in the axial direction, of the roller shaft 662 and engagement grooves 665 provided to the drive shaft 663 engage with each other. This engagement is performed at the center portion in the axial direction of the tape feed subroller 66. That is, the drive shaft 663 engages with the roller shaft 662 at only a single position in the axial direction.

A movable case 666 is supported movable with respect to the roller holder 67 in the vertical direction as viewed in FIG. 13*b*. The movable case 666 rotatably supports the drive shaft 663. Springs 66*b* are provided in the roller holder 67. The springs 66*b* urge both tip portions in the axial direction of the moveable case 666 upward as viewed in FIG. 12 (B). For this reason, the tape feed subroller 66 is urged with respect to the tape drive roller 42 at an urging force uniform in the axial direction.

With the above-described configuration, when the gear 53 rotates, then the tape feed subroller 66 is rotated via the gear 54 and the gear 66*a*. Also, in the same manner as the platen roller 65, the tape feed subroller 66 is pressed at a uniform pressing force in the axial direction of the tape feed subroller 66 with respect to the tape feed roller 24.

The friction coefficient at the surfaces of the platen roller 65 and the tape feed subroller 66, the pressing force generated between the platen roller and the thermal head 12 by the spring 65*b*, and as well as the pressing force generated by the spring 65*b* between the tape feed subroller 66 and the tape feed roller 24 are set so that feed force of the print tape 22 by the platen roller 65 is larger than the feed force by the tape feed subroller 66.

Peripheral speed of the tape feed subroller 66 is set slightly faster than peripheral speed of the platen roller 65 so that a slip is generated between the tape feed subroller 66 and print tape 22. In this way, during printing, the platen roller 65 transports the print tape and the tape feed subroller 66 applies an appropriate tension to the print tape so that the print tape is transported stably.

Next, an explanation will be provided for operations to rewind the print tape.

As shown in FIG. 10, a gear 48 is provided to the lower tip of the ribbon take-up cam 42. The ribbon take-up cam 42 and the gear 48 are linked together by a clutch spring 60 to be described later. On the other hand, as shown in FIG. 8, a gear 301 provided rotatably to the main frame 11 is engaged with gear 47, which is provided rotatable with respect with the rotation shaft of the ribbon take-up cam 42. A lever 302 pivotable around the shaft of the gear 301 is provided to the gear 301. A planetary gear 306 engaging with the gear 301 is provided on a rotational shaft of the lever 302.

With this configuration, when the tape feed roller 44 rotates in the clockwise direction, as viewed in FIG. 8, and the gear 301 rotates in the counterclockwise direction, then friction between the upper surface of the gear 301 and the pivot lever 302 causes the pivot lever 302 to move in the same direction so that the planetary gear 306 engages with the gear 48. The gear 48 rotates in the counterclockwise direction by engagement with the planetary gear 306 and, simultaneously with this, the ribbon take-up cam 42 rotates in the same direction so that the ink ribbon 32 is wound up on the ribbon take-up spool.

When the print tape 22 is to be rewound, the solenoid 80 is operated so that the roller holder 67 is pivoted into its released position. Also, the tape drive motor 44 is rotated in the counterclockwise direction so that the gear 47 rotates in the counterclockwise direction. In association with this, the gear 301 rotates in the clockwise direction and the pivot lever 302 moves in the same direction so that the gear 306 and the gear 48 are separated from each other and the ribbon take-up cam 42 stops rotating. It should be noted that a stopper 304 is formed on n the pivot lever 302. The stopper 304 stops movement of the pivot lever 302 by abutting against an abutment rib 305 provided to the main frame 11.

When the gear 47 rotates in the counterclockwise direction, then the gear 50 rotates in the counterclockwise direction via the gear 49 and the pivot lever 56 moves in the same direction so that the gear 57 and the tape take-up gear 52 engage each other. As a result, the tape take-up cam 41 formed integrally with the gear 52 rotates in the counterclockwise direction, which is the rotational direction for rewinding the print tape 22. At this time, the tape drive gear 54 and the gear 55 rotate in the direction opposite the direction they rotate during printing. However, because the roller holder 67 is in its separated position, neither the print tape 22 or the ink ribbon 32 will be transported.

It should be noted that a clutch spring 60 which links the ribbon take-up cam 42 and the gear 48 is a coil spring wrapped around the periphery of the ribbon take-up cam 42. When the gear 48 is rotated in the counterclockwise direction, then friction between the clutch spring 60 and the rotational shaft 42*a* causes the ribbon take-up cam to rotate with the gear 48. However, when the ribbon take-up cam 42 rotates slower than the gear 48 as a result of the external forces, then the winding of the clutch spring 60 will loosen. As a result, slip will be generated between the ribbon take-up cam 42 and the clutch spring 60. In this case, the ribbon take-up cam 42 will be rotated by the external force and not by the gear 48. With this configuration, take-up speed of the ink ribbon is determined by transport speed by the platen roller 65.

Next, an explanation will be provided for a mechanism for applying tension to the print tape.

When, as a result of backlash and the like of the gears, the platen gear 65*a* starts to rotate before the tape feed subroller 66*a*, then looseness of the print tape 22 will be generated between the tape feed subroller 66 and the platen roller 65. Accordingly, when a tip detection sensor 90 to be described later detects the tip of the print tape while the print tape is loose, then the linear distance between the tape tip position and the print start initial position will change. That is, when the tip of the print tape 22 is again detected after the tape is rewound, then a shift will be generated in the print position.

Figure 13:
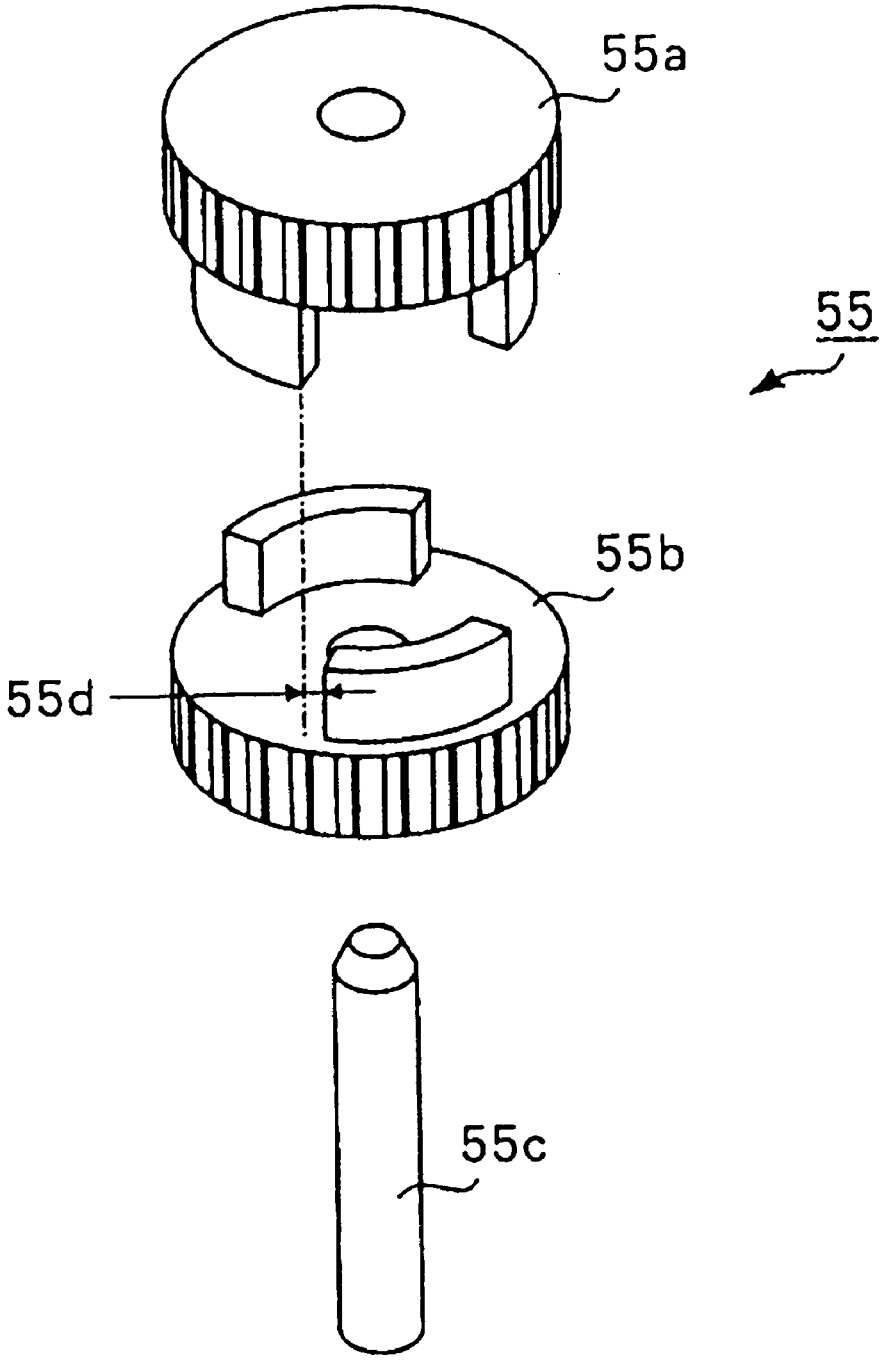
FIG. 13 is a perspective view showing a gear associated with the print head.

As shown in FIGS. 11 and 13, a gear 55 for transmitting rotational force to the platen roller 65 is provided rotatable about a shaft 55*c*. the gear 55 is formed from upper and lower two speed gears 55*a*, 55*b*, which are separated by a space 55*d* in the rotational direction. Because the gear 55*a* rotates slightly later than the gear 55*b*, the platen gear 65*a* rotates later than the tape feed subroller 66*a*. For this reason, even if there is gear backlash, the tape feed subroller 66 will reliably start to rotate before the platen roller 65.

It should be noted that at any particular time, the degree of space generated between the gear 55*a* and gear 55*b* is unknown. Therefore, by reversibly rotating the tape drive motor 44 before transporting the print tape in the forward direction, a space can be reliably opened between the gear 55*a* and the gear 55*b* when the print tape is next driving in the forward direction. By doing this, the next time the print tape is transported in the forward direction, the gear 55*a* can be started to rotate reliably after the gear 55*b*. Therefore, the platen roller 55 can be reliably started to rotate later than the tape feed subroller 66. In this way, looseness of the print tape can be prevented.

Next, an explanation will be provided for the tape feed roller 24. In the present embodiment, transport of the print tape 22 is performed by the platen roller 65. The tape feed roller 24 is used to apply tension to the print tape 22 while the print tape 22 is transported. For this reason the tape feed roller 24 must apply an appropriate friction force, that is, grip force, on the print tape 22.

Figure 14:
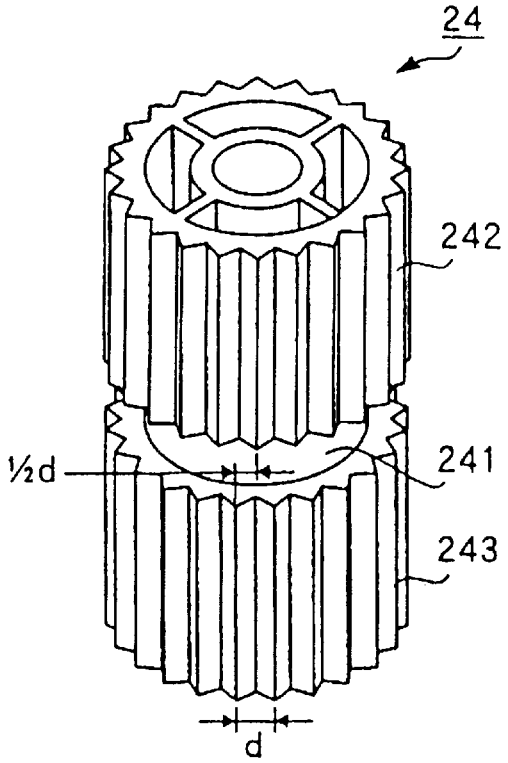
FIG. 14 is a perspective view showing a tape-feed roller.

FIG. 14 is a perspective view showing the tape supply roller 24. As shown in FIG. 14, the tape feed roller 24 has a substantially cylindrical outer shape. A groove portion 241 extending is formed in the vertical center portion of the tape feed roller 24 around its periphery. As shown in FIG. 4, a slide portion 12, which is a plate-shape member for pressing in the grooved portion 241, is formed to the tape cassette 20. The slide portion 12 rotatably supports the tape feed roller 24. By fitting the grooved portion 241 into the slide portion 12, the tape feed roller 24 can be rotatably supported on the tape cassette 20.

As shown in FIG. 14, rollettes 242, 243 are provided at opposite each other in the axial direction so as to sandwich therebetween the groove portion 241 of the tape feed roller 24. The rollettes 242, 243 are formed at a predetermined pitch in the peripheral direction with indentations and protrusions which extend in the axial direction and o the tape feed roller 24. Further, assuming that adjacent protrusions in the rollettes 242, 243 adjacent protrusions are separated from each other by a pitch d, the protrusions of the rollette 242 are formed shifted in the peripheral direction by a shift of one half d from the protrusions o the rollette 243.

Although with this configuration, the tape feed roller 24 only intermittently contacts the print tape, by shifting the phases between the rollette 242, 243 by a one half pitch-wise distance as described above, then the print tape is contacted at half pitch intervals.

That is, by forming the tape feed roller 24 from plurality of rollettes and shifting the phase between the rollette, then the griping force applied to the print tape can be increased. Also, the tape feed roller 24 can contact the print tape 22 at a fine pitch. In another words, the print tape can be stably transported because the tape feed roller 24 contacts the print tape 22 with an appropriate grip force, that is, frictional force.

It should be noted that in the tape-shaped label producing device according to the present invention, the platen roller 65 transports the print tape 22 and the tape feed roller 24 applies tension to the print tape 22. However, the tape feed roller 24 of the present embodiment can be used in a tape-shaped label producing device wherein the print tape 22 is transported by the tape feed roller 24. In this case also, grip force can be increased and contact with the print tape 22 can be at a fine pitch so that the print tape can be stably transported.

Figure 15:
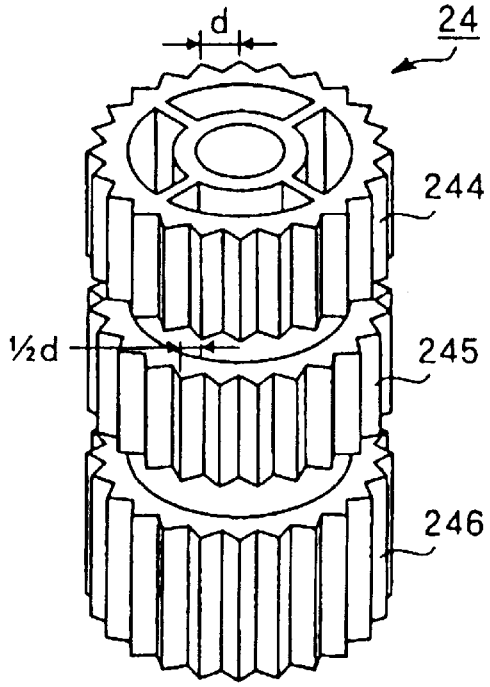
FIG. 15 is a perspective view showing a modification of the tape-feed roller of FIG. 14.

It should be noted that, as shown in FIG. 15, the tape feed roller 24 can be formed from three rollette portions 244, 245, 256 in the axial direction. The phase of the upper and lower rollette 244, 246 can be shifted one half pitch from the middle rollette 245. With this configuration, the rollettes of the tape feed roller 24 apply a symmetrical force on the print tape 22 with respect to the width direction of the print tape 22. Therefore, the print tape 22 will not slant in the axial direction with respect to the tape feed roller 24, that is, with respect to the widthwise direction of the print tape 22.

Next, an explanation will be provided for distinguishing between different ribbon cassettes. As will be described later, the tape-shaped label producing device of the present invention can be selectively used for multi-color printing, wherein printing is performed by exchanging different color ribbon cassettes, and for full-color printing, wherein colors are reproduced by overlapping three primary colors without exchanging ribbon cassettes. Monochrome ink ribbons are used during multi-color printing and a striped ribbon coated alternately with a plurality of colors, that is, the three primary colors of yellow, magenta, cyan, is used during full-color printing.

A plurality of different type ribbon cassettes 30 are prepared for housing ink ribbons with different colors and different widths. In the present embodiment, ink ribbons 32 are available in widths of 12, 18, 24, 32 mm. Detection hole groups 36 for detecting type of the plurality of different type ribbon cassettes 30 are formed at the lower tip portion of a vertical wall portion 31*d* of the ribbon case 31. The detection hole group 36 is formed from a combination of 8 detection holes 36*a*.

The detection hole group 36 is formed in the tape cassette 20. The detection hole group 36 is formed from 8 detection holes 36*a* for distinguishing the type of ink ribbon in the tape cassette 20. Ribbon detection switches 103 formed from first through eighth detection switches for detecting presence or absence of the eight detection holes 36*a* are provided at a rear portion of the main frame 11. Ribbon detection signals RS are outputted according to the combination of switch signals from the eight detection switches. FIG. 16 schematically shows a ribbon cassette distinction table stored in a memory of the tape-shaped label producing device 1. Switches 36*a* to 36*h* shown in FIG. 3 correspond to switch Nos. 1 through 8 in the distinction table of FIG. 16. Therefore, result in the determination that the ribbon cassette presently mounted is a three primary color striped ribbon cassette and houses a receptor type tape with a width of 32 mm. It should be noted that "all colors common" means that the same control is performed regardless of the color of the ink ribbon or the tape.

Next, an explanation will be provided for a configuration for detecting the tip of the print tape.

As shown in FIG. 2, a tip detection sensor 90 for detecting the tip of the print tape 22 is provided in the tape-shaped label producing device 1 at a position downstream in the transport direction of the print tape 22 from the cutting unit 84.

The tip detection sensor 90 is a transmission type photosensor having a light generating/receiving element 92 and a light receiving element 93. The light generating/receiving element 92 and the light receiving element 93 are housed in sensor housing chambers 94, 95, respectively. Light transmission holes 94*a*, 95*a* for enabling sensor light emitted from the 92 to fall incident on the light receiving element 93 are formed in the sensor housing chamber 94, 95, respectively. A slit 98 is opened between the sensor housing chambers 94, 95 for enabling passage of the print tape 22 therethrough. The tip portion of the print tape 22 is guided by the guide portion 99 to be reliably passed through the slit 98. That is, the print tape 22 enters the slit 98 and becomes an obstruction between the light-emission/light-reception element 92 and the light receiving element 93 so that the sensor light from the 92 is blocked off. The tip detection sensor 90 outputs a low level detection signal TS as a result.

Next, an explanation will be provided for a ribbon cassette enabling detection of type of ink ribbon housed therein. As shown in FIG. 2, a ribbon sensor 70 is a transmission type photosensor configured from a light generation portion 70*a* and a light receiving portion 70*b* disposed in mutual opposition and sandwiching the passage through which the print tape 22 and ink ribbon 32 are transported.

The ribbon sensor 70 generates a greater amount of sensor light and has a greater reception sensitivity than does the tip detection sensor 90. Also, the print tape 22 is formed from a material which does not allow transmission of sensor light from the tip detection sensor 90, but which allows transmission of sensor light from the ribbon sensor 70.

Next, an explanation will be provided for sensor marks detected by the ribbon sensor. The ink ribbon 32 is formed from a material through which sensor light from the ribbon sensor 70 is transmitted. As shown in FIG. 17 (*a*), a plurality of line shaped sensor marks having the same width are formed with uniform spacing therebetween at the end portion 32*a* of the ink ribbon 32. The sensor marks are formed so as to prevent sensor light from the ribbon sensor 70 from being transmitted therethrough. The width of the sensor marks and the width of empty spaces therebetween, through which the sensor light is transmitted, have a ratio of 1 to 2.

Figure 18:
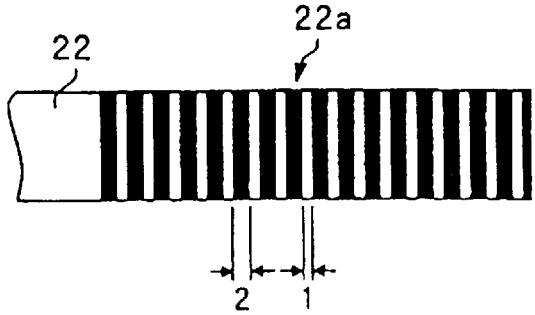
FIG. 18 is a schematic view showing an end portion of the print tape.

As described above, the print tape 22 is formed from a material through which the sensor light from the ribbon sensor 70 is transmitted. As shown in FIG. 18, a plurality of equivalent width sensor marks are formed with equal spacing therebetween at the end portion 22*a* of the print tape 22. The sensor marks are formed so as to prevent the sensor light from the ribbon sensor 70 from being transmitted therethrough. The width of the sensor marks and the width of the empty portions therebetween, through which the sensor light from the ribbon sensor 70 is transmitted, have a ratio of 2 to 1.

Accordingly, when the ribbon sensor 70 detects the sensor marks described above, whether sensor marks belong to the end portion 32*a* of the ink ribbon 32 or to the end portion 22*a* of the print tape 22 can be determined according to the ratio of widths of the sensor marks and the widths of the empty portions between the sensor marks.

Figure 19:
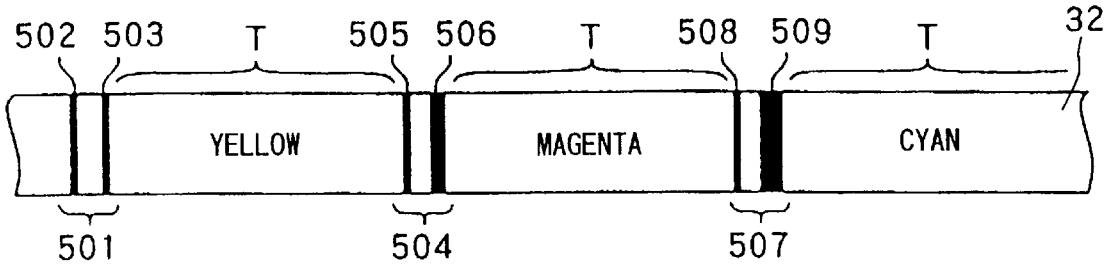
FIG. 19 is a schematic view showing sensor marks on a striped type ink ribbon.

In addition to monochrome type ink ribbons, the ink ribbon can be a striped ink ribbon having a plurality of colors disposed in alternation. The striped ribbon shown in FIG. 19 includes the three primary colors yellow, magenta, cyan formed serially on the same ribbon. All the three primary colors are transparent with respect to the sensor light from the ribbon sensor 70. Distinction portions 501, 504, 507 for distinguishing ink color are provided directly before each corresponding color region. Each distinction portion 401, 504, 507 is formed from two vertical marks formed in a manner so as to prevent sensor light from the ink ribbon sensor from being transmitted therethrough. The first vertical marks 502, 505, 508 of the distinction portions 501, 505, 507 are formed to the same width. The second vertical marks, 503, 506, 509 of the distinction portions 501, 504, 507 are formed to different widths depending on the corresponding ink color. Therefore, when the ribbon sensor 70 detects one of the distinction portions 501, 504, 507, the corresponding ink color can be determined based on the ratio of the widths of the corresponding first and second vertical marks.

It should be noted that the first vertical marks 502, 505, 508 for determining color of the ink ribbon 32, the sensor marks indicating the end portion of the ink ribbon 32, and the empty portion between the sensor marks indicating the end portion of the print tape 22 are formed with the same width.

Next, an explanation will be provided for the method used to distinguish between the different types of sensor marks using the ribbon sensor 70.

Because the print tape 22 and ink ribbon 32 pass between the light emission portion 70*a* and the light reception portion 70*b* of the ribbon sensor 70 while overlapping each other, the ribbon sensor 70 detects the sensor marks of the print tape 22 and the ink ribbon 32 while overlapping each other.

When the ink ribbon 32 is a striped type, then when the ribbon sensor 70 detects only two sensor marks, it can be understood that the sensor marks are for distinguishing ink color. Therefore, the ink color is determined based on the ratio of width between the two detected sensor marks. That is, when the first and second sensor marks are substantially the same width, then the ink color is determined to be yellow. When the second sensor mark is about one and a half the times width of the first sensor mark, then the ink color is determined to be magenta. When the second mark is about two times the width of the first mark, then the ink color can be determined to be cyan. At this time, it is determined that the print tape 22 is positioned at a print region because sensor light from the ribbon sensor 70 can be transmitted therethrough. It should be noted that monochrome type ribbons are not formed with sensor marks for distinguishing ink color. Therefore, only two sensor marks will never be detected. On the other hand, when three of more sensor marks are detected by the ribbon sensor 70, the ratio of the width of the sensor mark through which sensor light is not transmitted and the width of the empty portion through which sensor light is transmitted is stored based on five or more sensor marks. The reason for using five or more sensor marks will be explained later. Below, an explanation will be provided for five different situations wherein three or more sensor marks are detected.

It should be noted that in the condition when the print tape reaches its end portion, that is, when no more print tape is available, will be referred to as tape end and the condition when the ink ribbon reaches its end portion, that is, when no more ink ribbon is available, will be referred to as ribbon end, hereinafter.

Case 1

When three or more sensor marks are detected by the ribbon sensor 70 and the ratio of the widths of the sensor marks and the empty portions is to one to two, then ribbon end is determined. At this time, it is determined that the print tape 22 is at a printable region.

Case 2

When three or more sensor marks are detected by the ribbon sensor 70 and the ratio of the widths of the sensor marks and the empty spaces is 2 to 1, then tape end is determined. At this time, it is determined that the ink ribbon 32 is at a print region.

Case 3

When no empty portion is detected even though the print tape is fed a distance three times that of the width of a sensor mark, it can be assumed that no empty portion is detected because the sensor marks of the print tape 22 and the ink ribbon 32 are overlapping each other. In this case, both tape end and ribbon end are determined.

Case 4

When three of more sensor marks are detected, and the ratio of widths of the sensor marks and the empty space is fixed, and also the ratio is neither 2 to 1 nor 1 to 2, then it can be assumed that the sensor mark indicating the end portion of the ink ribbon 32 and the sensor mark indicating the end portion of the print tape 22 are passing through the ribbon sensor 70 in an overlapped condition. Therefore, both tape end and ribbon end are determined.

When the ink ribbon 32 is a monochrome ribbon, cases one to four described above can be distinguished. However, when the ink ribbon 32 is a striped type ribbon, the following case is also possible.

Case 5

When three or more sensor marks are detected and the ratio of the widths of the sensor marks and empty spaces is not a fixed value, then, it can be assumed that the sensor marks for distinguishing color of the ink ribbon 32 and sensor marks for indicating the end portion of the print tape 22 are being detected in an overlapped condition. In this case, determination will be postponed until the ratio of widths of the sensor marks and the empty spaces becomes a fixed value.

Because the tape-shaped label producing device 1 is configured so as to distinguish color by ratio between widths of two sensor marks, the space taken by the distinction portion will not increase even if the number of colors increases.

Conventionally, because the ink color was determined according to the number of sensor marks, the number of sensor marks increased in accordance with increase the number of colors, thereby reducing the length of the printable portion of the ink ribbon. However, the sensor mark portion of the ink ribbon 32 used in the tape-shaped label producing device 1 according to the present embodiment does not increase even when the number of ink colors increases. Therefore, the printable portion of the ink ribbon increases.

It should be noted that when the ink ribbon is a monochrome type ribbon, a predetermined portion at the end portion of either the ink ribbon 32 or the print tape 22 can be formed from a non-transparent material, and the end portion of the other one of ink ribbon 32 and print tape 22 can be formed with a plurality of equal distant sensor marks. For example, when a non-transparent portion 32*b* is formed at the end portion of the ink ribbon as shown in FIG. 17 (*b*), then when a non-transparent region having a width larger than the width of the sensor marks of the print tape 22 is detected, then ribbon end can be determined. When marks 22*a* at the end portion 22*a* of the print tape 22 are detected, then tape end can be determined.

Next explanation will be provided for a control system of the tape-shaped label producing device 1. The tape-shaped label producing device 1 according to the present embodiment can be used selectively for multi-color printing, wherein printing is performed by switching ribbon cassettes for each color to be printed, and full-color printing, wherein colors are reproduced by combining three primary colors without exchanging ribbon cassettes.

As described above, a monochrome ink ribbon is used during multi-color printing and a striped ribbon is used during full-color printing.

Figure 20:
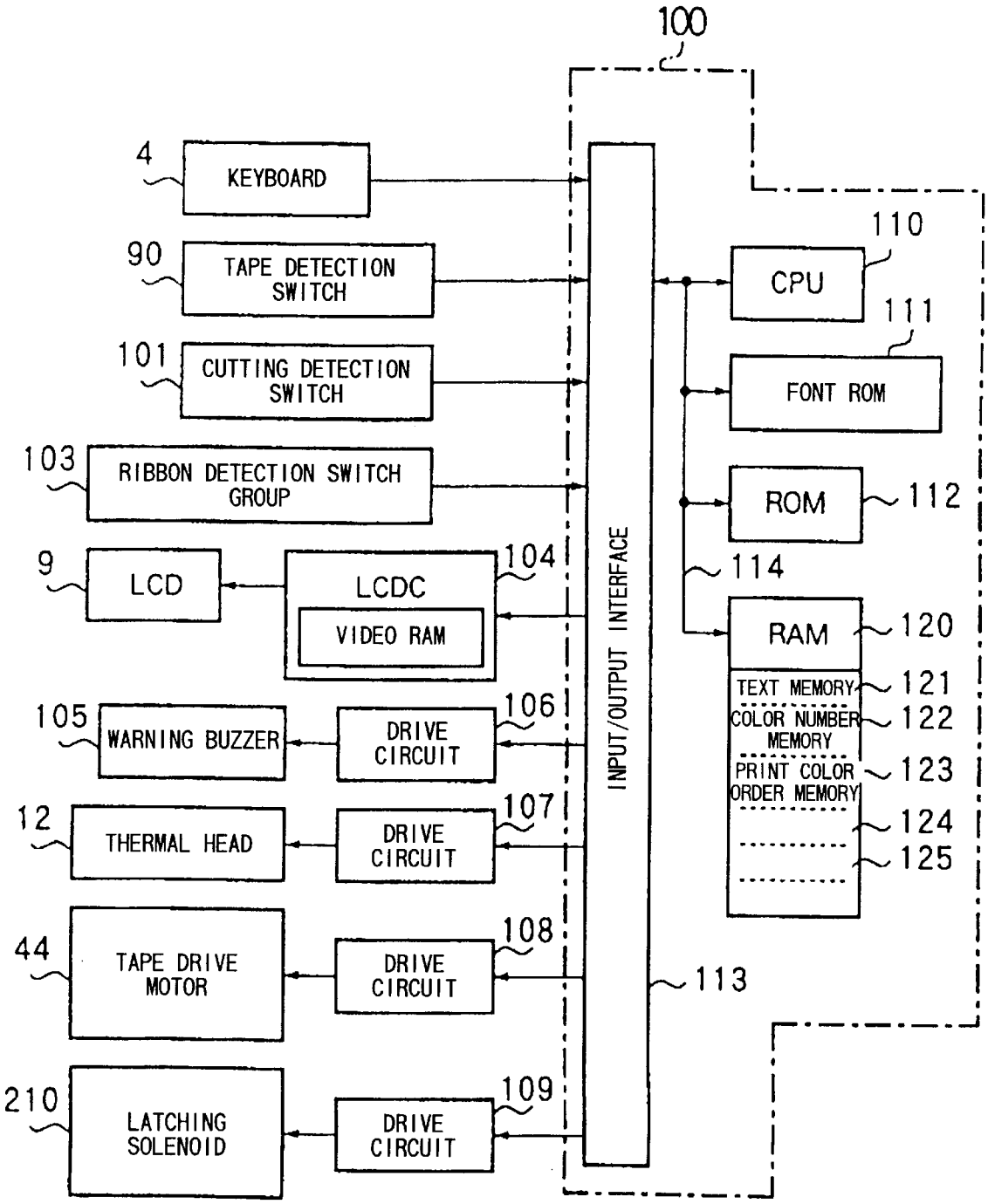
FIG. 20 is a block diagram showing a control system of the tape-shaped label producing device.

FIG. 20 is a block diagram indicating the control system. As shown in FIG. 20, the control device 100 includes an input/output interface 113. A variety of components are connected to the input/output interface 113 including: a keyboard 4; a tip detection sensor 90; a cutting detection switch 101; a ribbon/tape detection switch group 103; a display controller (LCDC) 104 for outputting display data into a liquid crystal display portion 9; a drive circuit 106 for a warning buzzer 105; a drive circuit 107 for driving the thermal head 12; a drive circuit 108 for the tape drive motor 44; and a drive circuit 109 for the solenoid 80.

The control device 100 includes: a CPU 110; the input/output interface 113 connected to the CUP 110 via a bus 114, such as a data bus; a font ROM 111; a RAM 112; and a RAM 120.

The font ROM 111 stores display dot pattern data relating to each of a plurality of characters, such as text and symbols. The font ROM 111 also stores print dot pattern data for printing the plurality of characters in a variety of different print sizes. The ROM 112 stores a variety of control programs, such as; a display control program determining correspondence between code data for characters, such as texts, symbols, and numbers inputted by the keyboard 4 and controlling the display controller 104 accordingly; a print control program for preparing dot pattern data accompanying printing based on text and symbols stored in a text memory 121; and a print control program for outputting dot pattern data for each one line, based on the prepared dot pattern data, serially to the thermal head 12 and the tape drive motor for printing the prepared dot pattern data. Also, the RAM 112 stores the determination table described previously with reference to FIG. 16. As described previously, the determination table is for detecting, based on the above-described ribbon/tape detection signal RS, the ribbon color and ribbon width of the ink ribbon 32, width and type of the print tape 22, and whether the mounted cassette houses an integral laminate type tape or a receptor type tape.

Text data formed from characters and symbols inputted from the keyboard 4 is stored in the text memory 121 of the RAM 120 in correspondence with print color data. There are two types of print color data: multi-color print data representing the inputted print color as is, that is, red, pink, blue, light blue, and the like; and full-color print data wherein the print color is broken into the three primary colors of yellow, magenta, and cyan. Text data in correspondence with full-color print data and text data in correspondence with full-color print data are stored separately in the text memory 121 of the RAM 120.

Figures 21, 22:
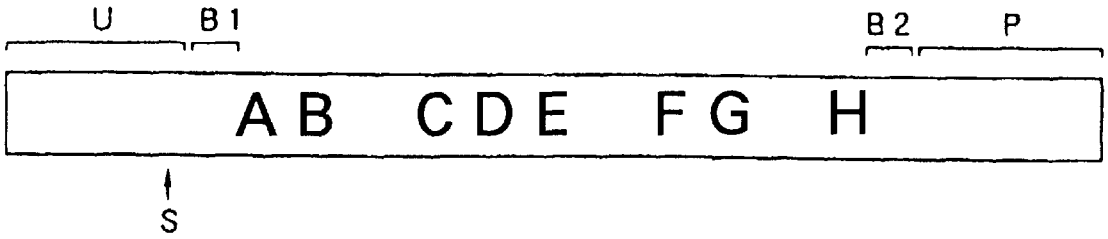
FIG. 21 is a print color correspondence table stored in the ROM of the control system.
FIG. 22 is a schematic view showing an example of a printed tape-shaped label.

A print color correspondence table shown in FIG. 21 is stored in the RAM 120. The print color correspondence table indicates the correspondence relationship between inputted print colors, such as red, pink, and blue, and the three primary color data into which the inputted colors can be broken down. For example, when blue is inputted as the print color, the CPU 110 selects magenta and cyan based on the print color correspondence table stored in the RAM. The CPU 110 then stores magenta and cyan in the text memory 112. That is, the user needs only input blue as a print color and does not need to break it down into its basic components of the three primary colors. Because the color break down is automatically performed by referring to a predetermined correspondence table, there is no need to perform complicated algorithms, thereby enabling rapid production of data indicating breaking down of appropriate primary colors.

For example, in order to prepare a tape as shown in FIG. 22, two types of data are prepared separately and stored so as to be selectively retrievable. That is, color data is prepared and stored for each color as shown in FIG. 23 and, using the three primary color data shown in FIG. 24, full-color print data broken down into yellow, magenta, and cyan is prepared and stored.

A number of inputted print colors are stored separately in the full-color print data and in the multi color print data in the color number memory 122. For example, in the example shown in FIG. 22, four is stored for the number of colors in the multi color print data as shown in FIG. 23 and three is stored for the number of colors in the full-color print data as shown in FIG. 24. Also, margin amount data relating to the set overall margin amount indicated by B1 in FIG. 22 and the end margin amount indicated by B2 in FIG. 22 are stored in a margin amount memory 124. Dot pattern data corresponding to character codes stored in the text memory 121 is developed and stored in a print data buffer 125. Further, memory and the like for temporary storing calculation results calculated by the CPU 110 are provided in the RAM 120.

When full-color printing is performed using a striped ribbon, multi-color printing cannot be performed by overlapping the primary colors until after printing of one of the primary colors, yellow, magenta, and cyan, is completed. For this reason, the length of each color region of the colors yellow, magenta, cyan must be formed longer than the print length T shown in FIG. 19. Normally, taking the applications of the tape-shaped label into consideration, it can be assumed that the print length is normally within 15 cm. Therefore, allowing for a predetermined margin, the length T of each color region in a striped ink ribbon according to the present embodiment is set to 20 cm.

It should be noted that this margin includes a distance U from the tip detection sensor 90 to the thermal element portion of the thermal head 12 and a distance P from the thermal element portion to the cutter 84.

Figure 25:
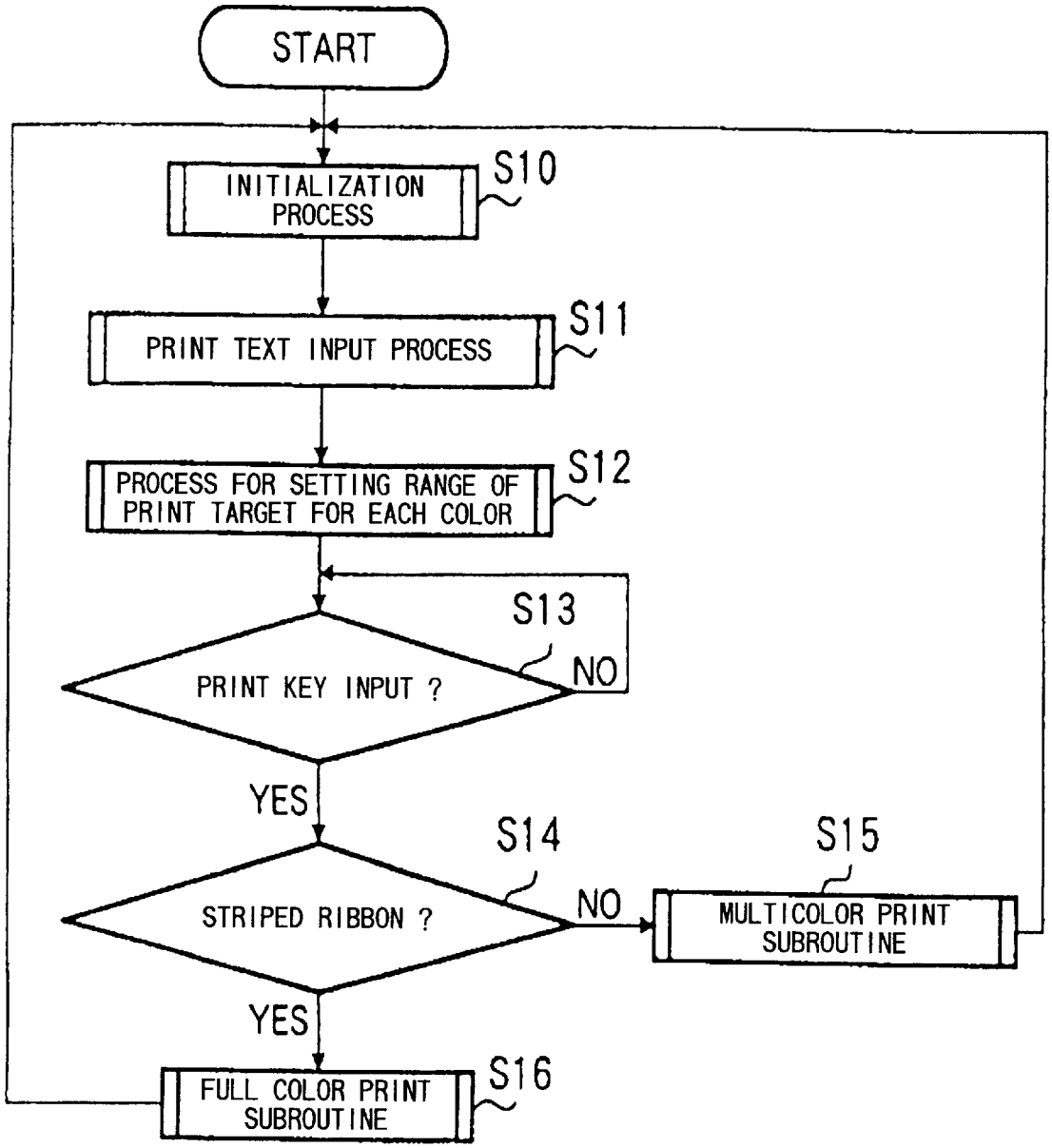
FIG. 25 is a flowchart showing a print start subroutine.

Next, an explanation will be provided for printing control based on the flowcharts in the drawings. First, an explanation will be provided for a print start control while referring to FIG. 25. As shown in FIG. 25, after initialization processes in S10, a print text input process is performed in S11. During the print text input process, the text to be printed is inputted using the keyboard 4 and the result text is displayed on the display 5. At this point, the user selects that normal printing be performed that a preformat print tape to be described later be prepared, or that printing be performed on a preformat print tape.

When the print text input process is completed, then in S12 the range for the print target for each color is set to the text inputted during the print text input process. Here, because the text data is displayed on the display 5, the user can use the display 5 while operating the four cursor keys 7*a*, which are shown disposed at the right edge of the keyboard 4 in FIG. 1, to indicate which characters and symbols should be the print target for each print color and to indicate the colors by operating the color combination key 7*b* shown in FIG. 1. When the print targets are completely set, the user operates the confirmation key 7*c* shown in FIG. 1.

When the confirmation key 7*c* is operated, then the character data indicated by operations of the cursor key 7*a* and the color confirmation key 7*d* is stored in the text memory 121 in correspondence with multi-color print data, which is data for the inputted colors, such as, red, blue, pink, light blue, and the like, and the full-color print data, wherein inputted color data is broken down into the three primary colors of yellow, magenta, and cyan. Further, whether or not the text is configured from several different color data is stored as the color number N in the color number memory 122. In the printed example shown in FIGS. 22 through 24, four is set for the color number N of the multi-color print data and three is set for the color number N of the full-color print data.

Next, whether or not input has been received from the print key is determined in S13. When input is received from the print key (S13:YES), then in S14 whether or not the ink ribbon 32 is a striped ribbon is determined by detecting, based on the ribbon detection signal RS from the above-described cassette sensor group 103, the type of ink ribbon 32 housed in the print cassette presently mounted. Here, when it is determined that the ink ribbon 32 is a striped type ribbon (S14:YES), then the program proceeds to a full-color print subroutine in S16. On the other hand, when it is determined that the ink ribbon 32 is not a stripe type ribbon, then the program proceeds to multi-color print subroutine in S15.

Figure 26:
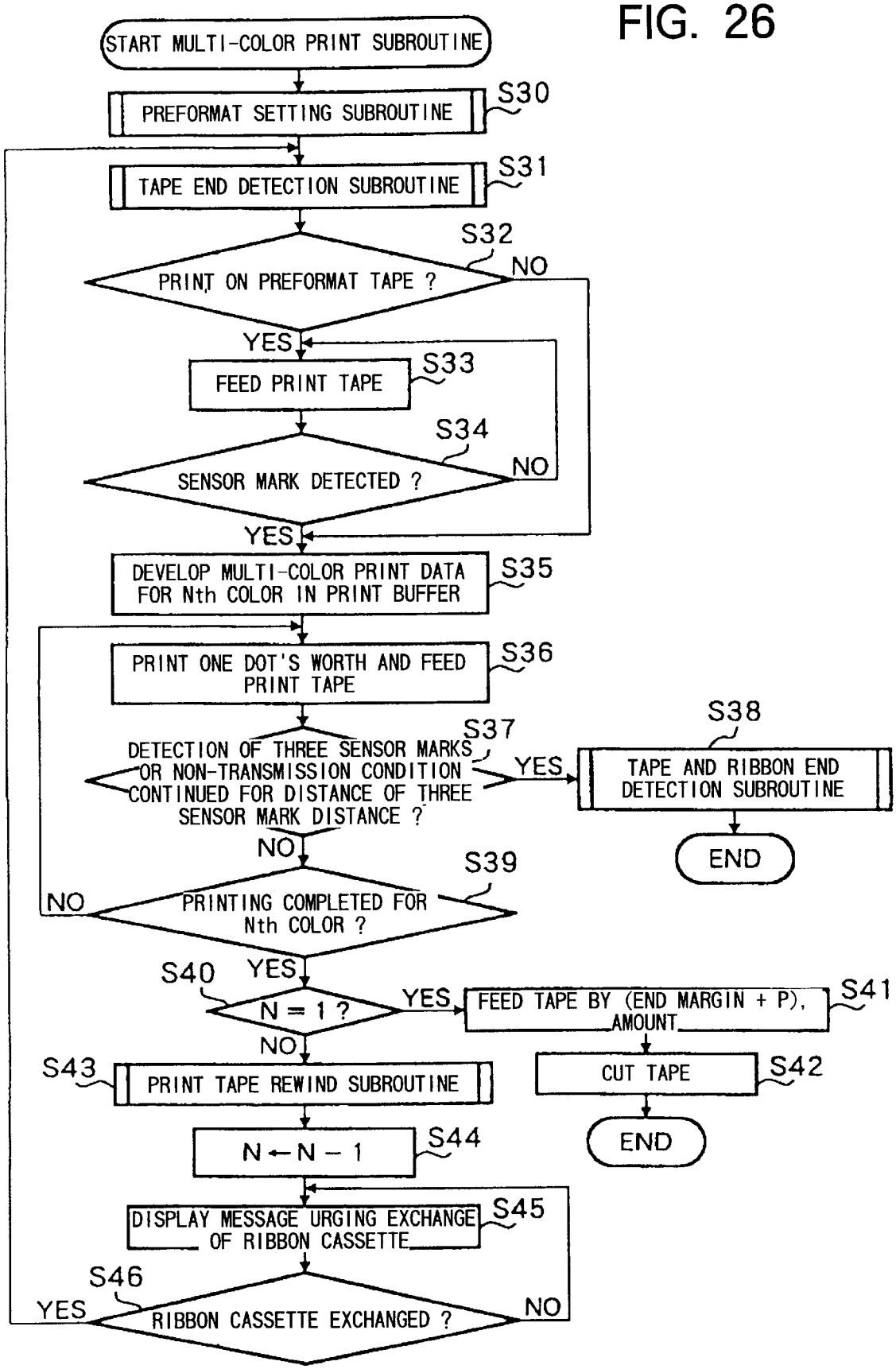
FIG. 26 is a flowchart showing a multi-color print control.

Next, an explanation will be provided for the multi-color print subroutine while referring to FIG. 26.

As shown in FIG. 26, when the multi-color print control is started, a preformat setting subroutine is executed in S30. Details of the preformat setting subroutine will be explained later. After the preformat subroutine is completed, then a tape tip detection subroutine is executed in S31.

Figure 27:
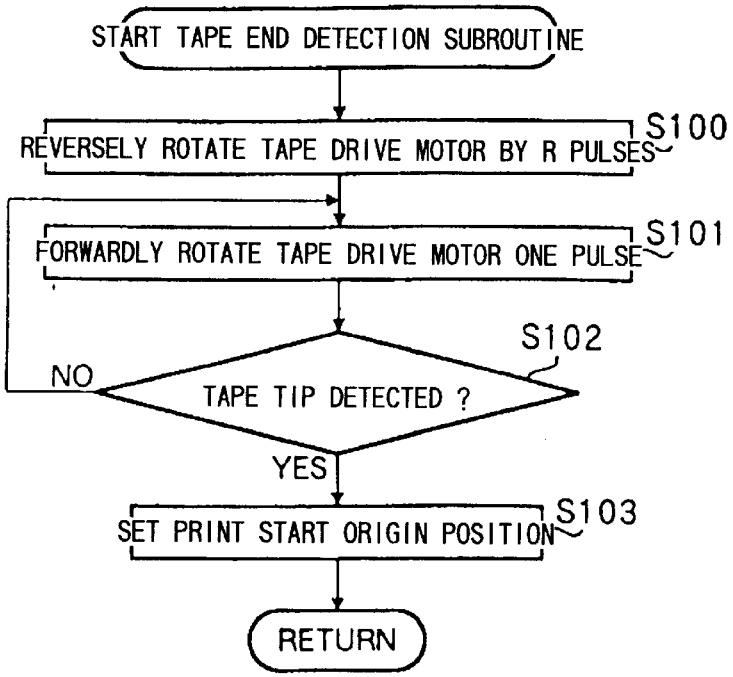
FIG. 27 is a flowchart showing a tape tip detection subroutine.

As shown in FIG. 27, during the tape end detection subroutine, the tape drive motor is rotated in reverse for a predetermined pulse number R in S100. As descried previously, the tape motor is driven in reverse in this manner to insure that a space is opened between the gear 55*a* and the gear 55*b* to an amount sufficient for applying tension on the print tape 22 extending between the tape feed subroller 26 and the platen roller 25 when the print tape 22 is first started to be transported in the forward direction. Next, the tape drive motor is driven one pulse in the forward direction in S101. Next, whether or not the tip detection sensor 90 has detected the tip of the print tape 22 is determined in S102. Steps 101 and 102 are repeated until the tip of the print tape 22 is detected. When the tip of the 22 is detected by the tip detection sensor 90 (S102:YES), then in S103, the print start origin position is set. The print start origin position is the portion of the print tape 22 positioned at the thermal element of the thermal head 12 when the tip of the print tape 22 is detected. The print start origin position is indicated by S in FIG. 22. Actual printing is started after the tape is fed by the margin amount previously set as indicated by B1 in FIG. 22. This ends the tape tip detection subroutine.

It should be noted that one pulse for driving the motor corresponds to one half dot amount during printing. That is to say, the gear train is set with a speed reduction ratio so that one dot is printed for each two pulses of the tape drive motor 44. For this reason, the tip of the print tape 22 can be detected more precisely and printing position can be more precise than compared with conventional method where single motor pulse for the tape drive motor 44 results in printing one dot.

Figure 28:
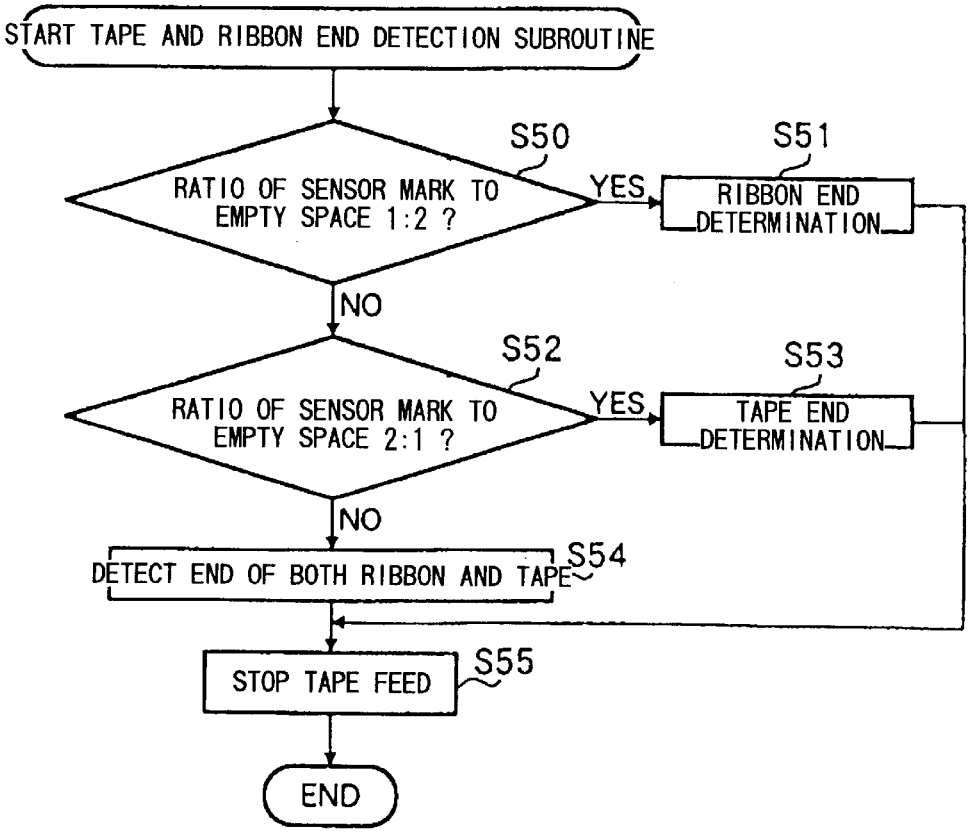
FIG. 28 is a flowchart showing a tape and ribbon end detection subroutine.

After the tape tip detection subroutine is completed, whether or not printing is to be performed on a preformat tape is determined in S32. Explanation for S32 through S34 will be provided later. Next, multi-color print data for an Nth number color is developed in the print buffer in S35. Then, in S36, one dot's worth of printing is performed on the print tape 22 while the print tape 22 is being transported. In S37, whether or not three sensor marks have been detected by the ribbon sensor 70 is determined or whether or not a non-transmission condition has continued for three sensor marks distance is determined. When either the ribbon sensor 70 detects a sensor mark or a non-transmission condition is detected to continue for three sensor marks distance (S37:YES) then a tape and ribbon end detection subroutine is executed in S38. As shown in FIG. 28, during the tape end and ribbon end detection subroutine when the ratio of the sensor mark and empty space detected by the ribbon sensor 70 is 1:2 (S50:YES), then ribbon end is determined in S51. When the ratio of the sensor mark to the empty space portion is 2 to 1, (S52:YES), then tape end is determined in S53. When neither of the above two situations applies (S52:NO), then both tape end and ribbon end are determined in S54. Then in S55, the detected condition is displayed on the liquid crystal display 5, transport of the tape is stopped, and the print control is terminated.

On the other hand, when the ribbon sensor 70 does not detect three or more sensor marks (S37:NO), then whether or not printing on the print tape in the present print color has been completed or not is determined in S39. If printing of the present color has no been completed (S37:NO), then S37 through S39 are repeated. When printing of the present print color has been completed (S39:YES), then whether or not the present print color is the final print color is determined in S40. If so (S40:YES), then the tape is transported a predetermined amount in S41, and a message urging the user to cut the tape is displayed in S42. Then the printing program is terminated. Predetermined amount in which the tape is transported in S41 is the sum of the rear margin amount B2 and the distance P between the print head 12 and the cutter 84 shown in FIG. 22.

Figure 29:
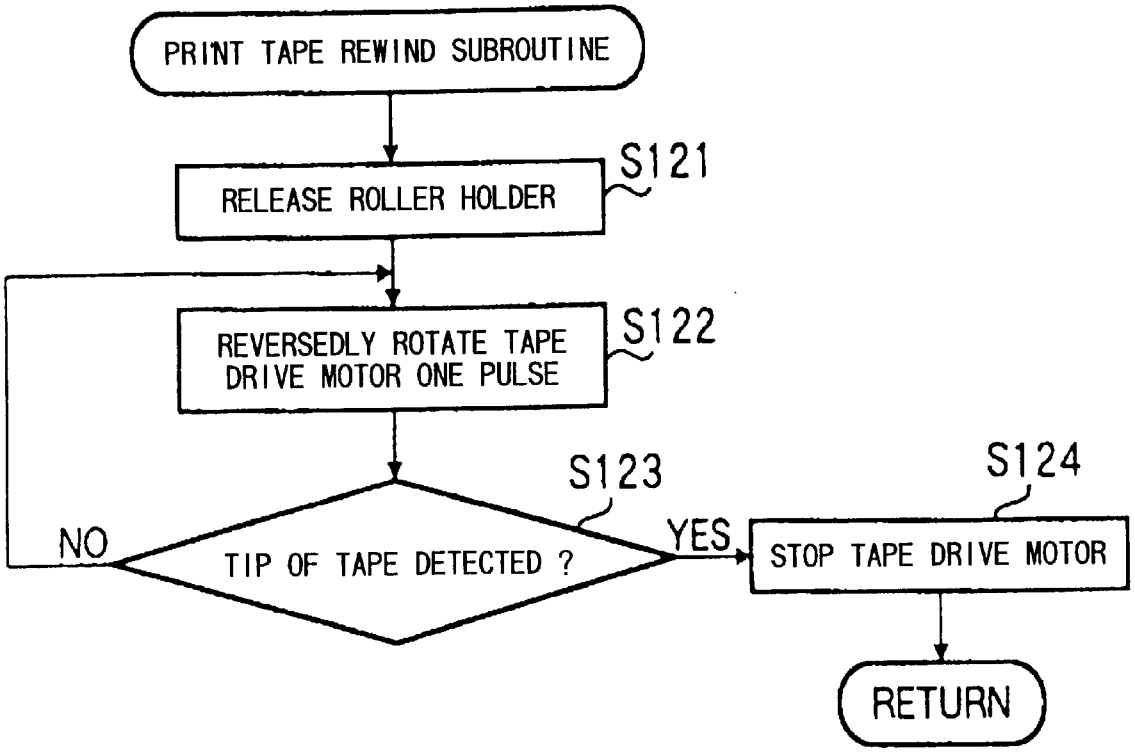
FIG. 29 is a flowchart showing a print tape rewind subroutine.

When the printing color is not the final printing color (S40:NO), then a print tape rewind subroutine is executed in S43. As shown in FIG. 29, during the print tape rewind subroutine, the solenoid 80 is driven to release the roller holder 67 in S121. The tape drive motor 44 is rotated in a reverse direction one pulse in S122. Then, whether or not the tip detection sensor 90 has detected the tip of the print tape 22 is determined in S123. When the tip of the print tape 22 has not been detected, then S122 and S123 are repeated. When the tip of the 22 has been detected (S123:YES), then the tape drive motor 44 is stopped in S124 and the print tape rewind subroutine is terminated.

Next, the print color number N is incremented by one in S44, whereupon in S45 a message is displayed on the liquid crystal display 5 urging the user to exchange the ribbon cassette 30. In S46, it is determined whether or not the cassette has been exchanged. Whether or not the ribbon cassette 30 has been exchanged can be determined as a result of all of the switch group 103 relating to the presently amounted ribbon cassette being turned off when the ribbon cassette is removed and then turned on again when the ribbon cassette 30 is replaced. When the ribbon cassette 30 has been exchanged (S46:YES), then the program returns to S31 and the same operations are performed until printing of the final print color has been completed.

This ends the multi-color print routine.

In the present embodiment, no processes are performed for detecting ink color of the ribbon cassette or for performing printing according to the color data. The user performs printing according to ribbon color from the first color to the Nth color.

Figure 30:
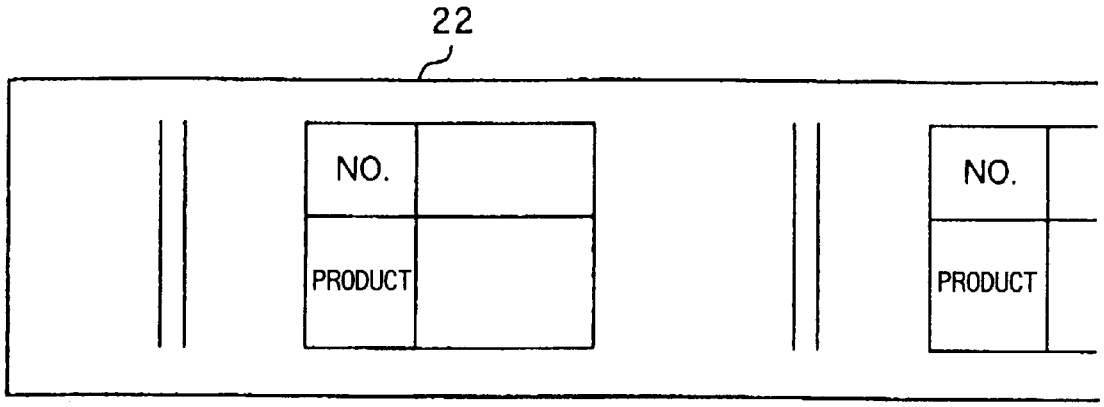
FIG. 30 (*a*) is a schematic view showing an example of a print tape printed with a preformat pattern.
Figure 30:
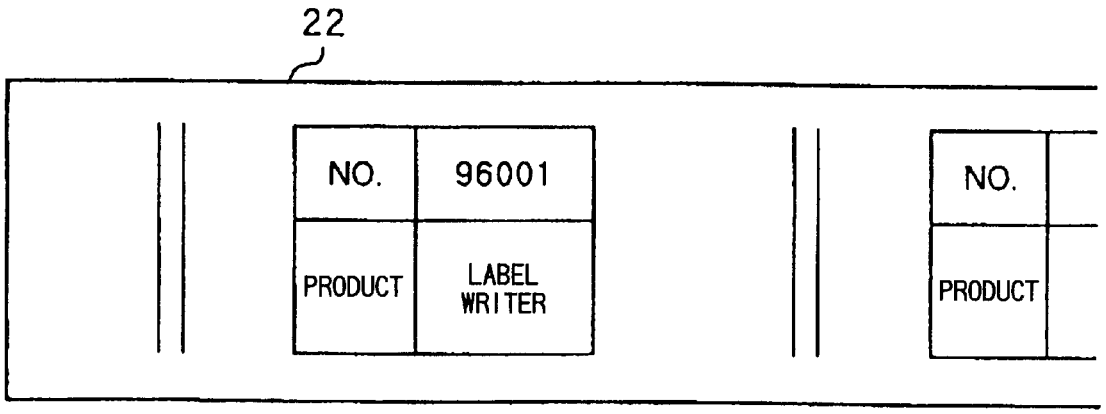

Next, an explanation will be provided for preformat printing. In preformat printing, as shown in FIG. 30 (*a*), a general format such as a predetermined label or name tag is pre-printed on the print tape 22. After the tape is once printed on, the print tape 22 is rewind and printed on in a combination format as shown in FIG. 30 (*b*). In this way, by preparing a preformatted print tape, there is no need to input the format each time.

When the format for a predetermined label and the like is to be formed on the print tape 22, a positioning mark is formed for serving as a standard for present positioning when printing characters and the like in the format.

Sensor marks for distinguishing the color of the ink ribbon 32 and detectable by the tip detection sensor 90 are formed on the ink ribbon 32 as described previously. In order to avoid confusion between the sensor marks and the positioning mark, the positioning mark is detected by the light emitting/receiving elements 92 of the tip detection sensor 90 operating as a reflection type photosensor. That is to say, the positioning mark does not reflect the sensor light from the light emitting/light reception elements 92 of the tip detection sensor 90. This contrasts with the print tape itself, which does reflect the sensor light from the detection sensor 90. Instead, the positioning mark is formed as a portion transmitting sensor light from the ribbon sensor 70, which emits a greater amount of light than the tip detection sensor 90.

During a preparatory printing wherein a format is printed, the positioning marks are printed between the patterns, such as preprinted predetermined labels, printed repeatedly on the print tape 22. During a main printing, wherein a name and the like is printed in the predetermined label of the preformat tape, the positioning marks are detected by the tip detection sensor 90 and printing is performed to match the patterns such as the predetermined label. As shown in FIG. 30 (*a*), the positioning mark can be repeatedly formed in the patterns. Therefore, when printing is performed on the preformat tape, positioning can be performed for each pattern.

Figure 31:
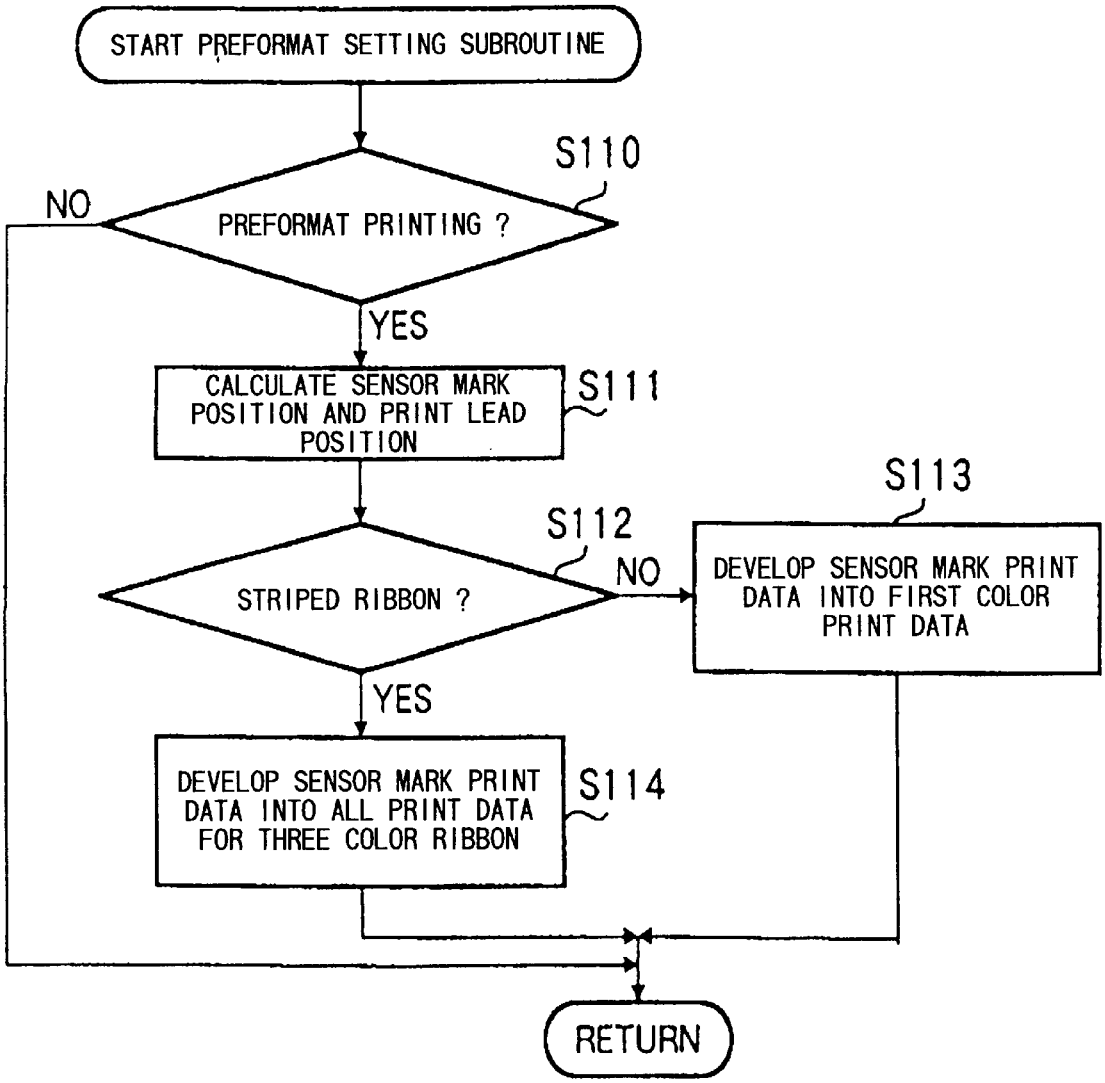
FIG. 31 is a schematic view of a preformat setting subroutine.

As shown in FIG. 31, during the preformat setting subroutine, whether or not preformat printing is to be performed is determined in S110. If preformat printing was selected during input of print data during print starting process, that is, S11 in FIG. 25 (S110:YES), then a position to print the positioning mark and a print read position for printing patterns are calculated and stored in S111. Then, whether or not the ink ribbon 32 is a striped ribbon is determined in S112.

When the ink ribbon is a striped type (S112:YES), then the positioning mark is printed in a black color so as to provided sufficient contrast with the print tape 22. For this reason, print data for the positioning mark is developed from the print data of all three primary colors. On the other hand, when the ink ribbon 32 is a monochrome ribbon (S112:NO), then the color of the monochrome ribbon is denser than that of the striped ribbon so that there is no need to print the positioning marks in black. Therefore, to increase the processing speed, print data, for example red, is developed. This ends the preformat setting subroutine.

After the preformat setting subroutine is completed and S31 through S36 of the multi-color print subroutine is performed, then a pattern, such as predetermined label set during the preformat setting routine, and positioning marks are printed in the same manner as during normal multi-color printing. In this way, a predetermined format is printed and a preformat tape is produced.

When printing on a preformat tape was selected during input of print text in the print start subroutine, that is, during S11 of FIG. 25, then S32 of FIG. 26 will result in a positive determination so that printing during the multi-color print subroutine will be performed on a preformat tape. That is to say, during the multi-color print subroutine, the print tape 22 is transported in S33 and S34 until the positioning mark is detected by the tip detection sensor 90. It should be noted that at this time the light emission/light reception element 92 of the tip detection sensor 90 functions as a reflection type sensor. After the positioning mark is detected, then name and the like are printed on the preprinted format, such as a predetermined label, by simultaneously printing in the same manner as during normal multi-color printing.

In this way, a tape-shaped label producing device 1 is controlled so that positioning marks are printed on the print tape 22 during a primary printing, that is, preformat printing, and then printing is performed in a main printing, that is, printing on the preformat tape based on detected positioning marks after the positioning marks are detected. For this reason, it is possible to perform printing at a precise position with respect to the format preprinted on the tape.

Figure 32:
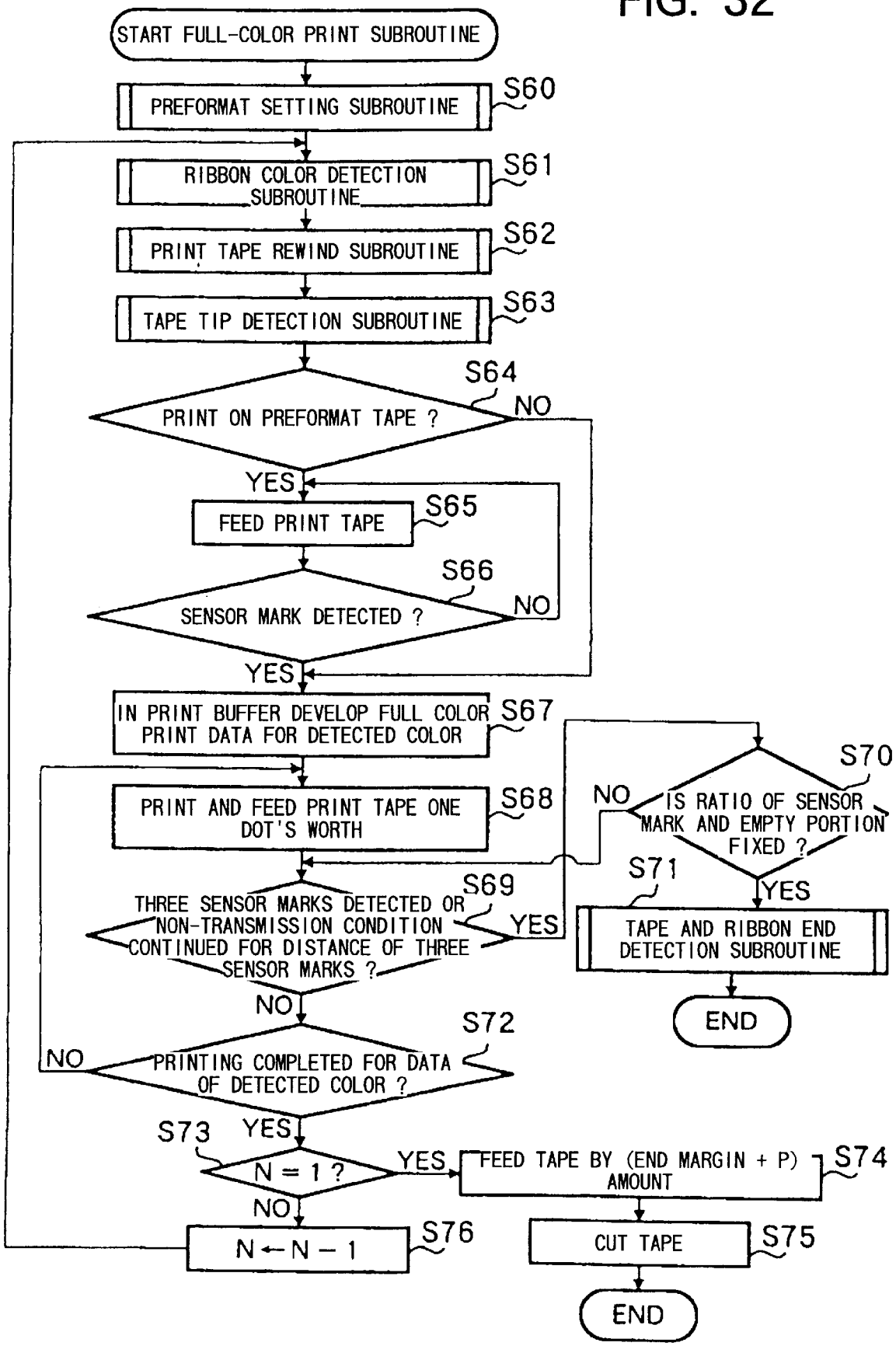
FIG. 32 is a flowchart showing a full-color print subroutine.
Figure 33:
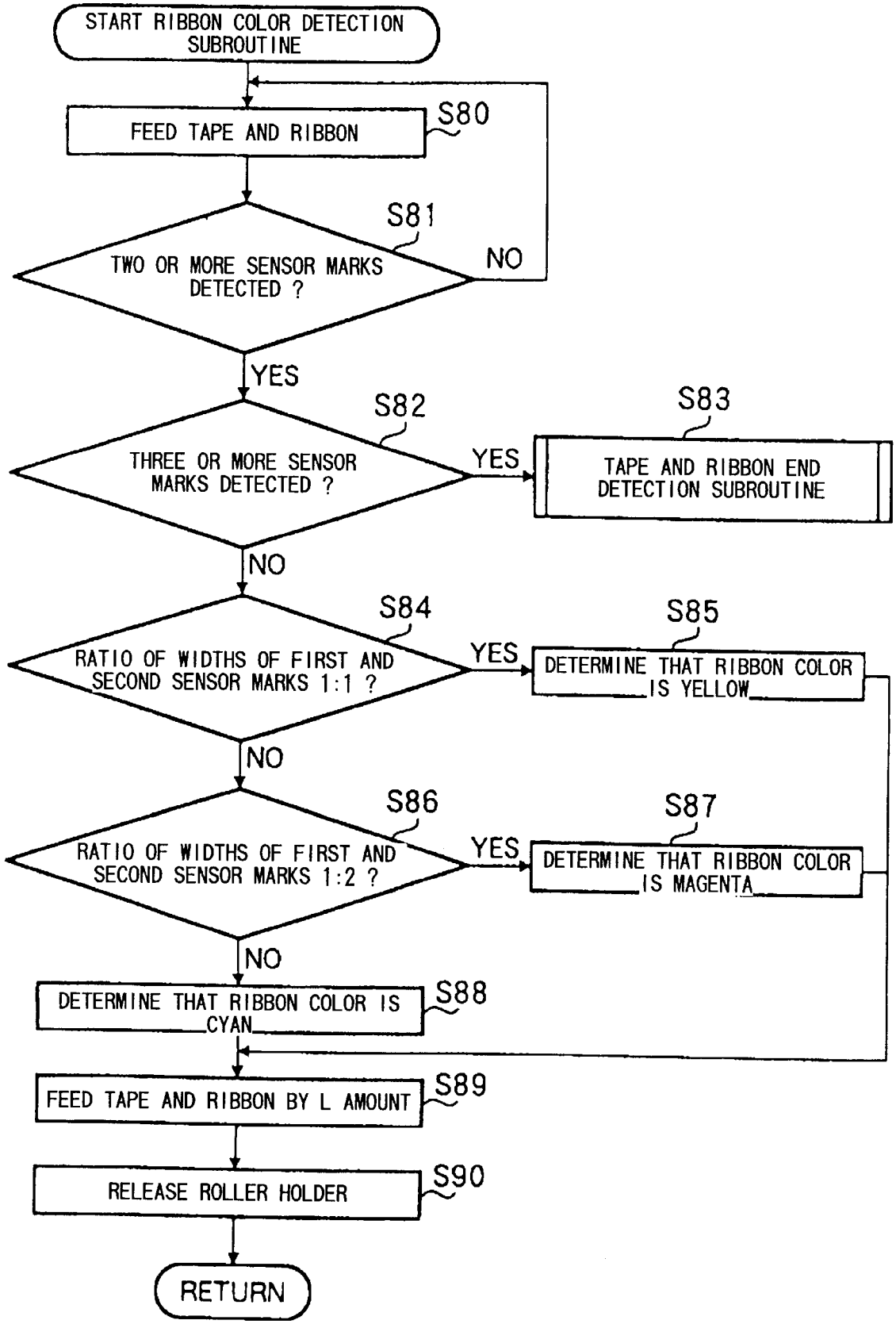
FIG. 33 is a flowchart showing a ribbon color detection subroutine.

As shown in FIG. 32, when the full-color print subroutine is started, first in FIG. 60, the preformat setting subroutine is executed. After the preformat setting subroutine is completed, then in S61, the ribbon color detection subroutine is executed. As shown in FIG. 33, during the ribbon color detection subroutine in S80 the print tape 22 and the ink ribbon 32 are transported. Then, whether or not the ribbon sensor 70 has detected two or more thermal marks is determined. When the ribbon sensor has detected two or more sensor marks (S81:YES), then whether or not three or more sensor marks have been detected is determined in S82. When three or more sensor marks have been determined (S82:YES), then the above-described tape and ribbon end detection subroutine is executed in S83. When three or more sensor marks are not detected (S82:NO), then it is determined that the sensor marks are for color distinction so color distinction of ink color is performed in steps 84 and on.

Next in S84, the widths of the first and second sensor marks are compared. When the ratio of the two widths is 1 to 1 (S84:YES), then it is determined that the ink ribbon is at the start of a yellow region. When the ratio of the widths of the first and second sensor marks is 1 to 2 (S86:YES), then it is determined that the ink ribbon is at the start of a magenta color region. When the ratio is neither of these (S86:NO), then it is determined that the ink ribbon is at the start of a cyan color region. At this point, the start of the distinguished color region is positioned at the ribbon sensor 70. Therefore, next in S89, the print tape 22 and the ink ribbon 32 are transported a predetermined amount L in order to move the ink ribbon 32 from the position of the ribbon sensor 70 to the position of the thermal elements of the thermal head 12. Next in S90, the solenoid 80 is operated to release the roller holder. This ends the ribbon color detection subroutine.

After the ribbon color detection subroutine is completed, then the above-described tape rewind subroutine is performed in S72 and the above-described tape tip detection subroutine is executed in S63. Next, in S64 whether or not printing is to be performed on a preformat tape is determined. When printing on a preformat print tape was selected during the print start subroutine (S64:YES), then in S65 and S66, the print tape 222 is transported until the tip detection sensor 90 detects a positioning mark. It should be noted that at this time, the light-emission/light-reception element 92 of the tip detection sensor 90 functions as a reflection type photosensor.

Next, the full-color print data, that is, three primary color data, for the detected color is developed in the print buffer in S67. When a label shown in FIGS. 22 through 24 is to be printed, then print data for A, B, C, D, E, F, G, and H is developed when the detected color is yellow, print data for A, B, F, and G is developed when the detected color is magenta, and print data for C, D, E, F, and G is developed when the detected color is cyan.

Next, in S68, one dot's worth of printing is performed on the print tape 222 while the print tape 222 is transported. Next, in S69, whether or not the ribbon sensor 70 has detected three sensor marks is determined and whether or not a non-transmission condition has continued for a distance corresponding to three sensor marks is determined. Printing is continued in S68 and S69 until three sensor marks are detected or until a non-transmission condition is detected to continue for a distance of three sensor marks is detected.

When the ribbon sensor 70 detects three sensor marks or a non-transmission condition for distance equivalent to three sensor marks (S69:YES), then the program proceeds to the above-described tape and ribbon end detection subroutine. However, before that, in S70, whether or not the ratio of the sensor mark widths and the empty space portion between the marks as shown in FIGS. 17 (*a*) to 19 of the three detection sensor marks is fixed is determined. When the ratio is not fixed, then it can be assumed that a sensor mark for distinguishing color is overlapped with a sensor mark for indicating the end of the tape. Therefore, the routine returns to S69 without determining the end of the ink ribbon and tape. When the ratio of the sensor mark widths and the empty space portion is fixed, then the program proceeds to the tape and ribbon detection subroutine in S71.

On the other hand, when three or more sensor marks are not detected (S69:NO), then whether or not print data for the detected color has been completely printed is determined. When printing is determined to have not been completed (S72:NO), then S68 through S72 are repeated. When printing is determined to have been completed (S72:YES), then whether or not the presently printed color is the final print color or not is determined in S73. If the present print color is the final print color (S73:YES), then the print tape 222 is transported a predetermined amount in S74. Next, in S75, a message is displayed urging the user to cut the tape. This completes printing processes. The predetermined amount in which the print tape 222 is transported in S74 is the sum of the end margin amount B2 shown in FIG. 22 and the distance P between the print head 12 and the cutter 84 also shown in FIG. 22. When the presently printed color is not the final print color (S73:NO), then the print color number N is decremented by one in S76 and the program returns to S61, whereupon the same operations are repeated until printing of the final print color is completed.

This completes the full-color print subroutine.

In this way, a print color setting means (keyboard 4, CPU) for setting print color of text; a first print color memory means (text memory 121) for storing data of the print color as is; and a second print color memory means (text memory 121) for breaking down the print color set by the print color memory means into a predetermined plurality of colors and storing a plurality of colors as a combination of data are provided. Therefore, both multi-color printing wherein separate colors are printed when colors are printed separately and full-color printing wherein colors are printed overlapping each other can be performed. Further, because a combination data memory portion (RAM) is provided for storing print color set by the print color setting means in correspondence with the three primary color data by only setting the print color, the set print color is automatically broken down into its primary color components by referring to the predetermined correspondence table. For this reason, data representing break down of a color into the three primary colors can be rapidly produced.

According to the tape-shaped label producing device of the first embodiment, multi-color printing and full-color printing can be selected. It should be noted that one merit of full-color printing is that the ribbon can be used with extreme economy because the color ribbon is consumed only as necessary during each printing operation. Also, each of the colors are reproduced by the particular color of the ink ribbon so that the reproduction of color is excellent. With respect to merits of the full-color printing, a variety of colors can be freely selected using only a single ribbon cassette. Further, color printing can be achieved without exchanging ribbon cassettes so that operations are simple.

For this reason, according to the tape-shaped label producing device of the present embodiment, the user can select the printing method most appropriate for his or her desired application by considering the merits of multi-color printing and full-color printing.

Next, an explanation will be provided for a second embodiment of the present invention.

According to the second embodiment, the print tape is transported by both the tape feed subroller and the platen roller when a laminate type tape cassette is being used. On the other hand, the print tape is transported by the platen roller only when a receptor type tape cassette is being used. Further, in the second embodiment, the end of the print tape is detected by a tip detection sensor for detecting the tip of the print tape.

Next, an explanation will be provided for a laminate type cassette.

Figure 34:
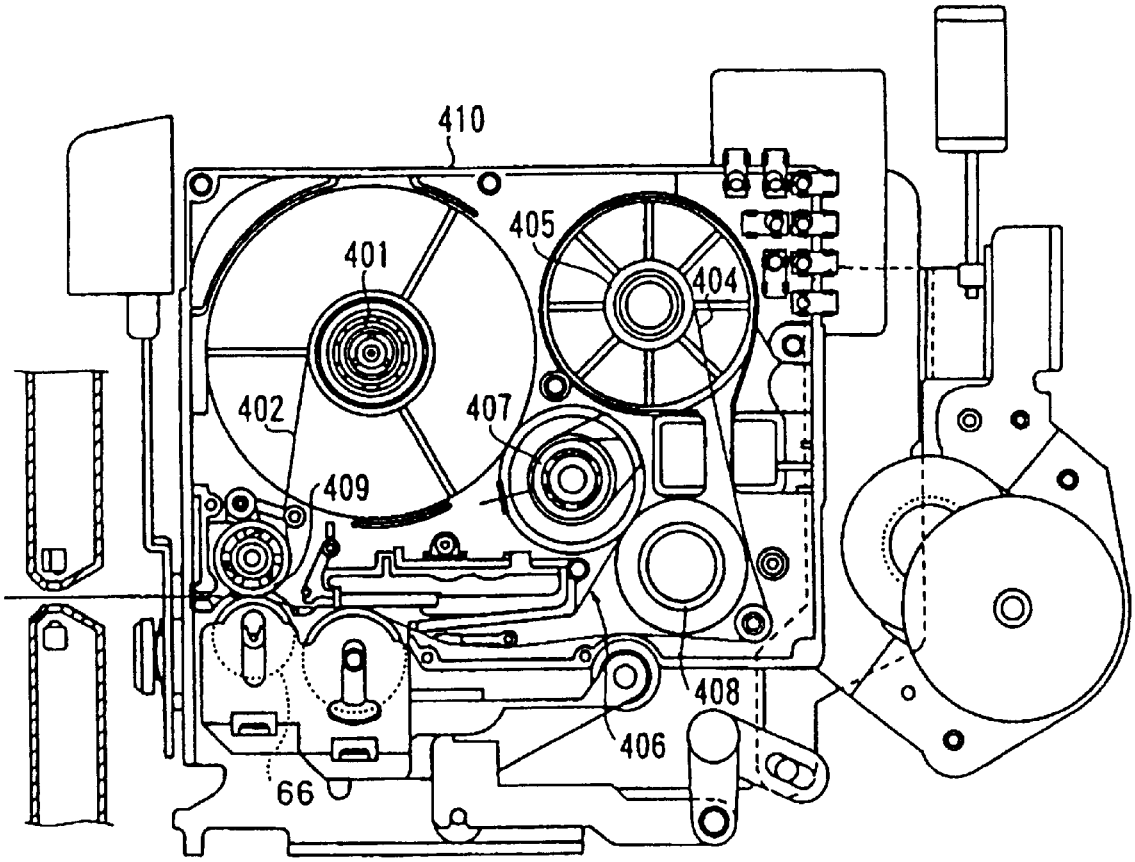
FIG. 34 is a plan view showing a cassette mounting portion of the tape-shaped label producing device according to a second embodiment mounted with a laminate-type tape cassette.

As shown in FIG. 34, a two-sided adhesive tape 402, a transparent tape 404, and an ink ribbon 406 are housed in a cassette case 410. The two-sided adhesive tape 402 is wrapped around a tape spool 401. The transparent tape 404 is wrapped around the spool 405. The ink ribbon 406 is wrapped around a ribbon spool 408. The ink ribbon 406 is taken up by a ribbon take-up spool 407. The ribbon take-up spool 407 is driven in the same manner as described for the ribbon take-up spool in the first embodiment. Also, the tape-feed roller 408 functions to adhere the transparent tape 404 to the two-sided adhesive tape 402 at a position between the tape-feed subroller 66 of the tape-shaped label producing device 201.

It should be noted that full-color printing and the multi-color printing are not possible with a laminate type cassette, because sensor marks of the ink ribbon 406 can not be detected by the ribbon sensors and exchange of the ribbon cassette can not be detected.

Figure 35:
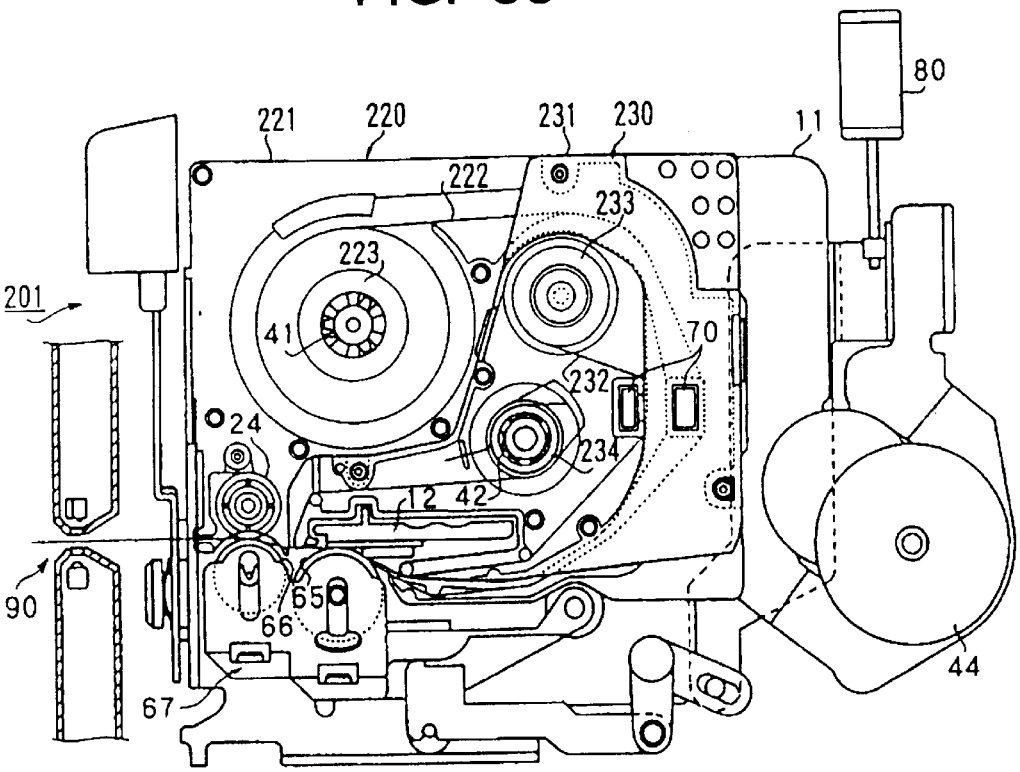
FIG. 35 is a plan view showing the tape-shaped label producing device according to the second embodiment mounted with a tape cassette and a ribbon cassette.
Figure 36:
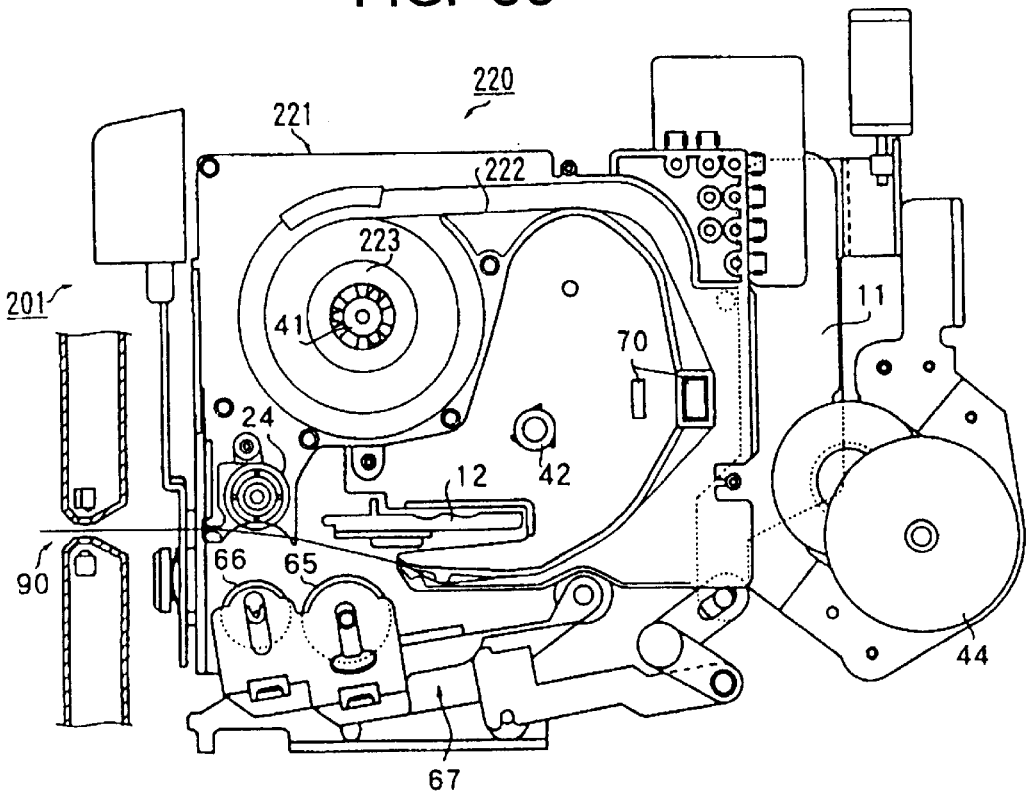
FIG. 36 is a plan view showing the tape-shaped label producing device of the second embodiment mounted with a tape cassette only.

Next, an explanation will be provided for a receptor-type cassette. As described above, two types of receptor-type cassettes are available: a tape/ribbon integral type cassette and a tape/ribbon separate cassette. FIG. 35 is a plan view showing a tape-shaped label producing device 201 mounted with the tape/ribbon separate cassette. FIG. 36 is a plan view showing the ribbon cassette 230 removed after the roller holder 69 is released. As shown in FIG. 36, the tape cassette 220 includes a tape spool 223 for winding up a print tape 222 at the internal portion of the tape case 221. The ribbon cassette 230 is provided with a ribbon take-up spool 234 for taking up the ink ribbon 232 and a ribbon spool 233 around which is wrapped the ink ribbon 232.

In contrast with the tape cassette 20 of the first embodiment, in the tape cassette 220 of the second embodiment, the print tape 222 is transported so as to bypass the ribbon sensor 70. In other words, the ribbon sensor 70 is used for detecting only sensor marks formed on the ink ribbon 232.

Next, an explanation will be provided for the tape-shaped label producing device 201 according to the second embodiment.

A tape wind-up cam 41 capable of engagement with the tape cassette 223 of the tape cassette 220 and a ribbon take-up cam 42 capable of engaging with the ribbon take-up spool 234 of the ribbon cassette 230 are rotatably supported on a main frame 11 of the tape-shaped label producing device 201.

Figure 37:
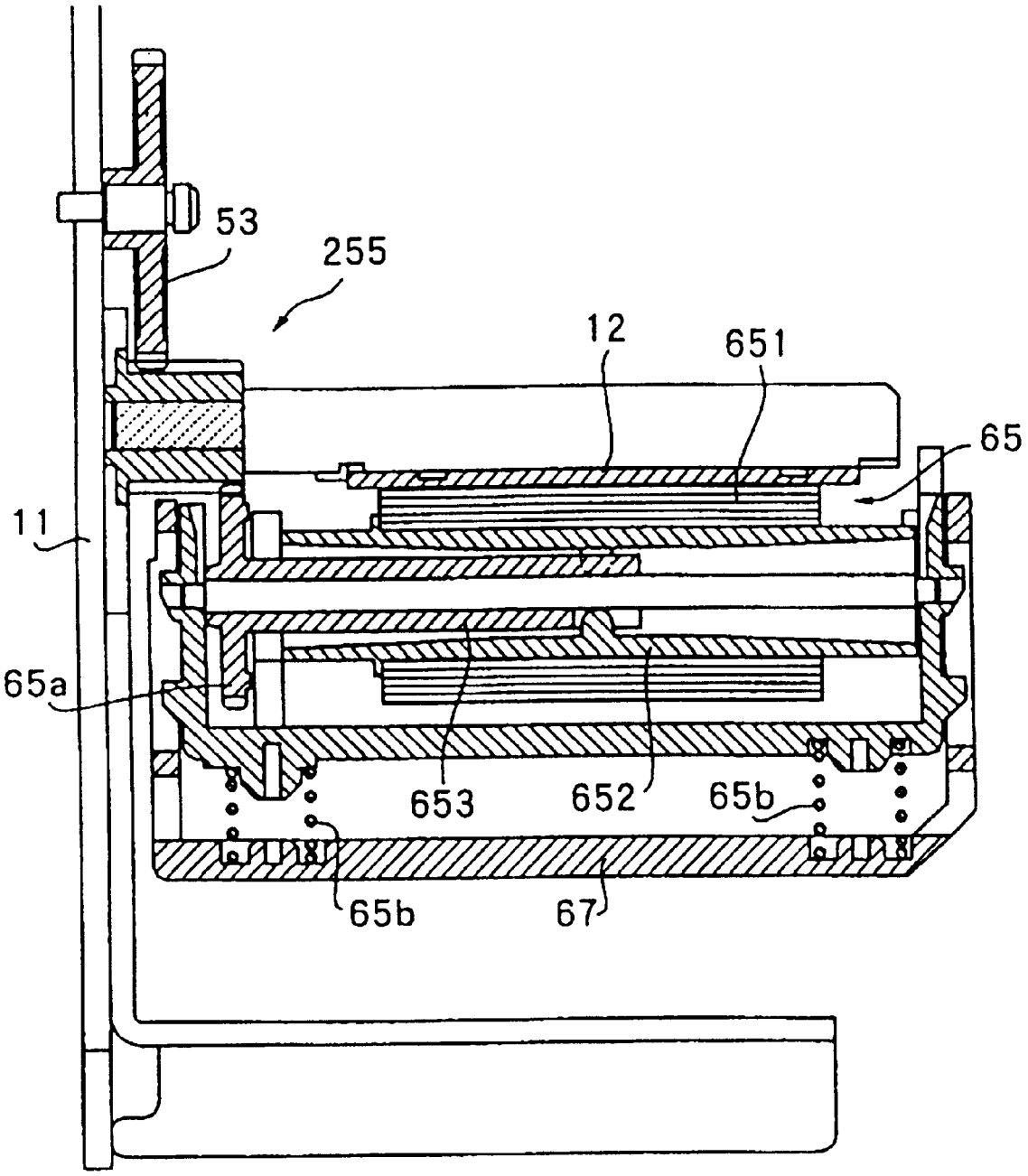
FIG. 37 is a side view showing a platen roller and its drive portion according to the second embodiment.

A thermal head 12 for printing on the print tape 222 is provided in the tape-shaped label producing device 201. A platen roller 65 is disposed in confrontation with the thermal head 12 so as to sandwich the tape between itself and the thermal head 12. Also, a tape-feed subroller 66 is disposed in confrontation with a tape-feed roller 24 of the tape cassette 220 so as to sandwich the tape between itself and the tape-feed roller 24. The platen roller 65 and the tape-feed subroller 66 are supported on the roller holder 67 so as to be pivotable with respect to the main frame 11. Also, a tape-feed motor 44 is provided on the main frame 11. A drive portion for the platen roller 65 is shown in FIG. 37. The platen roller 65 and its drive portion shown in FIG. 37 are configured substantially the same as described in the first embodiment with the exception of a gear 255 for engaging with the platen gear 65*a,* which is for driving the platen roller 65. That is to say, the platen roller 65 is formed from a roller body 651 and a roller shaft 652 penetrating through the roller body 651. The roller shaft 652 is hollow. A drive shaft 653 for driving rotation of the platen roller 65 is inserted into the hollow portion of the roller shaft 652. The platen gear 65*a* is formed to the drive shaft 653. The gear 255 engaging with the platen gear 65*a* is different from the gear 55 of the first embodiment in that it is not divided into two speeds in the axial direction. The drive system from the tape-feed motor 44 to the gear 53 is otherwise the same as described in the first embodiment.

Figure 38:
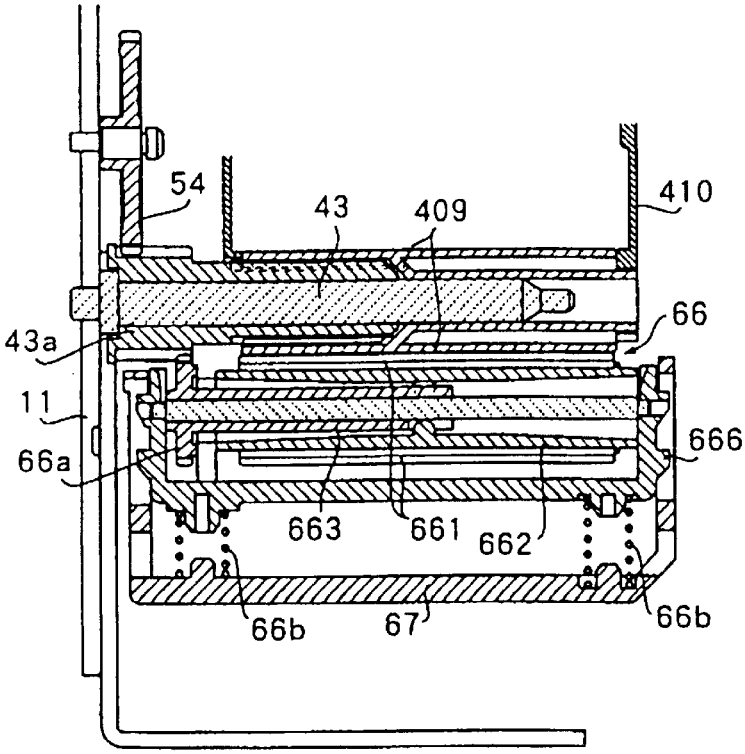
FIG. 38 (*a*) is a cross-sectional view showing a platen roller and its drive portion according to the second embodiment.
Figure 38:
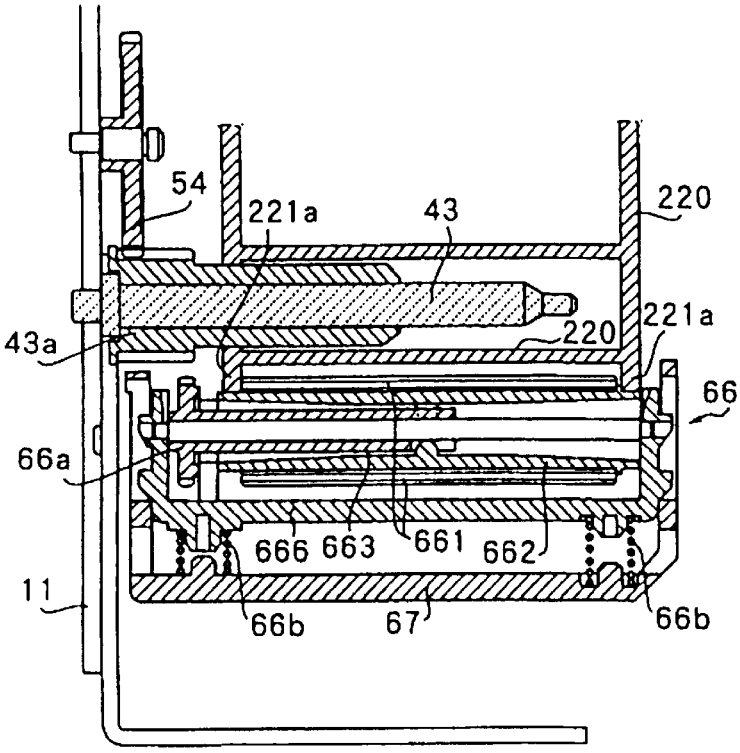

FIGS. 38 (*a*) and 38 (*b*) show a drive portion for the tape-feed subroller 66. As shown in FIG. 38 (*a*), the tape-feed subroller 66 and its drive portion are configured the same as described in the first embodiment with reference to FIG. 11. That is, the tape-feed subroller 66 includes a roller body 661 and a tape-feed subroller shaft 662 penetrating through the roller body 661. The roller shaft 662 is hollow. A drive shaft 663 for driving rotation of the tape-feed subroller 66 is inserted in the hollow portion of the roller shaft 662. A drive gear 66*a* is provided to the drive shaft 663. A tape drive gear 43*a* is provided to the lower portion of the tape-feed roller cam 43. A gear 45 is provided for driving the drive gear 66*a* via the tape drive gear 43*a*. The drive system from the tape-feed motor 44 to the gear 54 is the same as that described in the first embodiment.

The drive shaft 663 is rotatably supported on a movable case 666. The movable case 666 is supported so as to be movable in the vertical direction as viewed in FIG. 38 (*a*) with respect to the roller holder 67. Springs 66*b* are provided to the roller holder 67. The springs 66*b* urge both axial ends of the movable case 666 upward as viewed in FIG. 38 (*b*).

As shown in FIG. 38 (*b*), when a receptor-type tape cassette 220 mounted in the tape-shaped label producing device, a rib 221*a* formed on the tape cassette 220 urges the axial portion of the tape-feed subroller 66 downward as viewed in FIG. 38 (*b*) against the urging force of the springs 66*b*. For this reason, the tape-feed subroller 66 is brought into a position where it does not contact the print tape 222, engagement between the tape drive gear 43*a* and the tape-feed subroller 66*a* is released, and drive force is not transmitted to the tape-feed subroller 66.

When the tape-feed subroller 66 and the platen roller 65 are simultaneously driven, there is a possibility that the platen roller will begin rotating before the tape-feed subroller 66 by backlash between gears before the drive force reaches the rollers. In this case, the tape extending between the tape-feed subroller 66 and the platen roller 65 may loosen. When the tip of the print tape 222 is detected, this looseness can generate error in the distance detected between the tape tip position and the print start origin position. When a receptor-type cassette is used, full-color printing and multi-color printing are often performed. Therefore, when the tip of the print tape 222 is detected with poor precision, then shift in the print position will occur with each different color. For this reason, as shown in FIG. 38 (*b*), by transporting the print tape 222 using the platen roller 65 and stopping rotation of the tape-feed subroller 66, then, slack of the print tape 222 between the tape-feed subroller 66 and the platen roller 65 can be prevented.

On the other hand, when a laminate-type cassette 410 is mounted, then as shown in FIG. 38 (*a*), the tape-feed subroller 66 and the tape-feed roller 409 contact each other and also the tape drive gear 43*a* and the tape-feed subroller 66*a* meshingly engaging each other so that rotational force is transmitted thereby. The tape-feed subroller 66 and the tape-feed roller 409 in the tape cassette adhere the two-sided adhesive tape 402 to the transparent tape 404. The laminate type cassette is not used for full-color printing or multi-color printing so that the tip of the print tape 222 need not to be detected with a great deal of precision. Therefore, slack of the print tape 222 between the tape-feed subroller 66 and the platen roller 65 is acceptable.

In this way, the tape-feed subroller 66 contributes to transport of the print tape 404 only when the laminate type cassette is used wherein the two-sided adhesive tape is adhered to the transparent tape 404 using the tape-feed subroller 66.

In receptor-type cassettes, there is no need to adhere the two-sided adhesive tape. The receptor-type cassette is used for multi-color printing and full-color printing so there is a need to accurately detect the tip position of the print tape 222. Therefore, when the receptor-type cassette is being used, the print tape 222 is transported by the platen roller 65 only and, as described above, variation in the print start position caused by a slack in the tape between the tape-feed subroller 66 and the platen roller 65 can be reduced. Therefore, shift in printing position of different colors can be prevented from being generated during full-color printing and multi-color printing.

Next, an explanation will be provided for detecting the tip of the print tape 222 according to the tape-shaped label producing device of the second embodiment.

Figure 39:
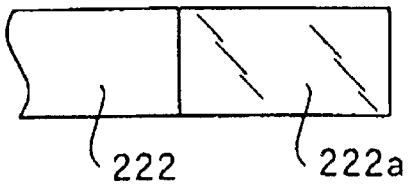
FIG. 39 (*a*) is a cross-sectional view showing a platen subroller and its drive portion according to the second embodiment.
Figure 39:
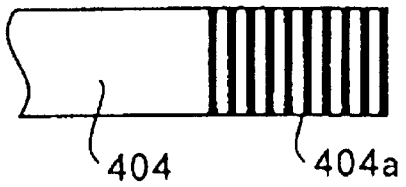

First, an explanation will be provided for tape tip detection operations when a receptor-type cassette is being used. The print tape 222 is formed from a material through which sensor light from the tip detection sensor 90 is not transmitted. Therefore, when, as shown in FIG. 39 (*a*), sensor marks 222*a* formed from a material through which sensor light can be transmitted are formed at the end portion of the print tape 222, that is, the portion within a predetermined distance from the tip of the print tape 222, then the tip detection sensor 90 will read the sensor marks 222*a* and detect the end of the print tape 222 when the end portion of the print tape 222 passes by the tip detection sensor 90.

In this way, by providing a transmission type photosensor, that is, the tip detection sensor 90, for detecting the tip of the print tape 222 and by forming a light transmitting portion at the end of the print tape 222, which is formed from a material through which sensor light from the transmission-type photosensor is not transmitted, then, the transmission-type photosensor, that is, the tip detection sensor 90, can detect the end of the print tape 222. For this reason, a greater variety of materials can be used to produce the print tape 222.

Next, an explanation will be provided for detection of the tape tip when a laminate-type cassette is mounted in the tape-shaped label producing device.

The two-sided adhesive tape 402, which is a non-transparent tape, and the transparent tape 404 are adhered to each other by the tape-feed roller 409 and the tape-feed subroller 66 and then pass through the tip detection sensor 90. Normally, two-sided adhesive tape 402 is printed in a variety of colors so that sensor light from the light-emission/light-reception element 92 is not transmitted therethrough. The two-sided adhesive tape 402 is set to be shorter than the transparent tape 404. Also, the sensor marks 404*a* indicating the end portion of the transparent tape 404 as shown in FIG. 39 (*b*) is provided to the end portion of the transparent tape 404.

Figure 40:
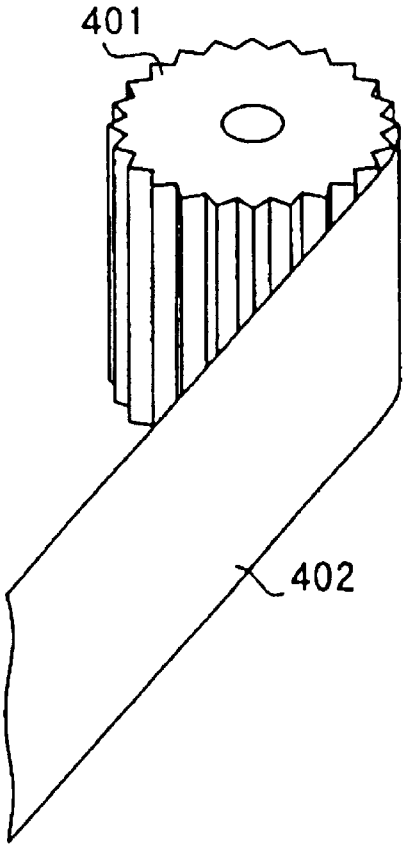
FIG. 40 is a perspective view showing a tape spool for a two-sided adhesive tape.

As shown in FIG. 40, the outer peripheral surface of the tape spool 401 is formed with rollette. Axially extending indentations and protrusions are disposed in an alignment in the peripheral direction so that the two-sided adhesive tape 402 can be more easily peeled away. Because the two-sided adhesive tape 402 is shorter than the transparent tape 404, the two-sided adhesive tape 402 ends before the transparent tape 404. The end of the two-sided adhesive tape 402 can be easily peeled away from the tape spool 401 because of the rollette surface of the tape spool 401.

Even if the end of the two-sided adhesive tape 402 peels away from the tape spool 401, because the tape-feed roller 409 and the tape-feed subroller 66 continue to rotate, when the end portion of the two-sided adhesive tape 402 passes by the tip detection sensor 90, afterward only the transparent tape 404 passes by the tip detection sensor 90. For this reason, when the sensor marks indicating the end portion of the transparent tape 404 are formed in the transparent tape 404 at a position corresponding to behind the end portion of the two-sided adhesive tape 402, then, the end portion of the transparent tape 404 can be detected by the tip detection sensor 90.

In this way, the print tape is formed from a transparent tape, that is, the transparent tape 404, adhered to a non-transparent tape, that is, the two-sided adhesive tape 402. Also, the transparent tape is made longer than the non-transparent tape. The transparent tape has at positions corresponding to past the end portion of the non-transparent tape, marks formed from portions that allow transmission of sensor light from the transmission type photosensor, that is, the tip detection sensor 90 and portions that prevent transmission of sensor light. Because of this, the end of the print tape can be detected by the transmission type photosensor, that is, the tip detection sensor 90. Because the indentations and protrusions are formed around the surface of the tape spool 401 for winding up the non-transparent tape, that is, the two-sided adhesive tape 402, therefore the non-transparent tape, that is, the two-sided adhesive tape 402, can be easily peeled away from the tape spool.

Next, an explanation will be provided for printing control when a laminate type and a receptor type cassette are used while referring to flowcharts in the drawings.

First, an explanation will be provided for printing control when a laminate-type cassette is used. It should be noted that the tape-shaped label producing device according to the second embodiment is capable of preformat printing in the same manner as the device of the first embodiment. However, this explanation will be omitted from the second embodiment. As described above, when the laminate-type cassette is used, monochrome printing only is performed using a monochrome ink ribbon 406. It should be noted that the print tape formed by adhering the two-sided adhesive tape 402 to the transparent tape 404 will be referred to as simply print tape 400 hereinafter.

Figure 41:
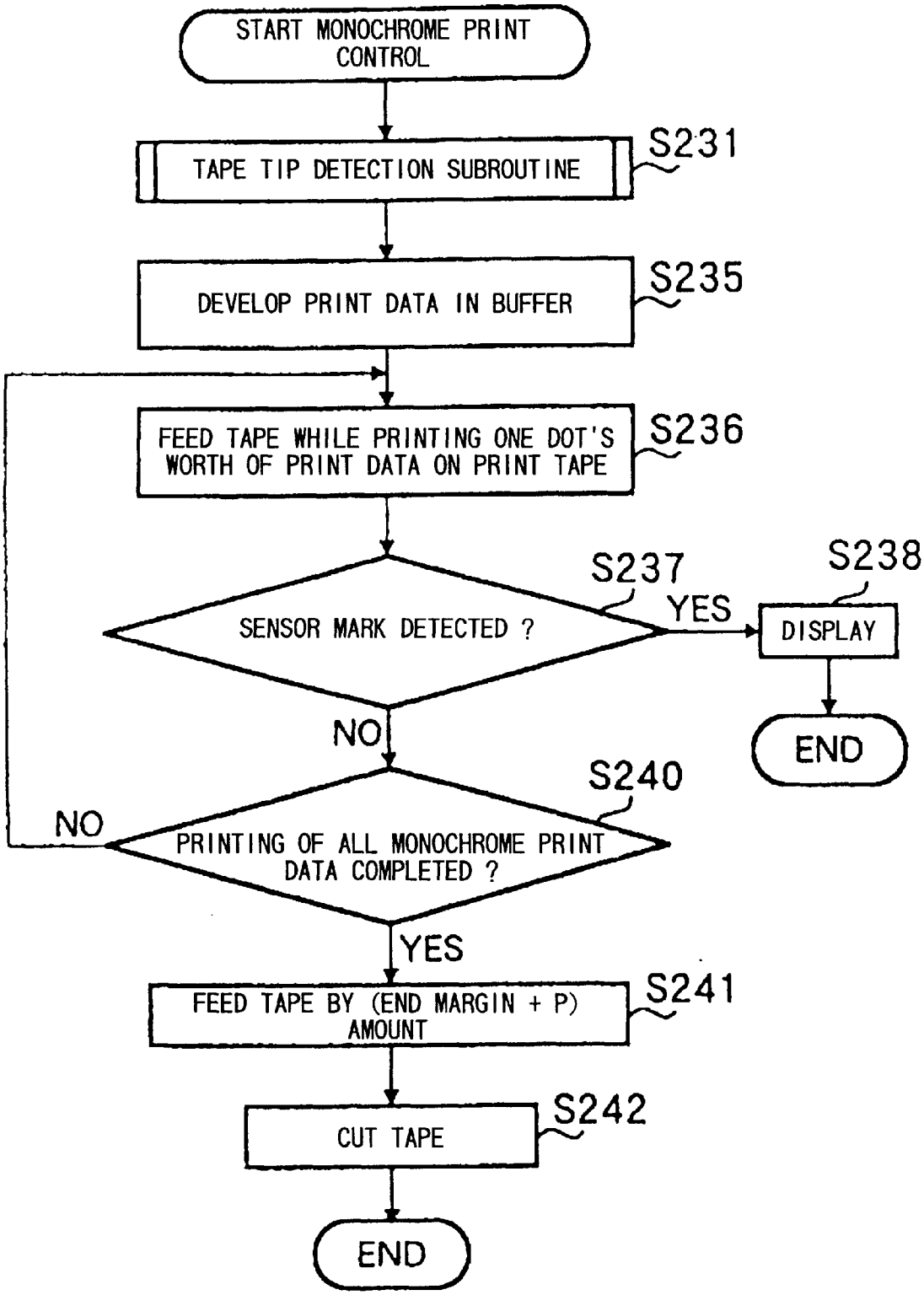
FIG. 41 is a flowchart showing a monochrome print control according to the second embodiment.

When monochrome printing control is started, then as shown in FIG. 41, first, a tape tip detection subroutine is performed in S231. During the tape tip detection subroutine shown in FIG. 42, first, the tape drive motor is driven one pulse in the transport direction is S251. Then, in S252, whether or not the tip detection sensor 90 has detected the tip of the print tape is determined. Here, S251 and S252 are repeated until the tip of the print tape 400 has been detected (S252:YES), whereupon the print start origin position is set accordingly. As described above, the print start origin position is a position indicated by S in FIG. 22 where the print tape confronts the thermal elements of the thermal head 12 when the tip of the print tape is detected. Actual printing will be started after feeding the tape by the set margin distance B1.

After the tape tip detection subroutine has been completed, then, in S235, monochrome print data is developed in the print buffer. Then, the tape is fed while one dot's worth of printing is performed on the print tape 400 in S236. Next, in S237, whether or not the tip detection sensor 90 has detected a sensor mark is determined. When a sensor mark is detected (S237:YES), then the tape end condition is determined. As a result, in S238, the tape end condition is displayed on the liquid crystal display 5 and the tape motor is stopped. This ends the printing control.

On the other hand, when a sensor mark is not detected (S237:NO), then whether or not all printing data has been printed is determined in S240. If not, then S236 to S240 are repeated. If printing has been completed (S240:YES), then the print tape 400 is transported by a predetermined amount in S241 and a message urging the user to cut the tape is displayed in S242. This ends the monochrome print control.

Next, an explanation will be provided for printing control when a receptor-type cassette is being used.

In the first embodiment, both multi-color printing and full-color printing can be performed when a receptor-type cassette is used in the device of the second embodiment. However, the following explanation will be for control of multi-color printing. An explanation for preformat printing will be omitted.

Figure 42:
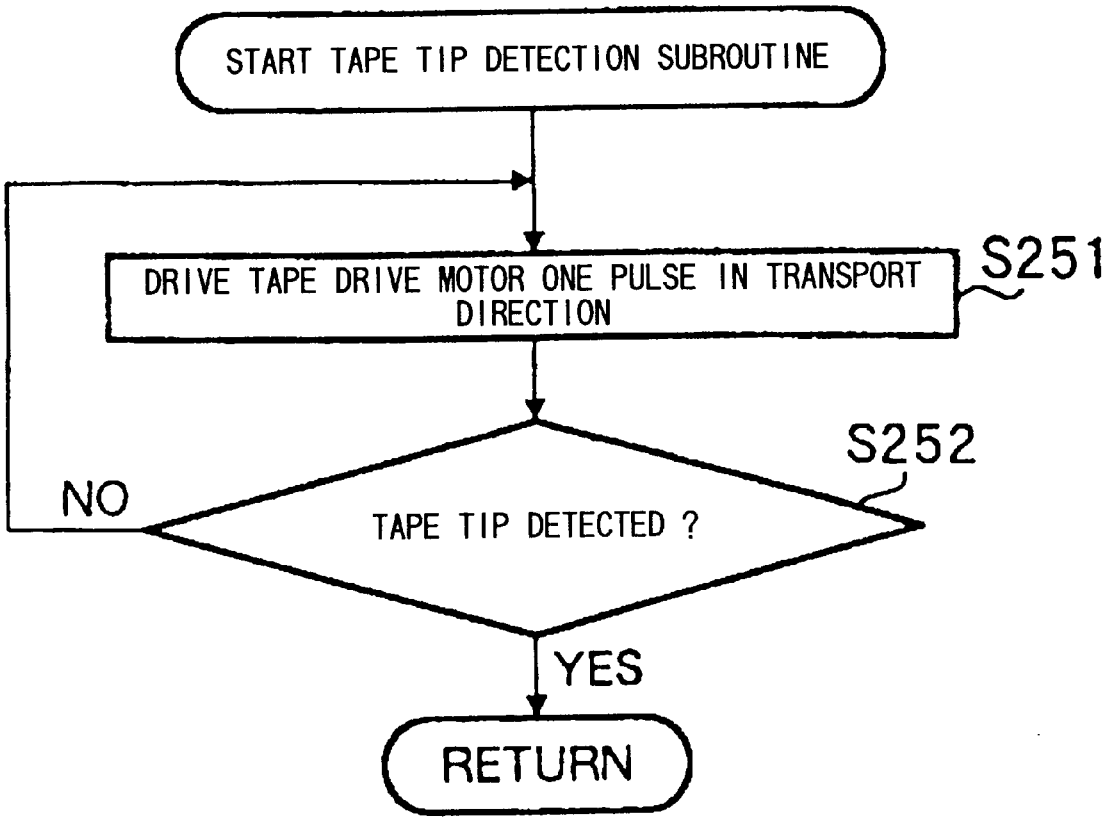
FIG. 42 is a flowchart showing a tape tip detection subroutine.
Figure 43:
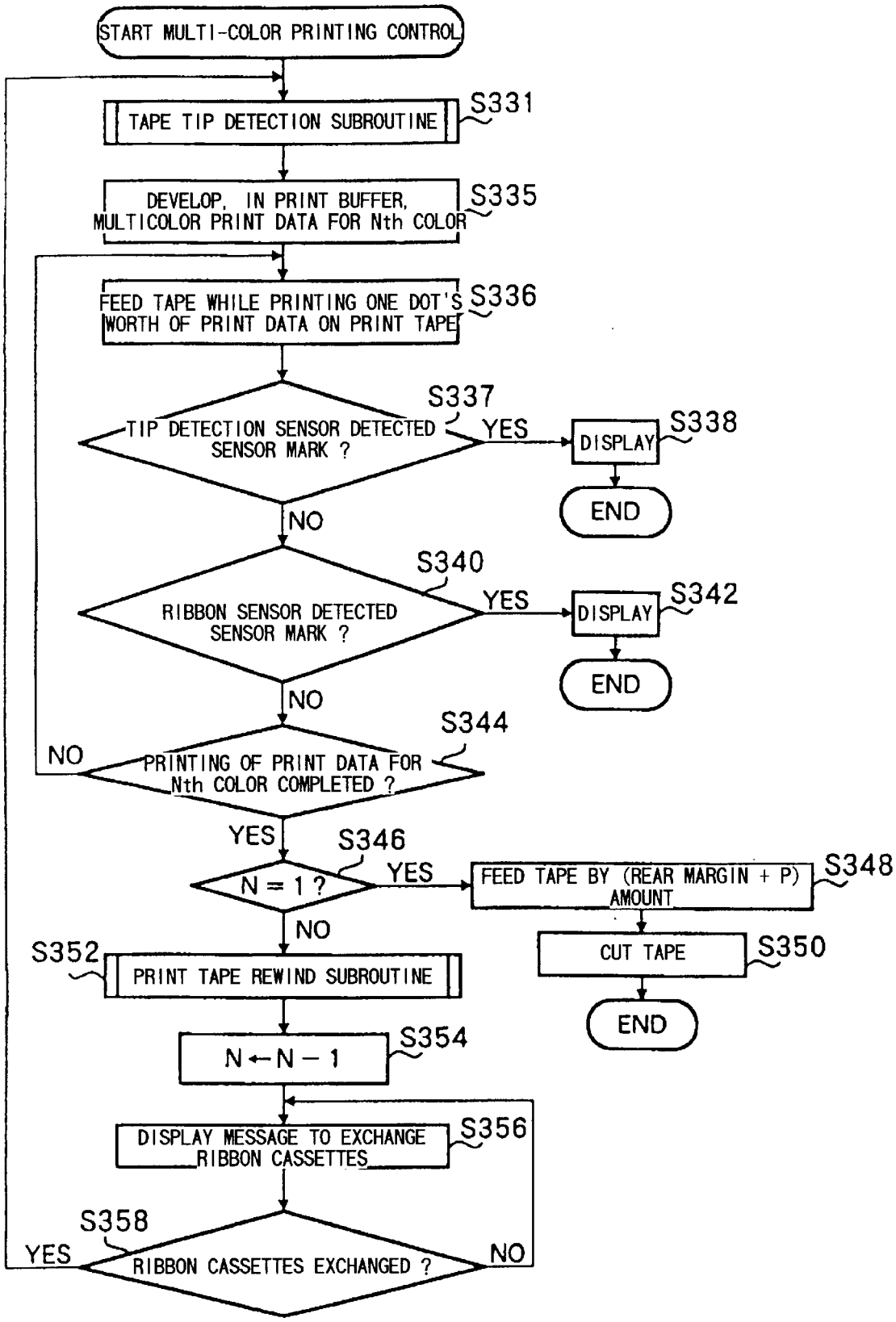
FIG. 43 is a flowchart showing a multi-color print control according to the second embodiment.

As shown in FIG. 43, when the multi-color printing control is started, then, the above-described tape tip detection subroutine shown in FIG. 42 is executed in S331. After the tape tip detection subroutine has been completed, then in S335, multi-color print data for the Nth color is developed in the print buffer. Next, printing will be performed for Nth color. In other words, in S336, the print tape is transported while performing one dot's worth of printing on the print tape 222. Then, in S337, whether or not the tip detection sensor 90 has detected a sensor mark is determined. When the tip detection sensor 90 detects the sensor mark (S337:YES), then, tape end is determined whereupon in S338 tape end is displayed on the liquid crystal display 5 and transport of the tape is stopped. This ends the print control.

On the other hand, when the tip detection sensor 90 has not detected the sensor mark, then, whether or not the ribbon sensor 70 has detected the sensor mark is determined in S340. When the ribbon sensor 70 has detected the sensor mark (S340:YES), then ribbon end is determined whereupon in S342 ribbon end is displayed on the liquid crystal display 5. Next, transport of the tape is stopped and the print control is completed.

It should be noted that because only the ink ribbon 232 passes by the ribbon sensor 70, there is no need to distinguish between tape end and ribbon end as is necessary in the first embodiment. Because no sensor marks are provided for distinguishing ink color in multi-color printing, therefore, there is no need to distinguish between the type of sensor marks by using a plurality of sensor marks.

When neither the ribbon sensor 70 nor the tip detection sensor 90 have detected a sensor mark, then in S344, whether or not print data for the present print color has been completely printed or not is determined. If not all printing has been completed (S344:NO), then S336 through S344 are repeated. When all of the print data for the present print color has been completely printed (S344:YES), then whether or not the present print color is the final color is determined in S346. If it is the final print color (S346:YES), then the tape is transported by a predetermined amount equivalent to the sum of the rear end margin amount B2 and the distance P between the print head and the cutter in S348. Then in S350, a message is displayed urging the user to cut the tape. Then, the print control is ended. On the other hand, when the present print color is not the final print color (S346:NO), then the above-described print tape rewind subroutine is executed in S352. After the print tape rewind subroutine has been completed, then the print color number N is decremented by one in S354. In S356, a message is displayed on the liquid crystal display 5 urging the user to exchange the ribbon cassette. When it is determined in S358 that the ribbon cassette is exchanged (S358:YES), then the program returns to S331. Afterwards, the same steps as described above are repeated until the printing of the final print color is completed. This ends the multi-color print control.

According to the tape-shaped label producing device 201 of the second embodiment, the end of the tape can be detected by the tip detection sensor 90 regardless of whether the presently used cassette is a receptor type or a laminate-type cassette. For this reason, there is no need to form the print tape 222 from a material capable of transmitting sensor light from the ribbon sensor 70. As a result, a greater variety of materials can be selected from for producing the print tape 222. Also, when the tape-shaped label producing device is to perform monochrome printing, there is no need to provide a ribbon sensor detect only the end of the tape so that the number of components and cost of producing the device can be reduced.

Next, an explanation will be provided for a third embodiment of the present invention.

In the third embodiment, shift in the printing position caused by eccentricity in the platen roller can be eliminated by setting the transport amount of the print tape for print processes for each color to an integral multiple of the transport amount resulting from one rotation of the platen roller. The configuration of the tape-shaped label producing device 201, the tape cassette 220, and the ribbon cassette 230 are the same as the described in the second embodiment. Next, an explanation for multi-color printing according to the third embodiment will be described with reference to FIG. 44.

It should be noted that the preformat printing and printing on a preformat tape are both possible with the configuration of the third embodiment in the same manner as the first embodiment, so an explanation will be omitted.

Figure 44:
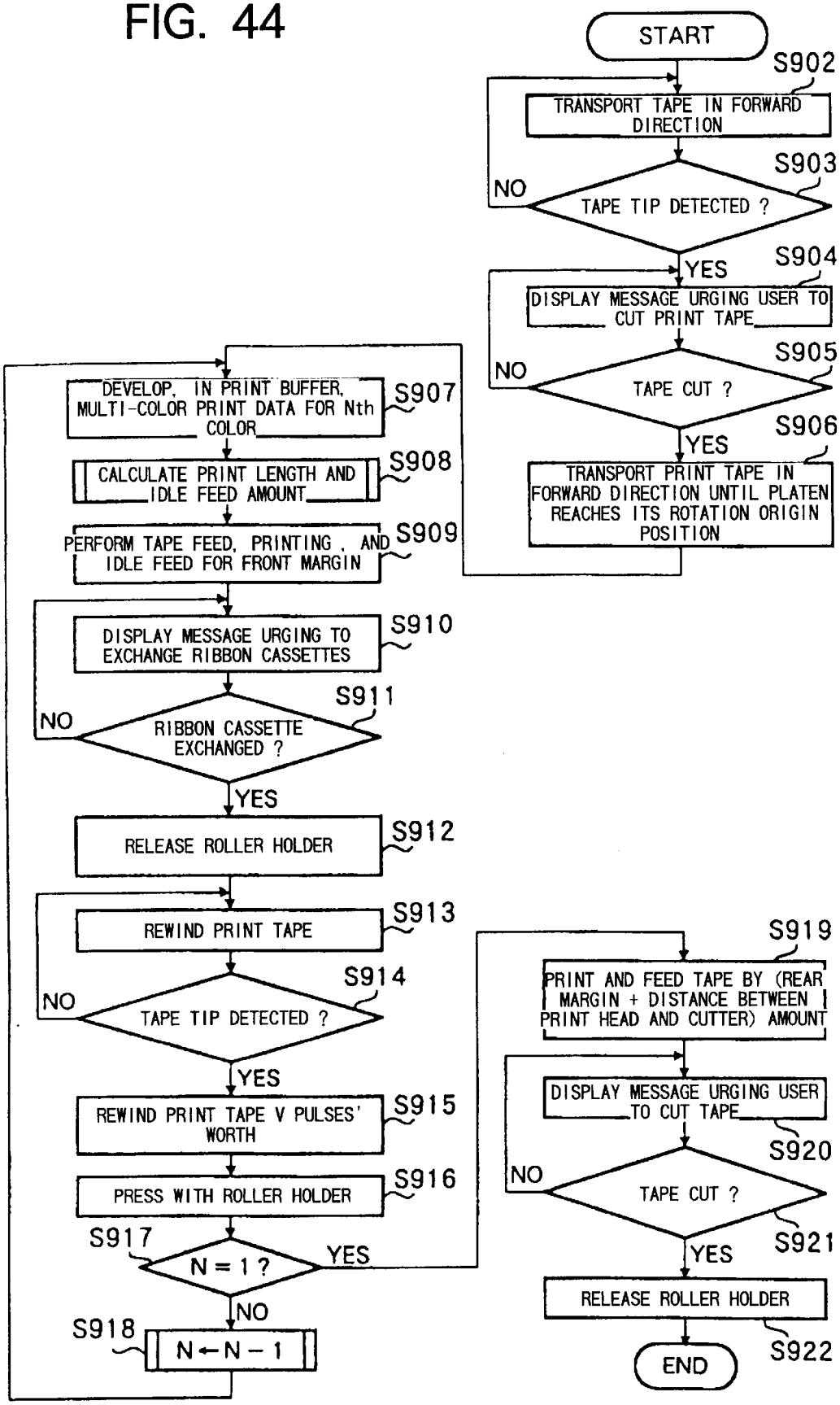
FIG. 44 is a flowchart showing a multi-color print control according to a third embodiment of the present invention.

As shown in FIG. 44, at the start of the multi-color print control, in S902, the print tape 222 is transported in the forward direction by one pulse's worth so that the tape tip can be detected. In S903, whether or not the tape tip detection sensor 90 has detected the tip of the print tape 222 is determined. If so (S903:YES), then a message is displayed urging the user to cut the print tape 222 in S904. Then, in S903, whether or not the tape has been cut is determined. When the tape has been cut (S905:YES), then in S906, the print tape 222 is transported in the forward direction for an amount corresponding to a distance from the cutter blade 84 to a predetermined origin position K.

In S907, multi-color print data of Nth color is developed in the print buffer. Next in S908, an idle feed amount corresponding to a print length F1 is calculated and set with respect to the inputted text. The idle feed amount is set so that printing, including black spaces and idle feed, results in the platen roller 64 rotating precisely an integral number of times. For example, when the print length F1 is shorter than the feed amount G for the platen roller 65, that is, when the feed amount G is greater than the print length F1, then the idle feed amount after printing will be set to the feed amount G minus the print length F1. Further, when the feed amount G is less than the print length F1 less than 2G, then the idle feed amount will be set to two times the feed amount G minus the print length F1. Further, when 2G<F1<3G, then the idle feed amount will be set to 3G–F1. Below in the same manner, the idle feed amount will be set according to the print length.

Next, in S909, tape transport, printing, and idle feed are performed for a front margin B1 shown in FIG. 22. Next, in S910, a message urging the user to exchange ribbon cassettes is displayed on the liquid crystal display 5. Once it is detected that the ribbon cassette has been changed, then in S912, the roller holder 67 is moved into its released position. In S913, the print tape 222 is rewound. Once the rewinding of the print tape 222 results in the tip of the print tape 222 being detected (S914:YES), then in S915, the print tape 222 is further rewound for V pulse's worth, whereupon rewind of the print tape 222 is stopped. The print tape 222 is rewound V pulse's worth in order to detect the tip of the tape in a stable condition. Therefore, rewinding the print tape 222 by V pulse's worth will position the print tape 222 at an origin position K.

In S916, the roller holder is pressed against the print tape 222. Then, in S917, whether or not the present print color is the final print color is determined. If the present colored is not the final print color (S917:NO), then, the print color is decremented by one in S918 and the program returns to S907. For the second and further ink colors, the above-described operations performed in S907 to S918 are again performed. When the print color is the final print color (S907:YES), then the print tape 222 is transported in S919 by a predetermined amount equivalent to the sum of the rear margin amount B2 and the distance P between the print head and cutter. Then, in S920, a message is displayed urging the user to cut the tape. When the user cuts the tape (S921:YES), then in S922, the roller holder is released so that the tape cassette and the ribbon cassette can be removed. This ends the multi-color print routine.

With this configuration, the platen roller 65 is brought into confrontation with the same position of the print tape 222 for each different print color. Said differently, when a single position on the print tape 222 is viewed, then, regardless of which print color is presently being printed, the position of the print tape 222 is in opposition with the same position of the platen roller 65. That is, regardless of what color is being printed at the position on the print tape 222, the print tape 222 will be transported at the same transport speed. Accordingly, print shift caused by varying transport speed between printings with different colors can be prevented.

In this way, according to the tape-shaped label producing device 201 of the third embodiment, the amount in which the print tape 222 is transported by the platen roller 65 during a single printing process is an integral multiple of the amount that one turn of the platen roller 65 will transport the print tape 222. Therefore, the platen roller 65 will be positioned at virtually the same position with respect to the print tape 222 for each printing. As a result, even if the platen roller 65 is slightly eccentric, no shift in print position will be generated.

The following process is conceivable as an alternative example to the printing control shown in FIG. 44. That is, operations performed before printing of the first color in the above-described embodiment are different from the operations performed before printing of the second or further print colors. That is to say, before printing of the first print color, the print tape is transported in forward direction in S906. However, before printing of the second and further print colors, the print tape is rewind in S915. Therefore, there is a possibility that the position where the platen roller 65 contacts the print tape will differ from printing of the first print color and printing of the second and further print colors.

Figure 45:
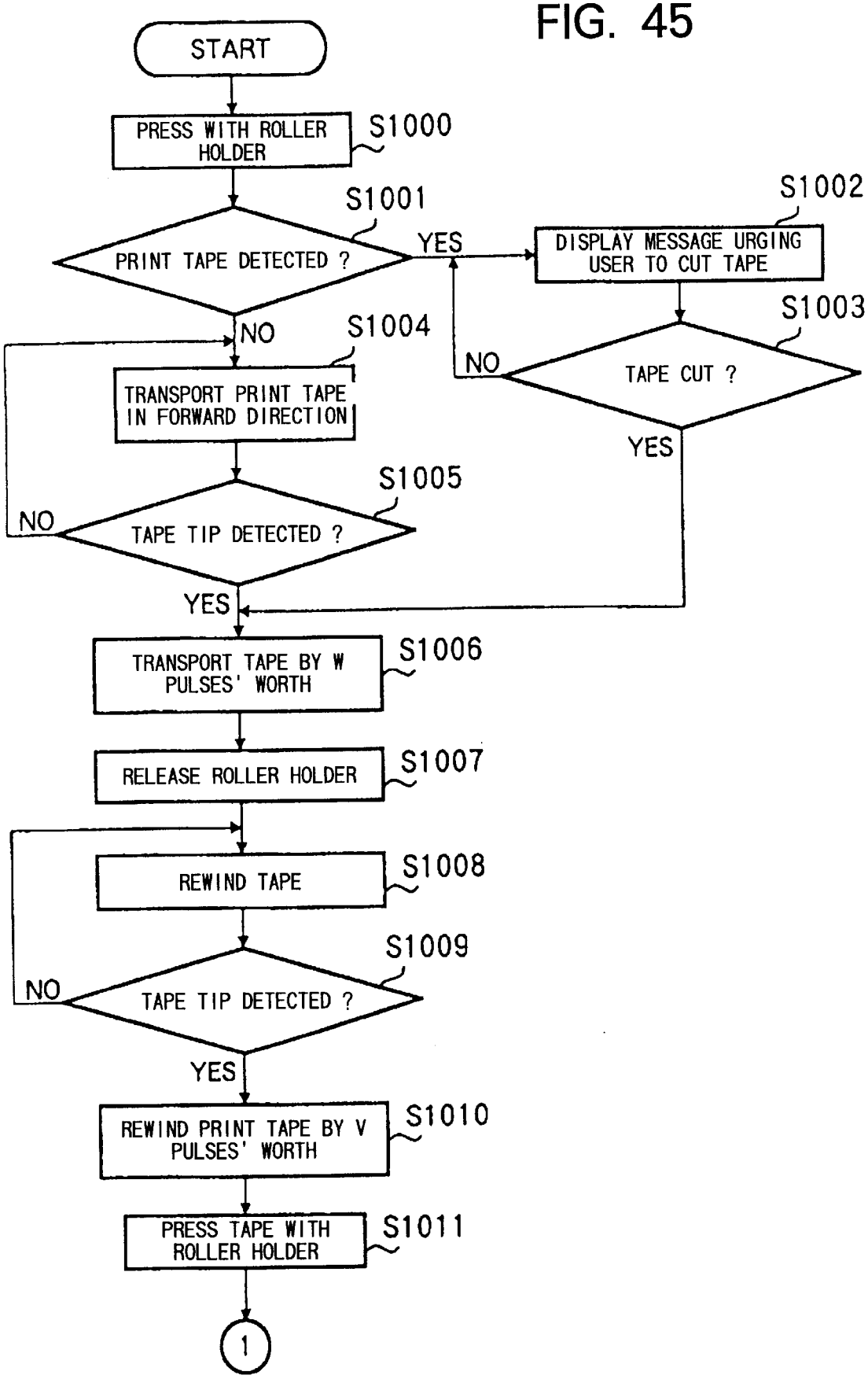
FIG. 45 is a flowchart showing a modification of the flowchart shown in FIG. 44.
Figure 46:
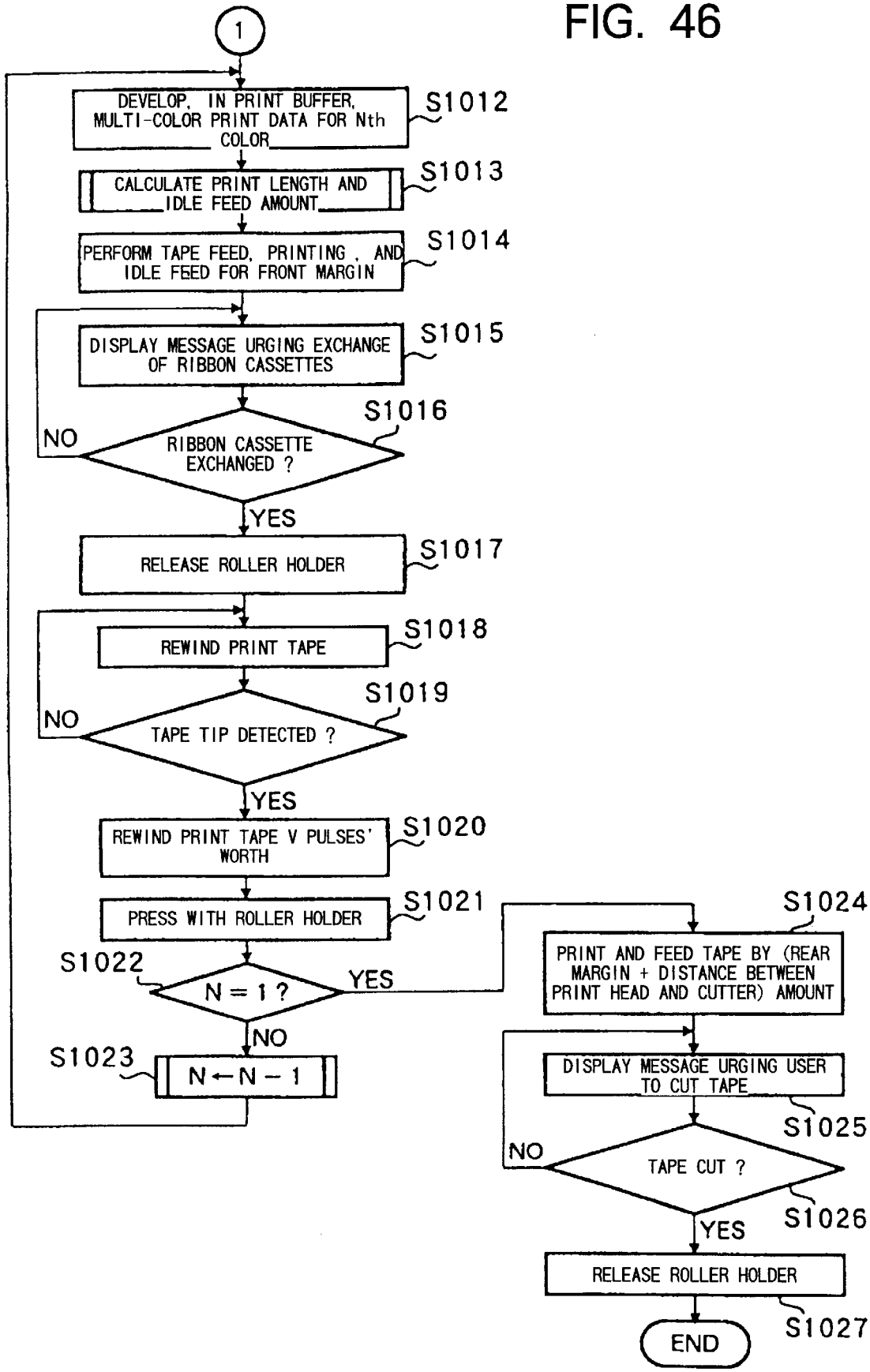
FIG. 46 is a flowchart showing a continuation of the flowchart shown in FIG. 45.
Figure 47:
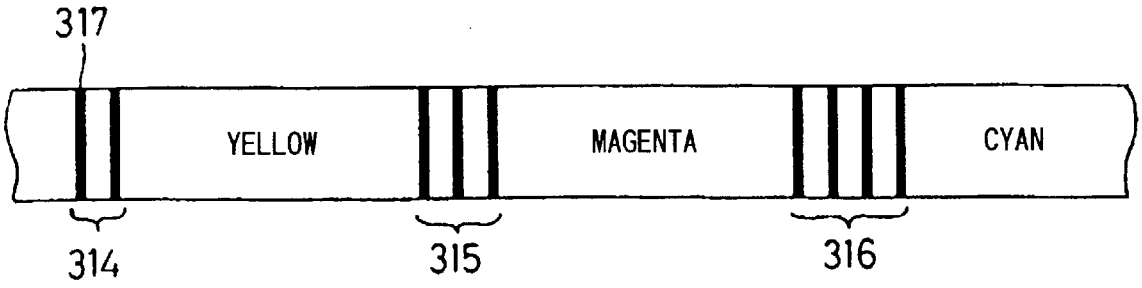
FIG. 47 is a schematic view showing conventional sensor marks on a striped type ribbon.

The print control shown in FIGS. 45 and 46 is an improvement on this point. In this example, the print tape is rewound before printing of the first print color as well as for printing of the second and the further print colors.

First, the roller holder 67 is pressed against the print tape 222 in S1000. Then in S1001, whether or not the tip detection sensor 90 has detected the print tape 222 is determined. When the tip of the print tape 222 has not been detected (S1001:NO), then the print tape 222 is transported in the forward direction in S1004. Then in S1005, again whether or not the tip detection sensor 90 has detected the print tape 222 is determined. If not (S1005:NO), then S1004 and S1005 are repeated until the tip of the print tape is detected. If during S1005, it is determined that the tip of the print tape 222 has been detected (S1005:YES), then the program proceeds to S1006.

On the other hand, in S1001, when the tip of the print tape 222 is detected (S1001:YES), then, a message is displayed urging the user to cut the tape in S1002. Then, in S1003, it is determined whether or not cutting of the print tape has been detected. If not (S1003:NO), then S1002 and S1003 are repeated until the print tape 222 is cut. Once the print tape 222 is detected as being cut (S1003:YES), then, the program proceeds to S1006.

During S1006, the print tape 222 is fed in the forward direction by W pulse's worth, then stopped. In S1007, the roller holder 67 is released. W pulses is the number of pulses required during slow-up and slow-down of the step motor when starting and stopping transport of the print tape. After transport of the print tape 222 is stopped, then in S1008, the print tape 222 is rewound. Whether or not the tip detection sensor 90 has detected the tip of the print tape 222 is determined in S1009. If not (S1009:YES), then S1008 and S1009 are repeated until the tip detection sensor 90 detects the tip of the print tape 222. When the tip of the print tape 222 has been detected (S1009:YES), then the print tape 222 is rewound for V pulse's worth in S1010. Next in S1011, the roller holder 67 is pressed against the print tape 222.

The following steps are performed in the same manner as S907 and on shown in FIG. 44. That is, as shown in FIG. 46, in S1012, multi-color print data for the Nth print color is developed in the print buffer. In S1013, idle feed amount is calculated and set. In S1014, tape transport, printing, and idle feed for the front margin B1 shown in FIG. 22 is performed. In S1015, a message urging the user to exchange the ribbon cassette is displayed. When it is detected that the ribbon cassette has been exchanged (S1016:YES), then, the roller holder 67 is released in S1017. In S1018, the print tape 222 is rewound. In S1019, whether or not the tip detection sensor 90 has detected the tip of the print tape 222 is determined. When the tip of the print tape 222 is detected (S1019:YES), then in S1020, the print tape 222 is rewound for the above-described V pulse's worth and stopped. In S1021, the roller holder 67 is pressed against the print tape 222. In S1022, whether or not the present print color is the final print color is determined. When the present print color is the final print color (S1022:NO), then the print color is decremented by one in S1023 and the program returns to S1012.

Printing is performed for the second and further print colors by repeating S1012 through S1023. When the present print color is determined to be the final print color (S1022:YES), then the print tape 222 is transported in S1024 by an amount equal to the sum of the rear margin B2 and the distance P between the print head and the cutter. In S1025, a message is displayed urging the user to cut the tape. When the tape has been cut (S1026:YES), then the roller holder 67 is released in S1027. This ends the print control.

According to the print control shown in FIG. 45 and FIG. 46, the same rewinding operation is performed in S1010 before printing the first print color and in S1020 before printing the second and further print colors. Therefore, a position where the platen roller 65 contacts the print tape during printing will always match. Accordingly, positional shift during printing can be prevented so that printing is more effective.

As described above, the tape-shaped label producing device according to the first embodiment of the present invention is provided with the keyboard 4, the CPU, and the ROM for setting print color to text; and text memory 121 for storing both data on the print color set as is and a print color set by the print color storage means broken down into a predetermined plurality of colors and stored as combination data for the plurality of colors. Accordingly, printing can be performed either by exchanging ribbons in correspondence with the set colors or by overlapping the plurality of colors based on the combination data. Because the keyboard 4, and the CPU, the ROM are capable of setting correspondence between the print colors and their respective range in the text, a desired print color can be set with respect to each optional range in the text.

By providing the platen roller 65, the tape-rewind cam 41, and the tape-transport motor 44 for transporting the tape, and the CPU for controlling the thermal head 12 to print on the print tape 22 while the print tape 22 is transported in a first direction, the print tape 22 can be printed on again while being transported in the first direction without first being printed on while being transported in a second direction opposite from the first direction. accordingly, printing can be performed a plurality of times on the same region of the print tape 22. For this reason, printing can be performed on the same region of the print tape a plurality of times.

During full-color printing, because the plurality of different colored inks are disposed in a predetermined order in different regions of the same ink ribbon 32, then there is no need to exchange the ink ribbon 32 to perform color printing. Also, because the plurality of colored inks are in the three primary colors of yellow, cyan, and magenta, composite color images can be easily formed. Because the CPU and ROM are provided for storing print colors set using the keyboard, the CPU, and the ROM in correspondence with combination data of the three primary colors, then the print colors set by the keyboard, the CPU, and the ROM are broken down into the three primary colors by merely setting the print color. The set print color will be automatically broken down into the three primary colors by referring to the predetermined correspondence table. Therefore, complicated algorithms are not necessary. Data formed by breaking down the target print color into the three primary colors can be quickly produced.

During multi-color printing, because each print color set using the keyboard, the CPU, and the ROM can be printed using corresponding one of a plurality of different colored ink ribbons 32, then the ink ribbon 32 can be used efficiently. Also, the plurality of different colored ink ribbons 32 are each housed within the different cassettes 30, and the label producing device is provided with a cassette housing portion 21*f* within which the ribbon cassettes 30 can each be freely detachably mounted. Therefore, only the cassette 30 need be exchanged to exchange the ink ribbon so that operability of tape-shaped label producing device is good. The print means has a display control means for displaying information relating to the color of the exchanged ink ribbon 32 on the display means during exchange of the ink ribbon 32. Accordingly, the user can exchange ink ribbons while following the instructions on the display.

The tape-shaped label producing device according to the first embodiment of present invention, positioning marks are printed on the print tape 22 during preformat printing and then printing is performed on the preformat tape based on the detected positioning mark. Accordingly, printing can be easily performed on an accurate position with respect to the preprinting format.

The positioning mark is printed on the print tape 22 in a color which does not reflect sensor light from reflection type photosensor configured by the light-emission/light-reception element 92 of the tip detection sensor 90. However, the print tape itself reflects the sensor light. Therefore, the positioning mark can be detected by the reflection type photosensor so that the positioning mark will not be confused for a sensor mark of the ink ribbon 32, which is detected by a transmission type photosensor.

During the preformat printing, a predetermined pattern is repeatedly printed on the print tape 22. When an image is printed on the preformat tape, the image is printed to match the preformat patterns. Therefore, names and the like can be printed at accurate positions with respects to preprinted formats of a set type label. Further, because the positioning marks are printed between the predetermined patterns, printing can always be performed at appropriate positioning with respect to the patterns.

The tape-shaped label producing device according to the first embodiment of the present invention, uses the tape cassette 20 provided with guide portions (guide axes 21*a*, 21*b*) and positioning portions (positioning axes 21*d*, 21*e*) and a ribbon cassette 30 having guided portion (guide rails 31*a*, 31*b*) and positioning portions (positioning rails 31*d*, 31*e*). When the ribbon cassette 30 is started to be mounted, the guide portions guide and position the guided portions. When mounting is completed, the positioning portions guide and position the positioning portions. Accordingly, each of these members (the shafts and rails) can be formed to a short length and so are easy to form. Further, mounting is particularly easy when a wide tape is housed in the tape cassette 20.

The guide portions (guide shafts 21*a*, 21*b*) and the positioning portions (positioning shafts 21*d*, 21*e*) are shaft-shaped members extending in the direction in which the ink ribbon cassette 30 is mounted. The guided portions and the positioned portions (guide rails 31*a,* 31*b,* positioning rails 31*d,* 31*e*) are groove-shaped portions in which the shaft-shaped members are fitted. Therefore, each of these members can be formed so as to take-up a minimum amount of space.

Because the guided portions (guide rails 31*a,* 31*b*) and the positioned portions (positioning rails 31*d,* 31*e*) are groove portions formed with a width gradually tapering in the mounting direction of the ribbon cassette, therefore, mounting is easier because resistance to sliding between the groove portions and shaft portions accompanying mounting of the ribbon cassette 30 can be decreased while maintaining positioning precision of the ribbon cassette 30. Because the guide portions are supported by the support member thinner than the guide portion itself, when the positioning portions position the positioned portions, the guided portions are separated from the guide portions. That is, resistance during mounting is decreased and mounting is further facilitated.

Because the tape-shaped label producing device according to the second embodiment of the present invention is provided with the transmission type tip detection sensor 90 for detecting the tip of the print tape 222 and also because the print tape 222, which is incapable of transmitting sensor light from the tip detection sensor 90, is formed at its end portion with portions 222*a,* 401*a,* which are capable of transmitting the sensor light, from the tip detection sensor 90, accordingly, the end of print tape 222 can be detected by the transmission type photosensor. That is, there is no need to form the print tape 222 from a material capable of transmitting the sensor light from the ribbon sensor 70 so that a broader range of materials can be selected from to form the print tape 222.

The print tape is formed by adhering a transparent tape 404 to the non-transparent two-sided adhesive tape 402. The transparent tape 404 is formed longer than the non-transparent two-sided adhesive tape 402. A non-transmissive mark 404*a* is formed to the transparent tape 404 at a portion of the transparent tape 404 extending beyond the end of the non-transparent tape. Therefore, the transmission type tip detection sensor 90 can be used to detect the end of print tape 222.

Because protrusions and indentations are formed on the surface of the tape spool 401 for taking up the two-sided adhesive tape 402, the two-sided adhesive tape 402 can be easily peeled off the tape spool 401. Therefore, the mark on the transparent tape 404 can reliably pass by the transmission type tip detection sensor 90.

The tape-shaped label producing device according to the third embodiment of the present invention is configured so that the platen roller 65 transports the print tape 222 during each single printing process by an amount equal to an integral multiple of the amount that the print tape 222 is transported by a single turn of the platen roller 65. Accordingly, with each successive printing, the platen roller 65 will contact the same position of the print tape 222 each time. Therefore, even if the platen roller 65 rotates with some eccentricity, positional shifts during printing can be prevented from occurring.

The platen roller 65 is controlled to rotate using, as a reference, a position of the platen roller 65 when the tip of the print tape passes a predetermined position. For this reason, the reference position can be accurately set based on, for example, the tip detection sensor 90 for detecting the tip of the print tape 222. Also, the platen roller 65 is controlled to perform idle feed for an amount corresponding to the difference between the print length and the transport amount of the print tape 222 by one turn of the platen roller 65. Therefore, the platen roller 65 can accurately transport the print tape 222 for a desired amount. Because the reference position for rotation of the platen roller 65 is set to the position when the print tape 222 is moved a predetermined amount from a position where the tip detection sensor 90 detects the tip of the print tape 65, the print tape 222 passes by the tip detection sensor 90 at a stable speed. Accordingly, when the tip detection sensor 90 detects the tip of the print tape, the print tape will pass the tip detection sensor 90 at a stable speed so that the detection can be performed with a fixed accuracy.

In order to achieve these objective, an ink ribbon according to the present invention is used in the print device for printing data of provided text onto a print medium. The ink ribbon is serially coated with a plurality of different colors of ink. Distinction portions for distinguishing ink color are formed on the ink ribbon at the border portions between the different colors of inks. The distinction portions are formed by a combination of a plurality of marks. At least, one of the marks is common to all the distinction portions and unrelated to any particular ink color. The other marks are set peculiar to a corresponding particular ink color. Accordingly, the ink color can be determined based on information obtained by a common mark unrelated ink color and to a mark peculiar particular ink color. The region of the distinction portions can be reduced by forming the marks in a shape which can fit in a narrow space. As a result, the usable region of the ink ribbon can be increased.

According to another aspect of the present invention, the plurality of marks are two lines extending in the width direction of the ink ribbon. One of the lines is set with a fixed width unrelated to the ink color. The other line is set with a width peculiar to a corresponding particular ink color. For example, by determining the ratio of the fixed width of the line unrelated to ink color and the width of the line set peculiar to a particular ink color, and then controlling the printing device to determine ink color based on the ratio, then the region occupied by the ink ribbon distinction portions can be reduced and the usable region of the ink ribbon can be increased.

A ribbon cassette According to the present invention houses an ink ribbon serially coated with a plurality of different colored inks. The ink ribbon includes distinction portions formed at the boundary portions between different colored inks. The distinction portions are each formed from two lines extending in the widthwise direction of the ink ribbon. One of the lines is set with a fixed width unrelated to ink color. The other line is set with a width peculiar to a particular ink color. Accordingly, when the ribbon cassette is mounted in the print device, the usable region of the ink ribbon can be increased. Therefore, the print amount can be increased compared to when a ribbon cassette housing a conventional ink ribbon is used. Therefore, the life of the cassette can be increased.

According to the ribbon cassette claimed in claim 4, the ink ribbon is housed in the cassette with a tape serving as a print medium. Therefore, the ribbon cassette can be used mounted in a tape printing device. In this case also, the tape can be printed by an amount increased compared with the conventional situation.

What is claimed is:

1. A tape cassette housing a tape that is fed in a tape feeding direction, comprising:

a cassette casing comprising upper and lower surfaces and a lateral surface extending between the upper and lower surfaces, a portion of each of the upper, lower, and lateral surfaces defining a head recess capable of accommodating a printing head support of a printing device; and the upper, lower, and lateral surfaces further defining a first slot in the head recess extending in the tape feed direction and receiving a corresponding protrusion on the printing head support, the first slot having a first opening adjacent the upper surface and a second opening adjacent the lower surface.

2. The tape cassette of claim 1, further comprising a second slot formed in the head recess and oriented substantially perpendicular to the first slot.

3. The tape cassette of claim 2, wherein the second slot has a first opening adjacent the upper surface and a second opening adjacent the lower surface.

4. The tape cassette of claim 2, wherein the tape cassette is adapted for use in a printing device wherein the printing head support comprises a first surface supporting a thermal head and a second surface opposite the first surface, the second slot of the tape cassette facing the second surface of the printing head support.

5. The tape cassette of claim 1, wherein the first slot is formed in the lateral surface and extends from the upper surface to the lower surface.

6. The tape cassette of claim 1, wherein the head recess comprises a through-hole.

7. A tape cassette, comprising:

a cassette casing;

a head recess formed in the cassette casing, the head recess capable of accommodating a printing head support of a printing device; and a first slot formed in the head recess and locating the tape cassette in a predetermined orientation relative to the printing head support.

8. The tape cassette of claim 7, wherein the first slot comprises a generally horizontally extending groove.

9. The tape cassette of claim 7, wherein the first slot is formed in a first wall of the head recess and a second slot is formed in a second wall of the head recess substantially perpendicular to the first wall.

10. The tape cassette of claim 7, wherein the cassette casing has upper and lower surfaces, and the first slot has a first opening adjacent the upper surface and a second opening adjacent the lower surface.

11. The tape cassette of claim 7, wherein the head recess comprises a through-hole.

12. A tape cassette mounting system, comprising:

a printing head support supporting a thermal printing head, the printing head support including first and second coupling ridges;

a cassette casing having a head recess formed therein for accommodating the printing head support, the cassette casing including a first slot formed in at least one wall defining the head recess, the first slot and head recess receiving the first and second coupling ridges of the printing head support.

13. The tape cassette mounting system of claim 12, wherein the first and second coupling ridges are formed on perpendicular walls of the printing head support.

14. The tape cassette mounting system of claim 12, wherein the cassette casing has upper and lower surfaces, and the first slot has a first opening adjacent the upper surface and a second opening adjacent the lower surface.

15. The tape cassette mounting system of claim 12, wherein the head recess comprises a through-hole.

16. A printing device, comprising:

a tape cassette mounting area having a base surface;

a printing head support extending upwardly from the base surface of the mounting area, the printing head support comprising a first surface supporting a thermal printing head, a second surface opposite to the first surface, a first coupling ridge on the second surface, and a second coupling ridge formed on the printing head support, the second coupling ridge positioned substantially perpendicular to the first coupling ridge on the second surface of the printing head support; and a tape cassette comprising upper and lower surfaces and a lateral surface extending between the upper and lower surfaces, a portion of each of the upper, lower, and lateral surfaces defining a head recess receiving the printing head support and the coupling ridges to locate the tape cassette in a predetermined orientation relative to the printing head support, and a first slot in the head recess that is adapted to receive the second coupling ridge on the printing head support.

17. A tape cassette for use in a printing device having a tape cassette mounting area including a base surface, a printing head support extending upwardly from the base surface, the printing head support comprising a first surface supporting a thermal printing head, a second surface opposite to the first surface, a first coupling ridge on the second surface, and a second coupling ridge formed on the printing head support, the second coupling ridge positioned substantially perpendicular to first coupling ridge on the second surface of the printing head support, the tape cassette comprising:

a cassette casing comprising upper and lower surfaces and a lateral surface extending between the upper and lower surfaces;

a head recess formed in the cassette casing and interacting with the coupling ridges of the printing head support to locate the tape cassette in a predetermined orientation relative to the printing head support when the tape cassette is mounted in the mounting area, the head recess including a slot that is adapted to receive the second coupling ridge on the printing head support.

* * * * *